US008418802B2

(12) United States Patent
Sterling et al.

(10) Patent No.: US 8,418,802 B2
(45) Date of Patent: Apr. 16, 2013

(54) PHASE PLUG AND ACOUSTIC LENS FOR DIRECT RADIATING LOUDSPEAKER

(75) Inventors: Brian Sterling, Farmington Hills, MI (US); John Sheerin, Pittsburgh, PA (US); Douglas Hogue, Farmington Hills, MI (US); Peter Premo, Charlton, MA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 13/463,258

(22) Filed: May 3, 2012

(65) Prior Publication Data

US 2012/0279797 A1 Nov. 8, 2012

Related U.S. Application Data

(62) Division of application No. 12/598,177, filed as application No. PCT/US2009/053823 on Aug. 14, 2009, now Pat. No. 8,181, 736.

(60) Provisional application No. 61/088,882, filed on Aug. 14, 2008.

(51) Int. Cl.
*G10K 11/00* (2006.01)

(52) U.S. Cl.
USPC ..... 181/176; 181/173; 181/167

(58) Field of Classification Search ..... 181/167, 181/173, 176; 381/429
See application file for complete search history.

(56) References Cited

U.S. PATENT DOCUMENTS

| | | | | |
|---|---|---|---|---|
| 834,629 | A | 10/1906 | Mobley | |
| 896,672 | A | 8/1908 | Terhune | |
| 983,416 | A | 2/1911 | Young | |
| 1,481,634 | A | 1/1924 | Thomas | |
| D67,404 | S | 5/1925 | Kirk | |
| D73,261 | S | 8/1927 | Kingsford | |
| 1,707,545 | A | 4/1929 | Wente | |
| 1,774,706 | A | 9/1930 | Fude | |
| 1,915,954 | A | 6/1933 | Scofield | |
| 2,037,187 | A | 4/1936 | Wente | 179/115.5 |
| D117,117 | S | 10/1939 | Bel Geddes | |

(Continued)

FOREIGN PATENT DOCUMENTS

| | | |
|---|---|---|
| GB | 1 557 879 | 12/1979 |
| GB | 2 437 126 A | 10/2007 |

(Continued)

OTHER PUBLICATIONS

International Search Report and Written Opinion issued in International Application No. PCT/US2009/053823, dated Nov. 9, 2009; European Patent Office, Rijswijk, The Netherlands.

(Continued)

*Primary Examiner* — Forrest M Phillips
(74) *Attorney, Agent, or Firm* — Brinks Hofer Gilson & Lione

(57) ABSTRACT

A phase plugs or acoustic lens improves the directional audio performance of a loudspeaker. Application of the improved directional audio performance to a sound system in a listening area may improve the performance of the audio system. Configuration of the acoustic lens or phase plug may include both symmetrical and asymmetrical features to provide an improved frequency response and directivity. The improved loudspeaker may provide improved an improved listing location, for example, in a vehicle.

20 Claims, 56 Drawing Sheets

U.S. PATENT DOCUMENTS

| | | | | |
|---|---|---|---|---|
| D148,192 | S | 12/1947 | Simons | D56/4 |
| D155,609 | S | 10/1949 | Hooks | D26/14 |
| D186,669 | S | 11/1959 | Richards et al. | D26/14 |
| D226,567 | S | 3/1973 | Sioles | D26/14 G |
| 3,852,529 | A | 12/1974 | Schafft | 179/1 MG |
| D234,799 | S | 4/1975 | Robson | D48/20 D |
| 3,909,530 | A | 9/1975 | Gosswiller | 179/1 E |
| D238,611 | S | 1/1976 | Fukuda | D56/4 B |
| 3,957,134 | A | 5/1976 | Daniel | 181/176 |
| D240,959 | S | 8/1976 | Imal | D56/4 B |
| 3,980,829 | A | 9/1976 | Beveridge | 179/1 GA |
| 3,995,125 | A | 11/1976 | Cypser | 179/184 |
| 4,050,541 | A | 9/1977 | Henricksen | 181/159 |
| D248,395 | S | 7/1978 | Barbera | D14/39 |
| D249,509 | S | 9/1978 | Henricksen | D14/37 |
| 4,157,741 | A | 6/1979 | Goldwater | 181/159 |
| 4,164,631 | A | 8/1979 | Garner et al. | 179/115.5 H |
| 4,283,606 | A | 8/1981 | Buck | 179/115.5 H |
| 4,454,927 | A | 6/1984 | Seebinger | 181/152 |
| D280,817 | S | 10/1985 | Ohtsuji | D14/30 |
| 4,619,342 | A | 10/1986 | Buck | 181/184 |
| 4,625,829 | A | 12/1986 | Sirois | 181/175 |
| D292,283 | S | 10/1987 | Matsuda et al. | D14/59 |
| 4,726,444 | A | 2/1988 | Iida et al. | 181/176 |
| 4,768,615 | A | 9/1988 | Steinebrunner et al. | 181/157 |
| 4,799,264 | A | 1/1989 | Plummer | 381/158 |
| 5,117,462 | A | 5/1992 | Bie | 381/156 |
| D339,138 | S | 9/1993 | Jung | D14/221 |
| 5,274,709 | A | 12/1993 | Koizumi | 381/24 |
| 5,298,690 | A | 3/1994 | Klein | 181/152 |
| D375,463 | S | 11/1996 | Bohannan | D10/120 |
| D376,149 | S | 12/1996 | Moose | D14/214 |
| 5,623,133 | A | 4/1997 | Kurihara | 181/175 |
| D384,076 | S | 9/1997 | Lazzeroni et al. | D14/216 |
| D405,088 | S | 2/1999 | Chen | D14/214 |
| 5,878,148 | A | 3/1999 | Alexandrov | 381/339 |
| 6,094,495 | A | 7/2000 | Rocha | 381/340 |
| 6,118,883 | A | 9/2000 | Rocha | 381/387 |
| D449,293 | S | 10/2001 | Irby et al. | D14/219 |
| D450,778 | S | 11/2001 | Engebretson | D21/221 |
| 6,334,505 | B1 | 1/2002 | Li | 181/192 |
| 6,385,324 | B1 | 5/2002 | Köppen | 381/336 |
| D465,779 | S | 11/2002 | Solland | D14/219 |
| 6,533,063 | B1 | 3/2003 | Ikeuchi et al. | 181/176 |
| D473,213 | S | 4/2003 | Abdo | D14/219 |
| D473,214 | S | 4/2003 | Dayan | D14/219 |
| D473,215 | S | 4/2003 | Dayan | D14/219 |
| 6,567,529 | B1 | 5/2003 | Roark | 381/423 |
| D478,560 | S | 8/2003 | Misrahi et al. | D14/150 |
| D483,350 | S | 12/2003 | Chen | D14/216 |
| D486,816 | S | 2/2004 | Nakajima et al. | D14/169 |
| 6,738,483 | B1 | 5/2004 | Betts | 381/160 |
| D493,445 | S | 7/2004 | Iijima et al. | D14/216 |
| D506,748 | S | 6/2005 | Garretson et al. | D14/221 |
| D506,992 | S | 7/2005 | Suzuki | D14/221 |
| D506,993 | S | 7/2005 | Suzuki | D14/221 |
| D510,084 | S | 9/2005 | Hasbrook | D14/221 |
| D517,048 | S | 3/2006 | Huang | D14/215 |
| 7,016,514 | B2 | 3/2006 | White et al. | 381/397 |
| 7,095,868 | B2 | 8/2006 | Geddes | 381/343 |
| 7,130,438 | B2 | 10/2006 | Lin | 381/337 |
| D531,620 | S | 11/2006 | Tanaka et al. | D14/221 |
| 7,142,680 | B2 | 11/2006 | Gelow et al. | 381/182 |
| 7,178,629 | B2 | 2/2007 | Vincenot | 181/191 |
| 7,200,240 | B2 | 4/2007 | Ohara | 381/404 |
| D549,692 | S | 8/2007 | Mizokawa | D14/216 |
| D549,693 | S | 8/2007 | Mizokawa | D14/216 |
| 7,266,211 | B2 | 9/2007 | Ikeuchi | 381/391 |
| D554,617 | S | 11/2007 | Solland | D14/207 |
| 7,298,862 | B2 | 11/2007 | Dedieu et al. | 381/386 |
| 7,316,290 | B2 * | 1/2008 | Hutt et al. | 181/176 |
| 7,324,656 | B2 | 1/2008 | Iwayama et al. | 381/386 |
| 7,333,626 | B2 | 2/2008 | Opie et al. | 381/345 |
| D566,682 | S | 4/2008 | Marash | D14/149 |
| D567,225 | S | 4/2008 | Nakane et al. | D14/216 |
| D573,980 | S | 7/2008 | Nakane et al. | D14/216 |
| 7,397,927 | B2 | 7/2008 | Pircaro et al. | 381/398 |
| D576,153 | S | 9/2008 | Sei | D14/216 |
| 7,596,236 | B2 | 9/2009 | Vincenot | 381/160 |
| 7,929,726 | B1 * | 4/2011 | Jones | 381/431 |
| 8,181,736 | B2 | 5/2012 | Sterling et al. | 181/176 |
| 8,254,615 | B2 * | 8/2012 | Schultz | 381/343 |
| 2003/0042068 | A1 | 3/2003 | Lee | 181/155 |
| 2004/0131218 | A1 | 7/2004 | Dedieu et al. | 381/338 |
| 2004/0156519 | A1 | 8/2004 | Geddes | 381/343 |
| 2004/0182642 | A1 | 9/2004 | Hutt et al. | 181/176 |
| 2005/0078850 | A1 | 4/2005 | Norton | 381/423 |
| 2005/0084127 | A1 | 4/2005 | Norton | 381/338 |
| 2005/0105753 | A1 | 5/2005 | Manzini et al. | 381/343 |
| 2005/0265570 | A1 * | 12/2005 | Isotalo | 381/337 |
| 2005/0286735 | A1 * | 12/2005 | Ikeuchi | 381/391 |
| 2006/0034475 | A1 | 2/2006 | Geddes | 381/343 |
| 2006/0083402 | A1 | 4/2006 | Ohara | 381/429 |
| 2006/0159299 | A1 | 7/2006 | Iwayama et al. | 381/337 |
| 2006/0171551 | A1 | 8/2006 | Klein | 381/351 |
| 2006/0233417 | A1 | 10/2006 | Steere et al. | 381/409 |
| 2006/0277254 | A1 | 12/2006 | Kenoyer et al. | 709/204 |
| 2006/0285712 | A1 * | 12/2006 | Butler | 381/340 |
| 2007/0025583 | A1 | 2/2007 | Weil | 381/391 |
| 2007/0116313 | A1 | 5/2007 | Seagrove | 381/337 |
| 2007/0201718 | A1 * | 8/2007 | Shimoe et al. | 381/396 |
| 2008/0006476 | A1 | 1/2008 | Kling | 181/176 |
| 2008/0130933 | A1 | 6/2008 | Hayashi | 381/354 |
| 2008/0212822 | A1 | 9/2008 | Basnet et al. | 381/398 |
| 2009/0310808 | A1 * | 12/2009 | Button et al. | 381/339 |

FOREIGN PATENT DOCUMENTS

| | | |
|---|---|---|
| JP | 60-224396 | 11/1985 |
| JP | 08-331684 | 12/1996 |
| JP | 2004-193749 | 7/2004 |
| JP | 2008-177967 | 7/2008 |

OTHER PUBLICATIONS

EAW Products, "Apparent Apex Error is the Problem. CSA Technology is the Solution." http://www.eaw.com/products/AX/CSA_technology.html; printed Dec. 1, 2009 (2 pgs.)

European Examination Report, dated Jan. 20, 2012, pp. 1-5, issued in European Patent Application No. 09791521.9, European Patent Office, Germany.

Japanese Office Action, dated Jun. 4, 2012, issued in Japanese Patent Application No. 2011-523189, Japanese Patent Office, Tokyo, Japan (10 pgs.) with English translation.

Korean Office Action dated Feb. 26, 2012, issued in Korean Patent Application No. 10-2011-7003418, Korean Intellectual Property Office, Korea, 7 pgs., with English translation.

* cited by examiner

Top View

PHASE PLUG AND ACOUSTIC LENS FOR DIRECT RADIATING LOUDSPEAKER

PRIORITY CLAIM

This application is a divisional of, and claims priority under 35 U.S.C. §120 to, U.S. patent application Ser. No. 12/598,177, filed Oct. 29, 2009, now U.S. Pat. No. 8,181,736, entitled "PHASE PLUG AND ACOUSTIC LENS FOR DIRECT RADIATING LOUDSPEAKER," which is the U.S. National Phase under 35 U.S.C. §371 of PCT Application Serial No. PCT/US2009/053823, filed Aug. 14, 2009, entitled "PHASE PLUG AND ACOUSTIC LENS FOR DIRECT RADIATING LOUDSPEAKER," and which claims the benefit of U.S. Provisional Application Ser. No. 61/088,882, filed Aug. 14, 2008, entitled "PHASE PLUG FOR DIRECT RADIATING SPEAKER," each of which is incorporated by reference in its entirety.

BACKGROUND OF THE INVENTION

1. Technical Field

The present invention relates to loudspeakers, and more particularly, to direct radiating loudspeakers and modifying the directivity of sound radiation.

2. Related Art

Automotive sound systems currently suffer from different tonal balance in different listening positions due to the directivity characteristics of direct radiating loudspeakers. Sound energy radiating into the surrounding ambient space within an automobile may result in different tonal balance characteristics depending upon the relative position of the listener to the loudspeaker.

A typical loudspeaker may have a low directivity at low frequencies. The speaker's response may have increased directivity and/or nulls in the frequency response at higher frequencies. Accordingly, the speaker will not provide the same frequency response or tonal quality for each listener depending upon the listener's relative position to the speaker. The response difference may result in reduced high frequency output at some listening positions. Additionally, the response at angles away from a primary axis of the speaker may have a different character from the response on the primary axis. Typically, the different character of the off-axis performance cannot be corrected electronically.

SUMMARY

To overcome the aforementioned difficulties, a need exists for an improved loudspeaker that provides sound radiation having very low and uniform directivity over a relatively wide frequency range. Lower, more uniform directivity may be obtained by using a phase plug to guide sound energy from the sound producing surface of a speaker, through an aperture with a smaller area than the sound producing surface of the speaker. Depending upon the features of the phase plug, the phase plug may cause nulls in the response of the speaker assembly at higher frequencies.

One example assembly includes a speaker coupled to an acoustic lens. The union of the acoustic lens to the speaker form a substantially air tight or resistant seal. The seal may be created by using a gasket between the acoustic lens and the speaker. Alternatively, the seal may be created by gluing the acoustic lens to the speaker.

An acoustic lens may typically include a centrally located aperture. The centrically located aperture may be configured to move resonance points of the acoustic lens. The centrally located aperture may have various shapes. Example shapes include circular, elliptical, etoile, estoile, triangular, or star-like. The shapes may be irregular shaped. The lengths of the sides of the shapes may be identical or non-identical. The aperture may be substantially two dimensional or three dimensional. Apertures may be created by a grouping of perforations that form an effective aperture.

To reduce distortion and insertion loss, the acoustic lens may further include vents, supplementary apertures, or auxiliary apertures. Similar to the central aperture, each supplemental aperture may have various shapes.

The examples described herein provide both apparatuses and methods to improve the directivity performance of a sound system. In addition, application of unique structural formations and asymmetric features provides improved directivity while reducing the effects of nulls in the frequency response at higher frequencies.

In one example, a sound system includes a loudspeaker having a mounting feature and a sound generation surface. A phase plug may be mounted to the mounting feature of the loudspeaker to provide improved directional audio performance. In at least one example, an acoustic lens may include a first member and a second member coupled together to form a passageway from the speaker sound generation surface to ambient air. The first member may also include a first surface and a second surface. The first surface and the second surface may unite to form a first edge defining a perimeter of the first member. A union of the first surface and the second surface may also form an internal lip defining petals around an orifice. The second surface may further include protrusions surrounding the orifice. The first member and the second member may be attached by way of support members. The support members may protrude from the second surface and each support member may be attached to one of the petals.

The third surface may include support points, where each support member is joined to one of the support points so that the second surface confronts the third surface. Each of the petals may include a deflection away from the third surface. The second member includes a third surface and a fourth surface. The third surface further may include a protuberance having a zenith oriented towards the orifice.

The fourth surface may further include a beveled edge. The beveled edge may define the perimeter of a depression substantially centered in the fourth surface. The fourth surface may be oriented to face the sound generation surface of the speaker. The fourth surface may be sculptured to provide a gap between the sound generation surface and phase plug. The gap between the sound generation surface and the phase plug allows movement of the sound generation surface without interference.

The third surface may further include a plurality of the protrusions, where each protrusion has a first protrusion face and a second protrusion face. Each first protrusion face may be beveled to face the sound generation surface of the speaker. Each second protrusion face may be beveled to substantially face the third surface. The third surface further may also include channels. Each of the channels may be positioned between two of the plurality of protrusions.

The phase plug may include openings oriented to face the sound producing surface. Each opening may be formed by the second surface, the third surface, and two of the support members. Two of the supports may be adjacent. Each of the openings may define or form a cross-sectional area. In addition, at least one of the cross-sectional areas of one of the openings may have a cross-sectional area different from a cross-sectional area of at least one of the other openings. The differences in cross-sectional area may provide an asymmetrical feature to provide different resonant behavior from each opening.

The protuberance of the third surface may be shaped in a substantially conical form to aid the deflection of sound energy through the phase plug. The orifice of the first member may include a cross-section shaped as an etoile or estoile. Alternatively, the orifice may include a star-like, estoile, or etoile shape or appearance. In at least one example, the star-like, estoile, or etoile shape may be symmetrical or have an even number of radiating points. Other examples may include a star, estoile, or etoile shape having an asymmetrical property or an odd number of radiating points. The star-like, estoile, or etoile shape may provide pathways for sound energy to propagate and thereby provide improved frequency response or improved directivity performance. The asymmetrical properties provide different pathways for sound energy to propagate through the phase plug, which distributes resonances over a range of frequencies. Each pathway has a different resonance frequency. The distribution of resonances may provide an overall improved frequency response for the system.

Another example of the phase plug is configured to improve the directional audio performance from a sound system. In particular, the phase plug may be configured to provide improved directional audio performance in an automobile or vehicle. The phase plug may include a first member having a first surface and a second surface. The union of the first surface and second surface form a first edge that forms a perimeter of the first member. A second union of the first surface and second surface forms an internal lip to form protrusions positioned about an orifice of the phase plug. Each protrusion may include an edge. The plurality of edges may combine to form one or more openings, through or in the first member. The openings through or in the first member may include a slice or wedge. The wedges or slices may form one or more openings through the first member to create or define the orifice. Intersections of each protrusion with one of the adjacent protrusions may further form or delineate a vertex for a slice or wedge shaped opening in or through the first member. The first member may further include support members emanating from the second surface.

The phase plug may include a second member attached to the first member. The second member may include a third surface and a fourth surface, where the third surface faces the second surface. The third surface may also include a dome feature surrounded by support positions. Each of the support members may be joined to the third surface at one of the support positions to attach the first member to the second member. In addition, each of the protrusion of the first member may include a deflection away from the third surface.

The phase plug may also include apertures, where each aperture is formed by the combination of the second surface, the third surface, and two of the plurality of support members. The apertures may be connected to the orifice of the phase plug to permit sound energy to radiate through the apertures and out of the orifice.

The phase plug may also be configured such that each vertex of each slice or opening is associated with one of the apertures. In some examples, at least one slice or opening is asymmetrically aligned with one of the apertures associated with at least one slice. In other examples, multiple slices are asymmetrically aligned with one of the associated apertures. The alignment of the apertures and slices work in combination to form channels for sound to pass through the phase plug. Each channel may propagate acoustic energy in a different manner. As a result, the combined outputs of the respective channels provide an improved sound power response. The combined outputs may also provide improved directivity.

In still another example, an apparatus to improve the directional audio performance from a sound system includes a loudspeaker having a mounting feature and a sound generation surface. The sound system may also include a phase plug mounted to the mounting feature of the loudspeaker. The phase plug may include a first member and a second member. The first member may include a first surface and a second surface that includes a first union and a second union. The first union of the first surface and the second surface form a perimeter edge. The second union of the first surface and the second surface form an internal lip to define protrusions around an orifice of the phase plug. The orifice of the phase plug may be positioned to radiate into the ambient air of a vehicle or automobile. The second surface may further include protuberances positioned about the orifice. The first member may further include support members protruding from the second surface.

The second member of the phase plug may further include a third surface and a fourth surface, where the third surface further has support positions. Each support member may be joined to one of the support positions. The phase plug further includes openings oriented to face the sound generation surface of the speaker. Each of the openings may be in communication with or connected to the orifice to provide a path for sound energy to move from the surface of the loudspeaker and through the phase plug. Each of the openings may be formed by the third surface, two of the support members that are adjacent, and at least two of the protuberances. The fourth surface may also be configured to face the sound generation surface of the speaker.

Another example further includes a phase plug to improve the directional audio performance from a sound system. The phase plug may include a first member including a first surface and a second surface. A first union of the first surface and the second surface form a first edge that forms or defines a perimeter of the first member. A second union of the first surface and the second surface may form an internal edge that forms or defines protrusions, where the protrusions form a boundary or perimeter of an aperture. The protrusions may conform substantially to the surface of a conical frustum. The conical frustum may have a zenith that forms a plateau. The aperture may include at least one opening at the zenith of the conical frustum. The aperture may include slices or wedges through the conical frustum to create a flower petal-like structure that is symmetric about a central axis and having an asymmetrical number of petal-like members. Each of the slices may radiate from the opening at the zenith of the conical frustum between an adjacent pair of the protrusions.

In addition, the first member may further include support members emanating from the second surface. A second member may include a third surface and a fourth surface. The third surface may include support points, and each support member may join to one of the support points. The phase plug may also include apertures. Each of the apertures may be formed by the second surface, the third surface, and two of the plurality of support members, where two of the plurality of support members are adjacent.

Another example of a phase plug to improve the directivity of a speaker includes a first member and a second member. The first member may include a first surface and a second surface joined to create a peripheral edge. The first and second surface may also include a union to form an interior lip. The interior lip may include an aperture edge formed by a set of substantially parabolic curved edges delineated in three dimensions to form an aperture. The aperture may have substantially parabolic curved edges that further delineate or form wedged shaped openings radiating outwardly from a central opening.

The second member of the phase plug may include a third surface and a fourth surface. The third surface may be oriented to substantially face the second surface, where the union of the third surface and the fourth surface form a perimeter edge.

Support members may join the first member and the second member, where each support member includes a first end attached to the second surface, and each support member further includes a second end attached to the third surface. The second and third surfaces may be separated by a void or opening to allow passage of sound energy through the phase plug. Each of the openings may be formed by the second surface, the third surface, and two of the support members, where two of the support members are adjacent, where each wedged shaped opening is oriented towards one of the openings and where each wedge shaped opening projects beyond the perimeter edge of the second member.

The orientation and surface of the wedge shapes may be configured to provide additional channeling effects to improve the directivity of the sound emanating from the orifice. The aperture of the phase plug may have an effective cross-sectional area. Each of the openings may have an opening cross-sectional area. The openings cross-sectional area may be combined to form an effective opening cross-sectional area. The aperture effective cross-sectional area and the effective opening cross-sectional area may include different ratios as compared to the area of the sound generation surface. Adjustments to the ratio may lessen air noise and other distortion effects.

In some examples, a summation of the opening cross-sectional area of each of the openings is about the same or equal to the effective cross-sectional area of the aperture. The aperture effective cross-sectional area and the effective opening cross-sectional area may be adjusted to either a compressive or non-compressive ratio to lessen air noise. Additionally, a summation of the opening cross-sectional area may be between two and ten times smaller than the sound generation surface. Alternatively, the summation of the opening cross-sectional area may be any size as compared to the sound generation surface depending upon directivity, sound power, and fidelity requirements of the sound system.

Another example includes an acoustic lens for improving directivity performance of a speaker assembly. The acoustic lens may include a member including a first surface and a second surface. The first surface and the second surface may unite to form a first edge to define a perimeter, where the perimeter includes a mounting feature. The first surface and the second surface may further unite to form a plurality of perforations arranged to define an effective aperture through the member. The member may further include a solid portion that lies between the effective aperture and the mounting feature, and where at least some portion of the solid portion lies substantially in a first plane.

In addition, the mounting feature may include a foot feature that lies in a second plane. The foot feature may be conformed to mate with a speaker to form a substantially air tight seal between the speaker and the foot feature of the member. A portion of the effective aperture may include a dome surface having an apex and a dome base, where the apex lies in the first plane, and the dome base lies close to a third plane, and where the third plane lies between the first plane and the second plane. The member further includes a substantially conical segment that lies between the dome base of the dome surface and the solid portion. The substantially conical segment of the acoustic lens may also include at least a portion of the substantially conical segment includes a portion of the plurality of perforations.

Also, the plurality of perforations of the acoustic lens may be arranged to form a border of the effective aperture, and where the outer border of the effective aperture includes at least one of an etoile shape, an estoile shape, and a star-like shape. Alternatively, or in addition, the dome surface may be formed as a convex dome. The connection between the substantially conical segment and the convex dome may also form a contour or fold.

In another example of the acoustic lens, the plurality of perforations arranged to define the effective aperture through the member are further arrange to form an imperforated portion centrally located in the effective aperture.

An acoustic lens for improving directivity performance of a speaker assembly may include a member including a first surface and a second surface, where the first and second surface unite to create a first union. The first union forms an internal lip to define a plurality of protrusions surrounding an orifice. In addition, the first surface and the second surface further unite to form a perimeter of the member, where the perimeter includes a mounting feature.

The mounting feature may include a foot portion conformed to mate with a speaker to form a substantially air tight seal between the speaker and the foot portion of the member. Each of the protrusions include an outer contour that intersects with the outer contour of an adjacent one of the protrusions to form a plurality of outer vertices with respect to a central point of the orifice, where the protrusions further includes interiorly located vertices with respect to the central point of orifice.

In some examples, the interior vertex of the plurality of protrusions and outer vertices of the orifice combine to form an irregular etoile shape. A first outer vertex of the outer vertices is located at a first outer vertex distance from the central point of the orifice, and a second outer vertex of the outer vertices is located at a second outer vertex distance from the central point of the orifice. In addition, a first interiorly located vertex of the plurality of interiorly located vertices is located a first distance from the central point of the orifice, while a second interiorly located vertex of the plurality of interiorly located vertices is located at a second distance from the central point of the orifice.

In other examples, the first surface and the second surface may unite to form a plurality of perimeters of a plurality of auxiliary apertures. At least one of the auxiliary apertures may be located in a portion of one of the protrusions. Otherwise, at least one of the auxiliary apertures may be an effective auxiliary aperture formed by a plurality of perforations within a perimeter of the at least one of the auxiliary apertures. One or more of the perimeters of one of the auxiliary apertures defines a cross-sectional area that may have a shape of an etoile-like form, an estoile-like form, or a circle-like form. Alternatively, one of the perimeters of the auxiliary apertures may define a cross-sectional area that includes a triangular-like shape or a circular-like shape. In addition, the summation of each cross-sectional aperture surface area may be related to a determined volume displacement through the summation of the combined cross-sectional areas of the orifice and all of the auxiliary apertures.

An assembly of a speaker mated to an acoustic lens may be optimized to improve directivity and power output of the speaker. The acoustic lens may include a first surface and a second surface. The first surface and the second surface may unite to form an internal lip to define an orifice that is centrally located in the acoustic lens, where the orifice includes a primary cross-sectional area. The first surface and the second surface further unite to form a perimeter of the acoustic lens, where the perimeter includes a mounting feature. The mounting feature may include a foot portion conformed to mate with the speaker to form a substantially air tight seal between the speaker and the foot portion of the acoustic lens. In addition, the first surface and the second surface further unite to form a plurality of supplementary lips to define a plurality of supplementary apertures.

The supplementary lips of the acoustic lens may define cross-sectional areas for each of the supplementary apertures and the cross-sectional area of each of the supplementary apertures includes a triangular-like shape. The triangular-like shape may include a base and a vertex. Each of the supplementary apertures may be oriented to locate the vertex of the triangular-like shape nearest to the orifice and to locate the base of the triangular-like shape nearest to the perimeter of the acoustic lens. The supplementary lips may define cross-sectional areas of each of the supplementary apertures, where the supplementary apertures are evenly distributed around the internal lip of the orifice. The supplementary lips of the acoustic lens may define cross-sectional areas for each of the supplementary apertures. The cross-sectional areas of all the supplementary apertures may be identical.

The speaker of the assembly may include a diaphragm. The summation of the cross-sectional areas of the supplementary lips may be selected based upon a cross-sectional area of the orifice and a volume displacement of the diaphragm to minimize distortion and insertion loss. In addition, the cross-sectional area of the orifice may be selected based upon a volume displacement of a diaphragm of the speaker.

Another acoustic lens for improving directivity performance and frequency response of a speaker assembly includes a speaker and an acoustic lens mated to the speaker. The acoustic lens may include a first surface and a second surface. The first surface and second surface may unite to form a first edge to define a perimeter, where the perimeter includes a mounting feature. The first and second surface may also unite to form a plurality of perforations arranged to define an effective aperture through the acoustic lens. The acoustic lens may also include a solid portion that lies between the effective aperture and the mounting feature, where at least some portion of the solid portion lies substantially in a first plane. The mounting feature of the acoustic lens may include a foot feature that lies in a second plane. The foot feature is conformed to mate with the speaker to form a substantially air tight seal between the speaker and the foot feature of the acoustic lens. Also, a portion of the effective aperture may include a convex dome surface having an apex and a dome base, where the apex that lies close to the first plane, and the convex dome base lies close to a third plane, and where the third plane lies between the first plane and the second plane.

The acoustic lens further may include a substantially conical segment that lies between the convex dome base of the dome surface and the solid portion that surrounds the effective aperture. At least a portion of the substantially conical segment may include a portion of the plurality of perforations. The plurality of perforations may be arranged to form a border of the effective aperture, and where the outer border of the effective aperture includes at least one of an etoile shape, an estoile shape, and a star-like shape.

Another speaker assembly may include a speaker and an acoustic lens. The speaker may include a mounting ring and a diaphragm, where the speaker includes a volume displacement of the diaphragm "Vd", where the volume displacement is a volume of air that is displaced by movement of the diaphragm. The acoustic lens including a centrally located aperture having a cross-sectional aperture surface area, "S", where the acoustic lens is mated to the mounting ring of the speaker to form a substantially air tight seal. The cross-sectional aperture surface area of the speaker may be configured to obtain a desired sound pressure level (SPL) insertion loss, IL, of the acoustic lens with respect to the speaker within a range of frequencies, where the insertion loss $$IL \approx 0.01\left(\frac{V_d}{S}\right)^2 + 0.001\left(\frac{V_d}{S}\right)$$

[in dB] within a desired range of frequencies.

Another speaker assembly for improved directivity performance of a radiating speaker may include a speaker and an acoustic lens. The acoustic lens may include a first surface and a second surface, where the first surface and the second surface unite to form a perimeter of the acoustic lens. The perimeter of the acoustic lens may include a mounting feature, and where acoustic lens is mated to the mounting feature to form a substantially air tight seal between the speaker and acoustic lens. In addition, the first surface and the second surface unite to define a perimeter of an aperture substantially located in a central location of the acoustic lens. The central location of the acoustic lens may be located approximately centered over a sound producing surface of the speaker.

The effective aperture of the acoustic lens may include a plurality of perforations arranged to define the perimeter of the effective aperture through the acoustic lens. The perimeter of the effective aperture of the acoustic lens may form an etoile-shaped form.

Other systems, methods, features, and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Phase plugs may provide a way to achieve low directivity over wider bandwidth than previously possible. The lower directivity may enable sound systems designs such as automotive sound system designs that have about the same tonal balance at each listening position within a listening area, such as in a vehicle. Alternatively, phase plugs may be used to improve the tonal balance at particular listening positions.

Improved loudspeaker directivity may be obtained by locating a phase plug in front of the diaphragm of a loudspeaker. Sound radiates from the diaphragm of the loudspeaker and passes through multiple spaced slots in the phase plug to communicate sound from the diaphragm to the surrounding environment. Unlike previous uses of phase plugs to direct sound into a horn, the sound energy radiates from the phase plug into an ambient environment without a horn.

Figure 1:
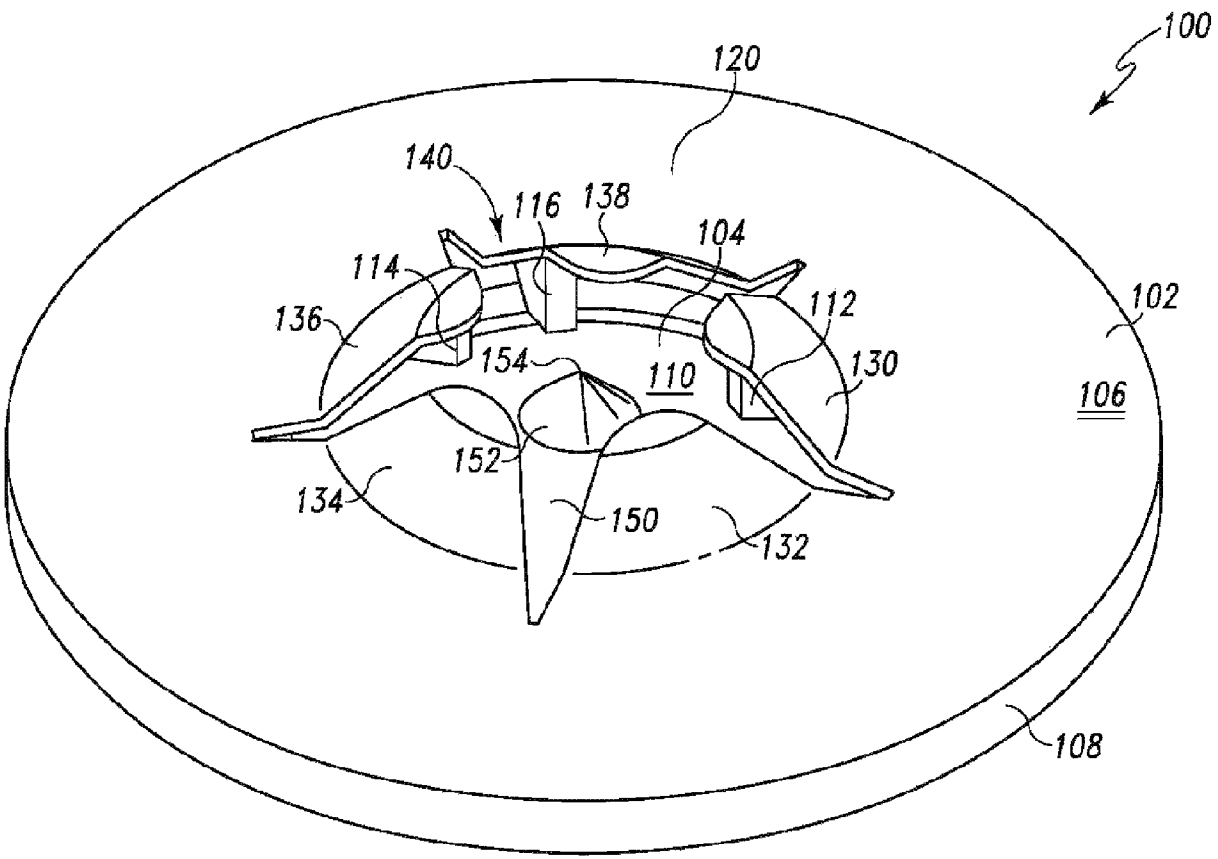
FIG. 1 depicts a perspective view of the top of an example of a phase plug.
Figure 2:
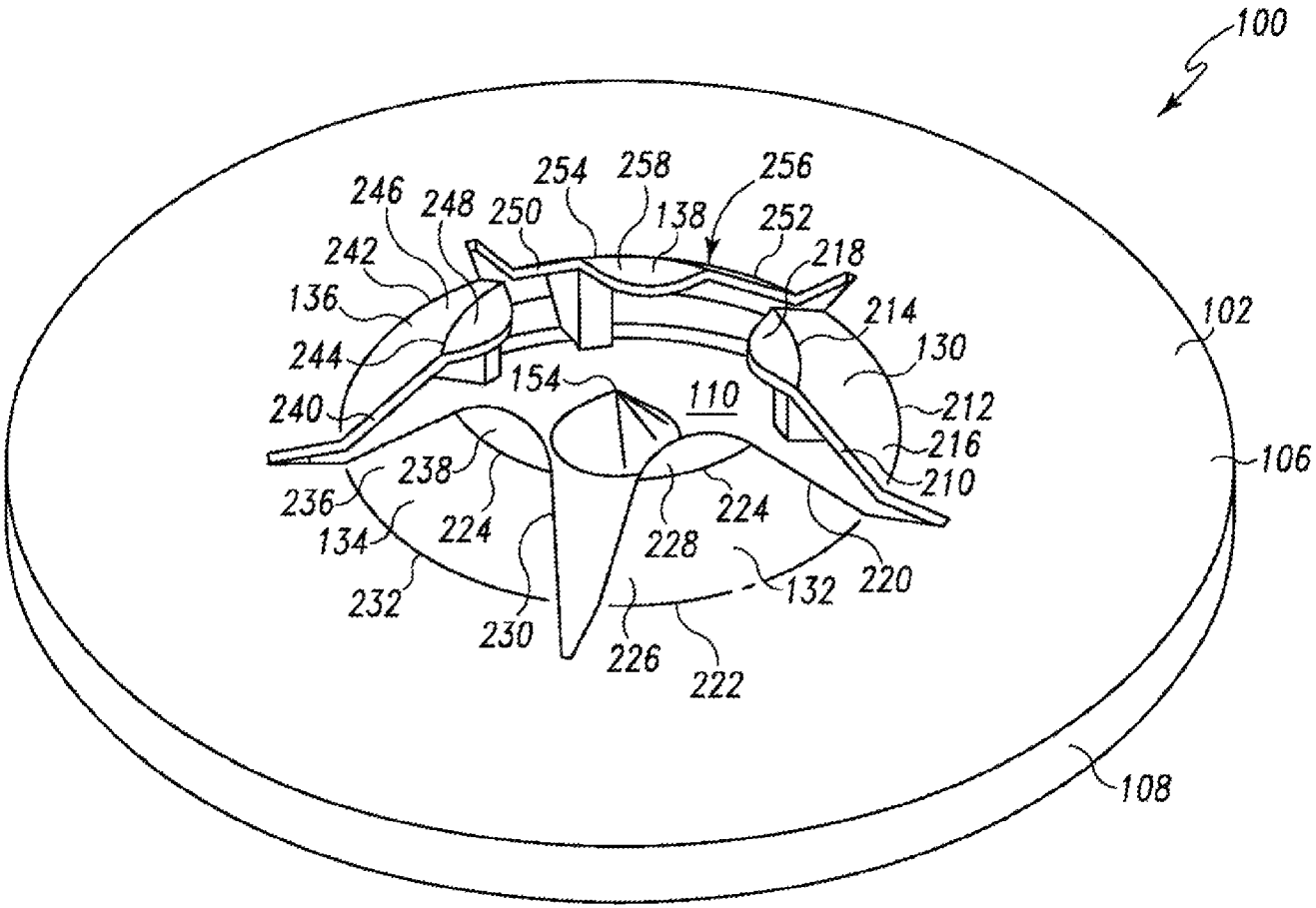
FIG. 2 further depicts a perspective view of the top of an example of a phase plug as shown in FIG. 1.

In FIGS. 1-6, Phase plug 100 includes a first member 102 and a second member 104. The first member 102 includes a first surface 106. The first member 102 includes a second surface 406; the second surface 406 in FIG. 4 and described in greater detail below. The second member 104 includes a third surface 110. The second member 104 further includes a fourth surface 410, which is also in FIG. 4. In FIG. 1, the first member 102 and second member 104 are joined by a first support member 112, second support member 502 (in FIG. 5), third support member 504 (in FIG. 5), fourth support member 114, and fifth support member 116.

Figure 4:
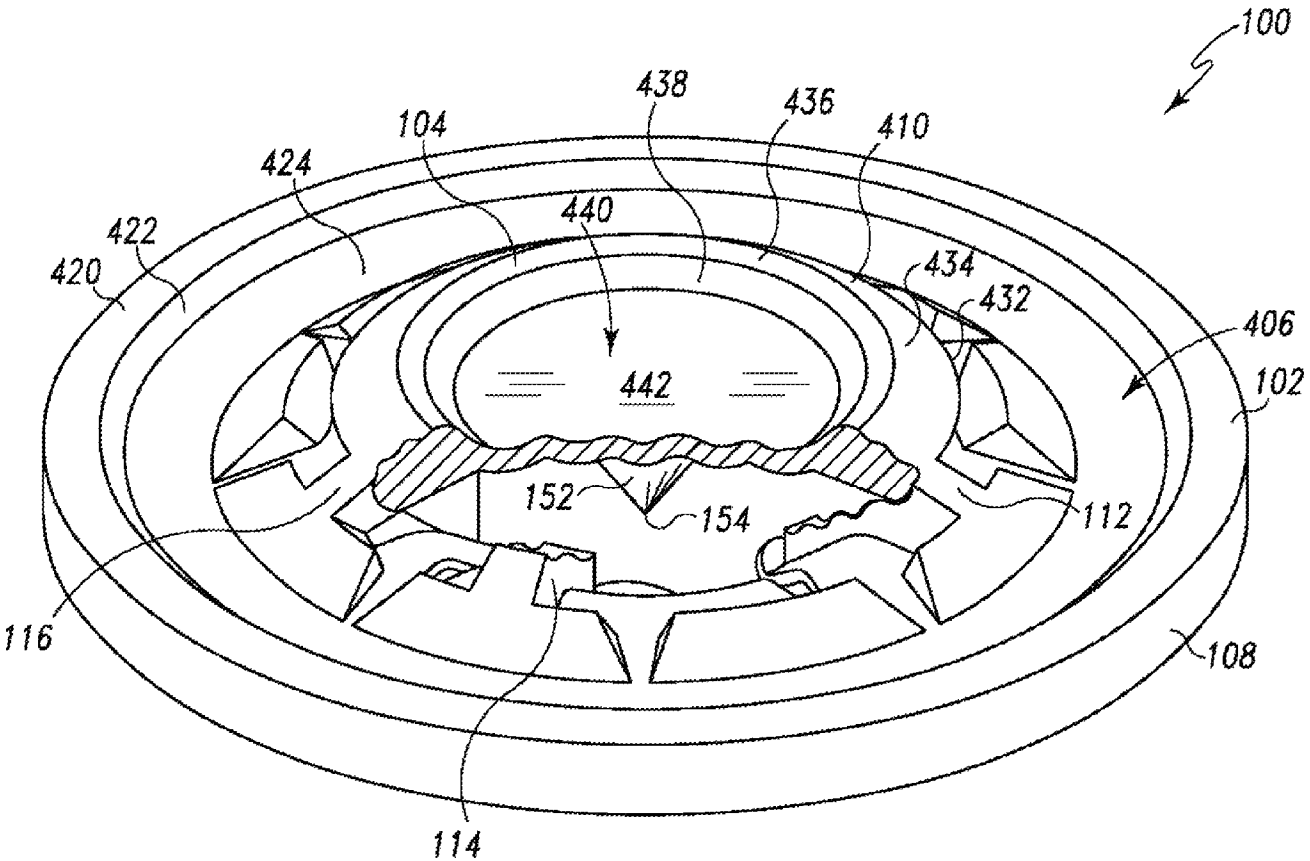
FIG. 4 depicts a cut-away perspective view an example of a phase plug.

A first union of the first surface 106 and second surface 406 in FIG. 4 creates an outer perimeter edge 108. A second union of the first surface 106 and second surface 406 also forms an interior edge or a lip 120. The lip 120 includes a curved surface in three dimensions forming the perimeter of a first petal 130, a second petal 132, a third petal 134, a fourth petal 136, and a fifth petal 138.

The first petal 130 includes a first petal edge 210, a first deflection 212, and a second deflection 214. The first deflection 212, second deflection 214, and first petal edge 210 of the first petal 130 enclose a first petal surface 216. The first petal edge 210 and second deflection 214 of the first petal 130 enclose a second petal edge 218. The first petal 130 may have a zenith at about the location of the second petal surface 218.

The second petal 132 includes a first petal edge 220, a first deflection 222, and a second deflection 224. The first deflection 222, second deflection 224, and first petal edge 220 of the second petal 132 enclose a first petal surface 226. The first petal edge 220 and second deflection 224 of the second petal 132 enclose a second petal surface 228. The second petal 132 may have a zenith at about the location of the second petal surface 228.

The third petal 134 includes a first petal edge 230, a first deflection 232, and a second deflection 234. The first deflection 232, second deflection 234, and first petal edge 230 of the third petal 134 enclose a first petal surface 236. The first petal edge 230 and second deflection 234 of the third petal 134 enclose a second petal surface 238. The third petal 134 may have a zenith at about the location of the second petal surface 238.

The fourth petal 136 includes a first petal edge 240, a first deflection 242, and a second deflection 244. The first deflection 242, second deflection 244, and first petal edge 240 of the fourth petal 136 enclose a first petal surface 246. The first petal edge 240 and second deflection 244 of the fourth petal 136 enclose a second petal surface 248. The fourth petal 136 may have a zenith at about the location of the second petal surface 248.

The fifth petal 138 includes a first petal edge 250, a first deflection 252, and a second deflection 254. The first deflection 252, second deflection 254, and first petal edge 250 of the fifth petal 138 enclose a first petal surface 256. The first petal edge 250 and second deflection 254 of the fifth petal 138 enclose a second petal surface 258. The fifth petal 138 may have a zenith at about the location of the second petal surface 258.

The first support member 112 may be fluidly joined to interior surfaces of first petal 130. The fifth support member 116 may be fluidly joined to interior surfaces of fifth petal 138. The fourth support member 114 may join fluidly to an interior surface of fourth petal 136. The third support member 504 may be fluidly joined to an interior surface of the third petal 134. The second support member 502 may fluidly join to an interior surface of the second petal 132

The first petal edge 210 and second petal edge 220 intersect to form a first notch 310. The second petal edge 220 and third petal edge 230 intersect to form a second notch 320. The third petal edge 230 and fourth petal edge 240 intersect to form a third notch 330. The fourth petal edge 240 and fifth petal edge 250 intersect to form a fourth notch 340. The fifth petal edge 250 and first petal edge 210 intersect to form a third notch 350.

The edge or lip 120 forms an opening or an orifice 140. The petals 130, 132, 134, 136, and 138 may be arranged about the orifice 140. The orifice 140 may be centered approximately in the center of the first member 102. The petals 130, 132, 134, 136, and 138 may be equally distributed around the orifice 140. In addition, petals 130, 132, 134, 136, and 138 may have substantially similar symmetries. In other examples, petals 130, 132, 134, 136, and 138 may be distributed unevenly about the orifice 140. In addition, in other examples, the petals 130, 132, 134, 136, and 138 may have an asymmetric or non-uniform size, thickness, appearance, or shape or a combination thereof. Alternatively, some examples may have an even number of petals while other examples may have an odd number of petals.

As a non-limiting example, the orifice 140 includes a generally star-like shape, estoile, or etoile configuration in cross-section. Orifice 140 includes a central aperture 360. The orifice 140 of the first member 102 further includes a star-like shaped, an estoile shaped, or an etoile shaped configuration having five radiating slices 312, 322, 332, 342, and 352. In other examples, the star-like shaped, the estoile shaped, or the etoile shaped configuration may have an odd number of radiating slices or wedges. Alternative examples may have an even number of radiating slices or wedges.

A first radiating slice 312 may be formed or defined by the first petal edge 210, the first notch 310, the second petal edge 220, and the central aperture 360. The first radiating slice 312 projects from the central aperture 360 towards first notch 310 and terminates at a first radiating end point 314.

A second radiating slice 322 may be formed or defined by the second petal edge 220, the second notch 320, the third petal edge 230, and the central aperture 360. The second radiating slice 322 projects from the central aperture 360 towards the second notch 320 and terminates at a second radiating end point 324.

A third radiating slice 332 may be formed or defined by the third petal edge 230, the third notch 330, the fourth petal edge 240, and the central aperture 360. The third radiating slice 332 projects from the central aperture 360 towards the third notch 330 and terminates at a third radiating end point 334.

A fourth radiating slice 342 may be formed or defined by the fourth petal edge 240, the fourth notch 340, the fifth petal edge 250, and the central aperture 360. The fourth radiating slice 342 projects from the central aperture 360 towards the fourth notch 340 and terminates at a fourth radiating end point 344.

A fifth radiating slice 352 may be formed or defined by the fifth petal edge 250, the fifth notch 350, the first petal edge 210, and the central aperture 360. The fifth radiating slice 352 projects from the central aperture 360 towards the fifth notch 350 and terminates at a fourth end point 354.

The star-shaped, estoile shaped, or etoile shaped configuration may further include five radiating end points 314, 324, 334, 344, and 354. The first radiating point 314 is formed by the first notch 310. The second radiating point 324 is formed by the second notch 320. The third radiating point 334 is formed by the third notch 330. The fourth radiating point 344 is formed by the fourth notch 340. The fifth radiating point 354 is formed by the fifth notch 350.

Other examples of the phase plug 100 may include differing numbers of intersections or slices to form orifice 140. The orifice 140 may also be configured to have a substantially inverted polygon like shape. The orifice may also be configured to include a contoured shape resembling an ellipse or circular form. Alternatively, the orifice may include a square, rectangular or boxy form or feature. Still other examples of the orifice may have include a polygonal feature. In addition, the orifice may be configured in a generally asymmetric geometry. The petals 130, 132, 134, 136, and 138 may be rounded, substantially elliptical, parabolic, non-uniform, or asymmetric in form. The petal edges 210, 220, 230, 240, and 250 may come to a substantially thin or tapered edge.

In FIG. 4, the second surface 406 includes mounting collar 420 formed between an interior edge 422 and perimeter edge 108 of the first member 102. The mounting collar 420 may be configured to interface the phase plug 100 with a speaker assembly. The interior edge 422 may be differentiated from the second surface 406 by an internal surface 424 configured to sit above the surface of the speaker in the speaker assembly.

The third surface 110 may also include a raised or dome feature 150 having a zenith 154. The raised feature may further include a protuberance or protrusion 152 projecting from the third surface 110. The protuberance or protrusion 152 may include the zenith 154 of the third surface. The protrusion 152 may have a conical form. In other examples, protuberance 152 may include a convex surface rising from the base of a conoid to the zenith 154. Alternatively, protuberance 152 may have a convex surface. In still other examples, the protrusion 152 may have a truncated form including a substantially flat portion at the zenith 154.

The union of a third surface 110 and a fourth surface 410 may form an edge 432. The fourth surface 410 may further include a first sloping surface 434 and a second sloping surface 438. The first sloping edge 434 and second sloping surface 438 may form a rounded surface or edge 436 configured to sit above the sound producing portion of a speaker. Rounded surface 436 may be beveled or sculpted to minimize turbulence in the air volume produced by the sound generating surface of a speaker.

Fourth surface 410 may further include a depression 440 enclosed by the rounded surface 436. The depression 440 may have a bowl or concave feature that reaches a nadir 442. The nadir 442 may be located substantially in the center of the fourth surface 410. Nadir 442 may be located opposite the zenith 154 of the raised portion 150 of the third surface 110.

Figure 5:
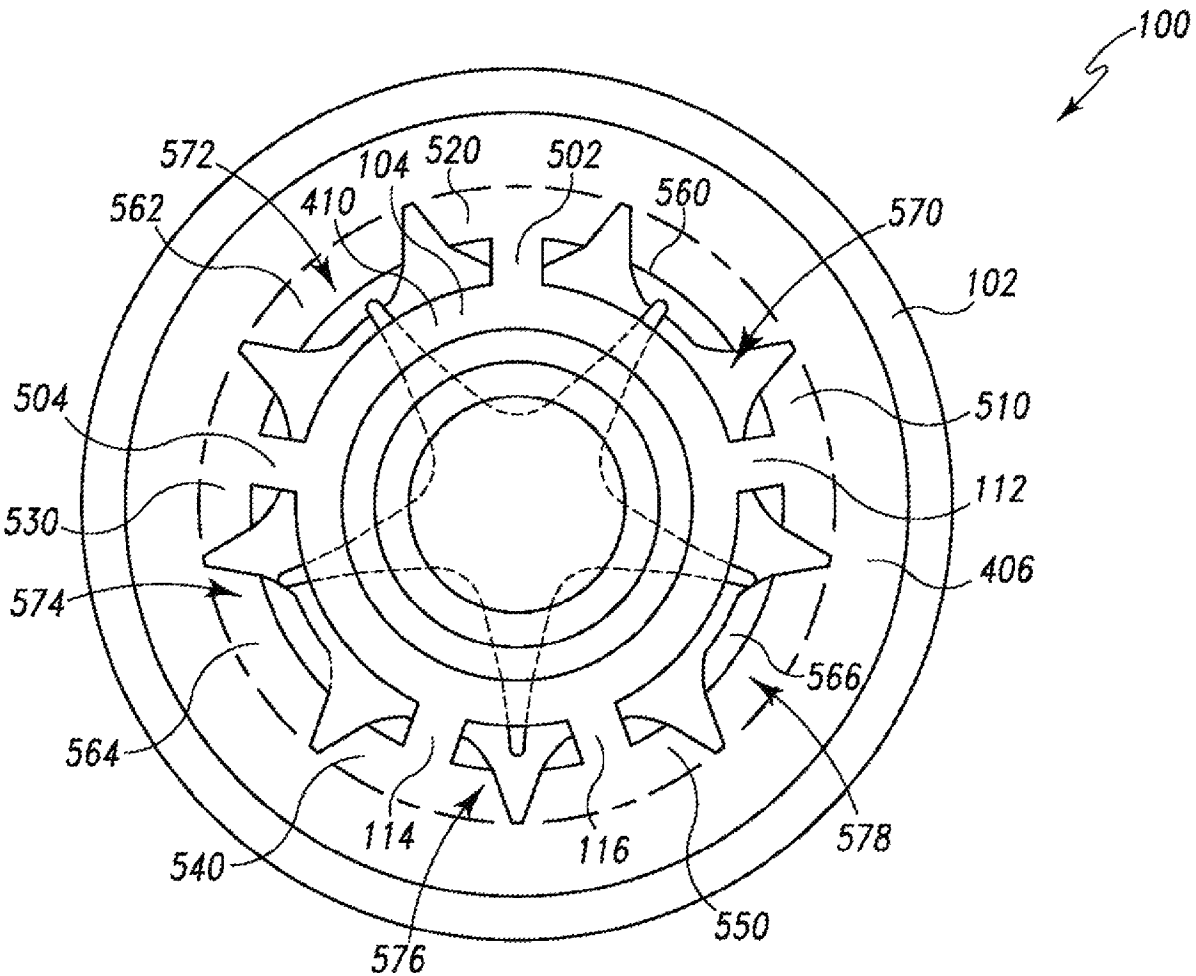
FIG. 5 depicts the bottom of an example of a phase plug as shown in FIG. 1.
Figure 6:
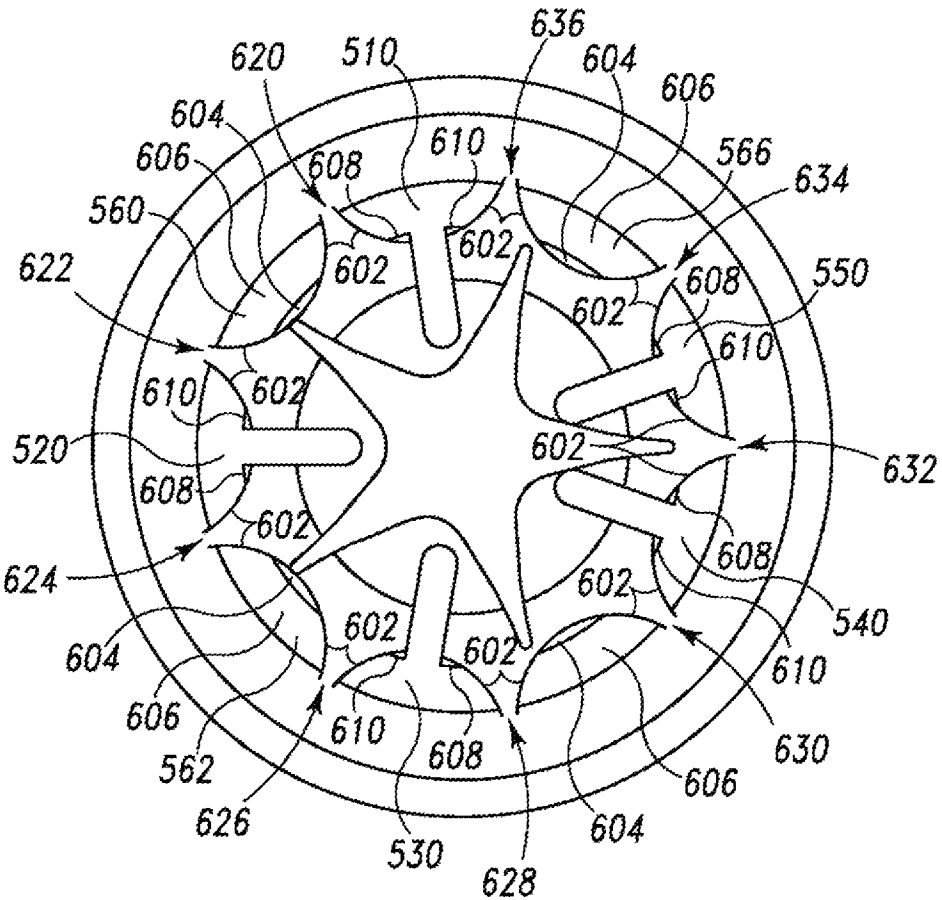
FIG. 6 depicts a bottom view of a member of an example of a phase plug.

In FIGS. 5-6, the second surface 406 may further include five protrusions 510, 520, 530, 540, and 550. The first protrusion 510 may be collocated with the respective first support member 112. The second protrusion 520 may be collocated with the second support member 502. The third protrusion 530 may be collocated with the third support member 504. The fourth protrusion 540 may be collocated with the fourth support member 114. The fifth protrusion 550 may be collocated with the fifth support member 116.

In FIG. 5, the support members 112, 114, 116, 502, and 504 are symmetrically collocated with respect to the center of the respective protrusions 510, 540, 550, 530, and 520. Even so, the support members may be skewed so as to not be symmetrically collocated with respect to the respective protrusions 510, 540, 550, 530, and 520. In addition, at least one of the support members may not be collocated with respect to the protrusions.

The second surface 406 further includes four additional protrusions 560, 562, 564, and 566, which are not collocated with one of the support members. The sixth protrusion 560 is positioned between the first protrusion 510 and the second protrusion 520. The seventh protrusion 562 is positioned between the second protrusion 520 and the third protrusion 530. The eighth protrusion 564 is positioned between the third protrusion 530 and the fourth protrusion 540. The ninth protrusion 566 is positioned between the fifth protrusion 550 and the first protrusion 510.

The sixth protrusion 560, seventh protrusion 562, eighth protrusion 564, and ninth protrusion 566 each includes a first and second channel face 602 and an interior face 604. The first protrusion 510, the second protrusion 520, the third protrusion 530, the fourth protrusion 540, and the fifth protrusion 550 each include a first and second channel face 602, a beveled face 606, a first interior face 608, and a second interior face 610.

A first channel 620 is formed between the channel face 602 of the first protrusion 510 and the channel face 602 of the sixth protrusion 560. A second channel 622 is formed between the channel face 602 of the sixth protrusion 560 and the channel face 602 of the second protrusion 520. A third channel 624 is formed between the channel face 602 of the second protrusion 520 and the channel face 602 of the seventh protrusion 562. A fourth channel 626 is formed between the channel face 602 of the seventh protrusion 562 and the channel face 602 of the third protrusion 530. A fifth channel 628 is formed between the channel face 602 of the third protrusion 530 and the channel face 602 of the eighth protrusion 564. A sixth channel 630 is formed between the channel face 602 of the eighth protrusion 564 and the channel face 602 of the fourth protrusion 540. A seventh channel 632 is formed between the channel face 602 of the fifth protrusion 550 and the channel face 602 of the fourth protrusion 540. An eighth channel 634 is formed between the channel face 602 of the fifth protrusion 550 and the channel face 602 of the ninth protrusion 566. A ninth channel 636 is formed between the channel face 602 of the first protrusion 510 and the channel face 602 of the ninth protrusion 566.

The first member 102 and the second member 104 in combinations with the first support member 112, the second support member 502, the third support member 504, the fourth support member 114, and the fifth support member 116 form five openings, 570, 572, 574, 576, and 578, that pass through to the orifice 140. A dotted line, in FIG. 5, shows the relative position of orifice 140 relative to the structures of the phase plug 100 when viewed from the fourth surface 410.

The first opening 570 may be formed by a portion of the second surface 406, the first support 112, the second support 502 and the second member 104 form a first opening 570 that passes through to the orifice 140 (a dotted line on FIG. 5). The portion of the second surface 406 that forms the first opening 570 includes a portion of the first protrusion 510, a portion of the second protrusion 520, and the sixth protrusion 560. In addition, opening 570 may further include the first channel 620 and the second channel 622.

The second opening 572 may be formed by a portion of the second surface 406, the second support 502, the third support 504, and the second member 104. The second opening 572 may further include the third channel 624 and the fourth channel 626. The second opening 572 may be in communication with the orifice 140.

The third opening 574 may be formed by a portion of the second surface 406, the third support member 504, the fourth support 114, and the second member 104. The third opening 574 may further include the fifth channel 628 and the sixth channel 630. The third opening 574 may be in communication with the orifice 140.

The fourth opening 576 may be formed by a portion of the second surface 406, the fourth support 114, the fifth support members 116, and the second member 104. The fourth opening 576 may include the seventh channel 632. The third opening 576 may be in communication with the orifice 140.

The fifth opening 578 may be formed by a portion of the second surface 406, the first support 112, the fifth support members 116, and the second member 104. The fourth opening 578 further includes the eighth channel 634 and ninth channel 636. The third opening 576 is in communication with the orifice 140.

By way of a non-limiting example, in FIGS. 5 and 6, the first opening 570, the second opening 572, the third opening 574, and the fifth opening 578 each define cross-sectional areas that are substantially equal. However, the fourth opening 576 is depicted as having a smaller cross-sectional area. As a result, the openings provide an asymmetric feature to receive sound emitted by the sound producing surface of a speaker. Alternative examples of the phase plug may include other asymmetrical features to the input surface including, but not limited to, each opening having a different cross-sectional area, a combination of differing cross-sectional areas, or positioning at least one of the support members to be skewed from the center of a protrusion.

Figure 7:
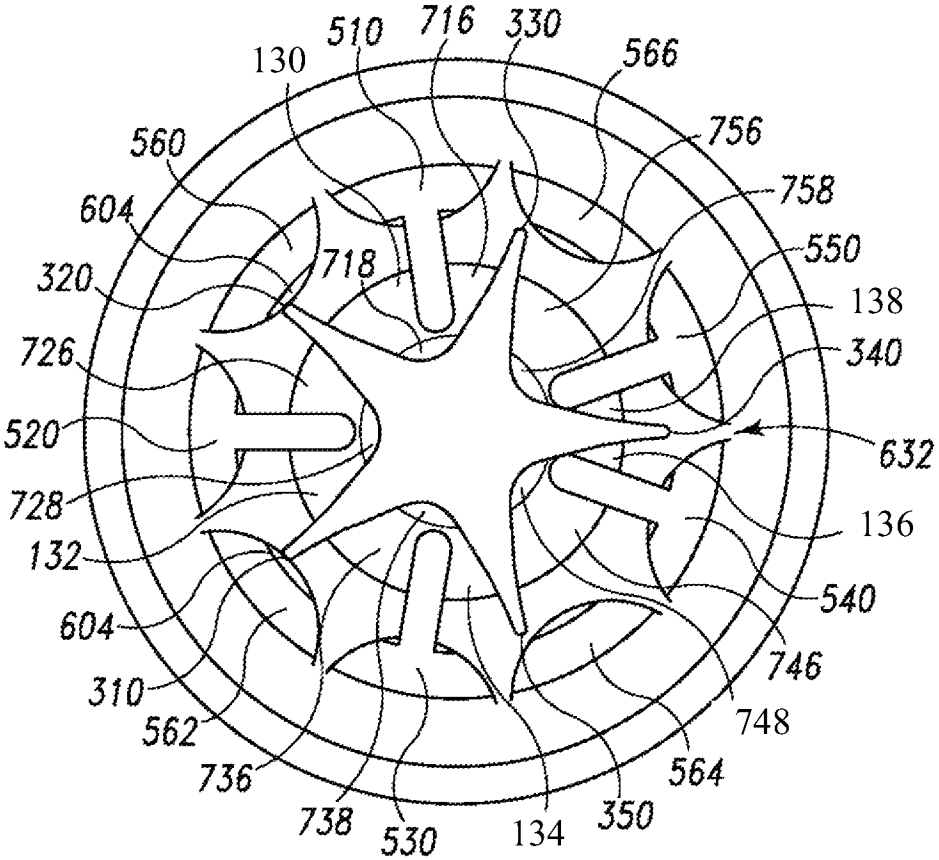
FIG. 7 further depicts a bottom view of a member of an example of a phase plug as shown in FIG. 6.

Referring to FIG. 7, the petal 130 includes a first interior petal surface 716 that corresponds to the first petal surface 216. The petal 130 further includes a second interior petal surface 718, which corresponds to the second petal surface 218. The first interior petal surface 716 and the second interior petal surface 718 may be joined to the first support member 112.

The petal 132 includes a first interior petal surface 726 that corresponds to the first petal surface 226. The petal 132 further includes a second interior surface 728 that corresponds to the second petal surface 228. The first interior petal surface 726 and the second interior petal surface 728 may be joined to the second support member 502.

The petal 134 includes a first interior petal surface 736 that corresponds to the first petal surface 236. The petal 134 further includes a second interior surface 738 that corresponds to the second petal surface 238. The first interior surface 736 and second interior surface 738 may be joined to the third support member 504.

The petal 136 includes a first interior petal surface 746 that corresponds to the first petal surface 246. The petal 136 further includes a second interior surface 748 that corresponds to the second petal surface 348. The first interior petal surface 746 and the second interior petal surface 748 may be joined to the fourth support member 114.

The petal 138 includes a first interior petal surface 756 that corresponds to the first petal surface 356. The fifth petal 138 further includes a second interior surface 758 that corresponds to the second petal surface 358. The first interior petal surface 756 and the second interior petal surface 758 may be joined to the fifth support member 116.

The first notch 310 of the first radiating slice 312 impinges upon the interior surface 604 of protrusion 560. Likewise, the second notch 320 of the second radiating slice 322 impinges upon the interior surface 604 of protrusion 562. The third notch 330 protrudes into an area about the eighth protrusion 564 without impinging upon the interior face 604 of the eighth protrusion 564. Likewise, the fifth notch 350 protrudes into an area about the protrusion 566 without impinging upon the interior surface of the protrusion 566. Notch 340 is substantially aligned with seventh channel 632.

Figure 8:
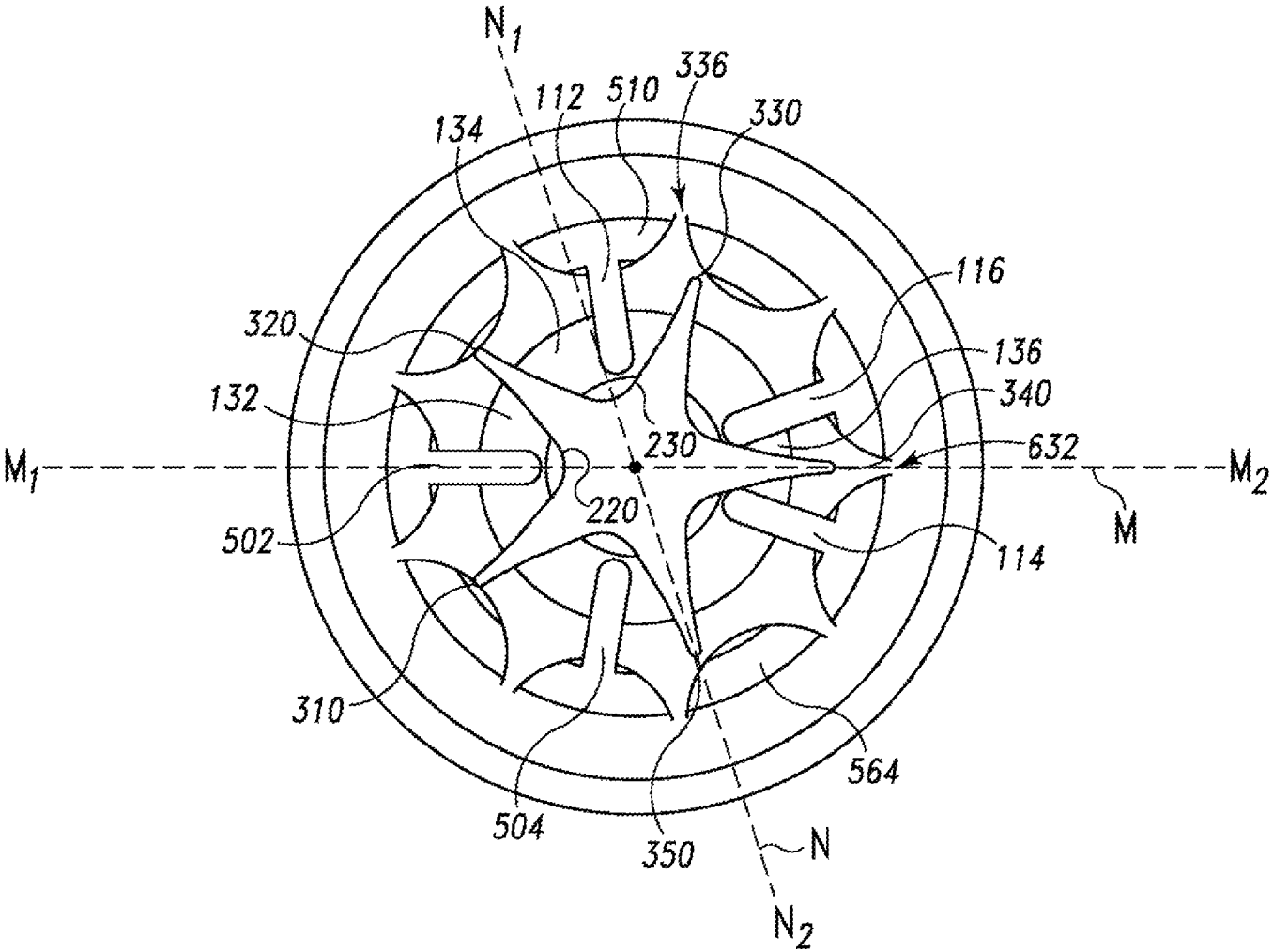
FIG. 8 depicts a bottom view of a member of an example of a phase plug as shown in FIGS. 6 and 7.

In FIG. 8, a first axis M runs between viewpoints M1 and M2. FIG. 8 further depicts a second axis N running between viewpoints N1 and N2. Another cross-sectional view, in FIG. 9, is depicted as a vertical slice along the first axis M.

Figure 9:
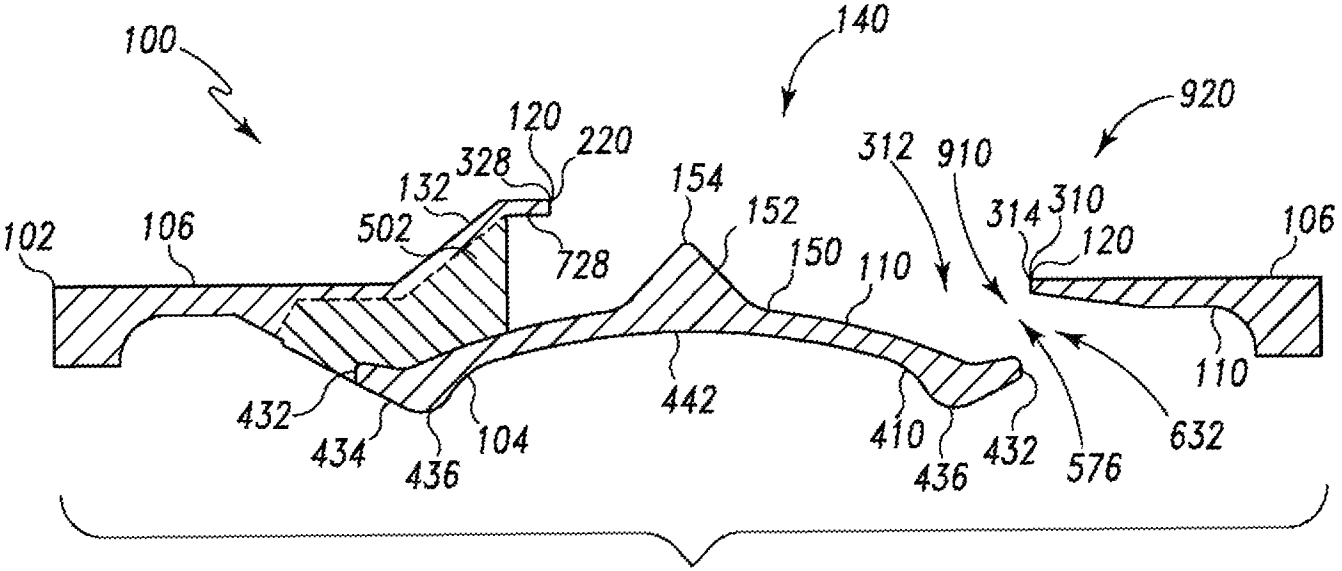
FIG. 9 depicts a cross-sectional view of an example of a phase plug as shown in FIGS. 1, 4, 5, and 6.

In FIG. 9, the seventh channel 632 is substantially aligned with the fourth opening 576, the fourth notch 340 and fourth radiating slice 342. The alignment of the seventh channel 632 with the fourth opening 576, the fourth notch 340 and fourth raiding slice 342 forms a substantially direct radiating path or opening 940 from the input of the fourth opening 576 to the orifice 140. The substantially direct opening 940 communicates sound energy entering the fourth opening 576 to the ambient 920 beyond the orifice 140. The raised or domed feature 150 of the third surface 110 in combination with protrusion 152 tends to reflect the sound energy received through the fourth opening 576 through the orifice 140.

In FIG. 9, the protuberance 152 may project into or towards the orifice 140. Accordingly, the zenith 154 of the protuberance 152 may rise above a portion of the first surface 106. As a non-limiting example, FIG. 9 also depicts that the zenith 154 may be positioned between the level of the fourth notch 340 and the second petal surface 228 of the second petal 132. Some examples of the third surface 110 may include a portion of domed feature 150 positioned above a portion of the lip 120. In other examples, the domed feature 150 is located below the lip 120 while the zenith 154 of protrusion 152 is located above at least a portion of lip 120.

Figure 10:
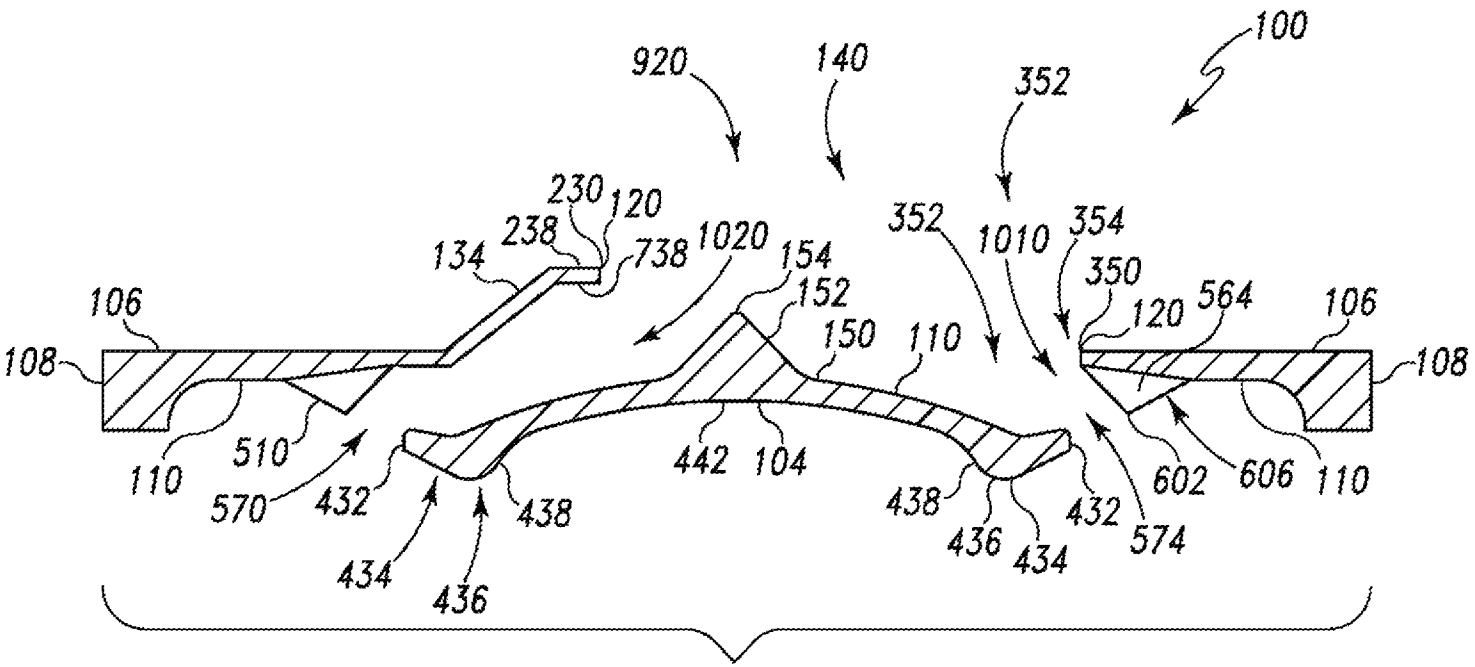
FIG. 10 depicts a cross-sectional view of an example of a phase plug as shown in FIGS. 1, 4, 5, 6, and 9.

In FIG. 10, the third opening 574 substantially aligns with the third notch 330 and the third radiating slice 332. The alignment of the third radiating slice 332 with the third opening 574 and the third notch 330 forms a substantially direct radiating path or opening 1010 from the input of the third opening 574 to the orifice 140. Similar to the substantially direct channel 910, the substantially direct channel 1010 communicates sound energy entering the third opening 574 to the ambient 920 beyond the orifice 140. The raised or domed feature 150 of the third surface 110 in combination with protrusion 152 tends to reflect the sound energy received through the third opening 574 through the orifice 140.

The protuberance 152 may project into the orifice 140. As a result, the zenith 154 of the protuberance 152 may rise above a portion of the first surface 106 or a portion of lip 120. As another non-limiting example, FIG. 10 depicts that the zenith 154 may be positioned between the level of the third notch 330 and the second petal surface 218 of the first petal 130. Some examples of the third surface 110 may include a portion of domed feature 150 positioned above the second petal surface 218. In other examples, the domed feature 150 is located below the lip 120 while the zenith 154 of protrusion 152 is located above at least a portion of lip 120.

In contrast, the first opening 570 substantially aligns with a portion of the first petal 130. The first support member 112 is skewed from the symmetrical center of the first petal 130. As a result, the combination of the first interior petal surface 718 and third surface 110 form a channel 1020, which is in communication with orifice 140. Channel 1020 directs sound energy from the first opening 570 toward the orifice 140. A portion of the sound energy directed through channel 1020 may be reflected off the third surface 110. In part, some portion of the sound energy directed through opening 1020 may be reflected off the raised or dome feature 150 or the protuberance or protrusion 152.

The overall effect of the alignment of the radiating slices 312, 322, 332, 342, and 352 with the structures forming the openings 570, 572, 574, 576, and 578 is to form various asymmetric or non-uniform structures and features with respect to the flow of sound energy through the openings 570, 572, 574, 576, and 578 into orifice 140. The non-uniform and asymmetric structure provides multiple paths for sound energy to propagate from the sound producing surface of the speaker to the surrounding ambient through the orifice 140. Because each path may be configured to provide a slightly different frequency response, the effect of nulls in the phase plug response may be minimized while optimizing the directivity response provided by the overall speaker assembly.

Figure 11:
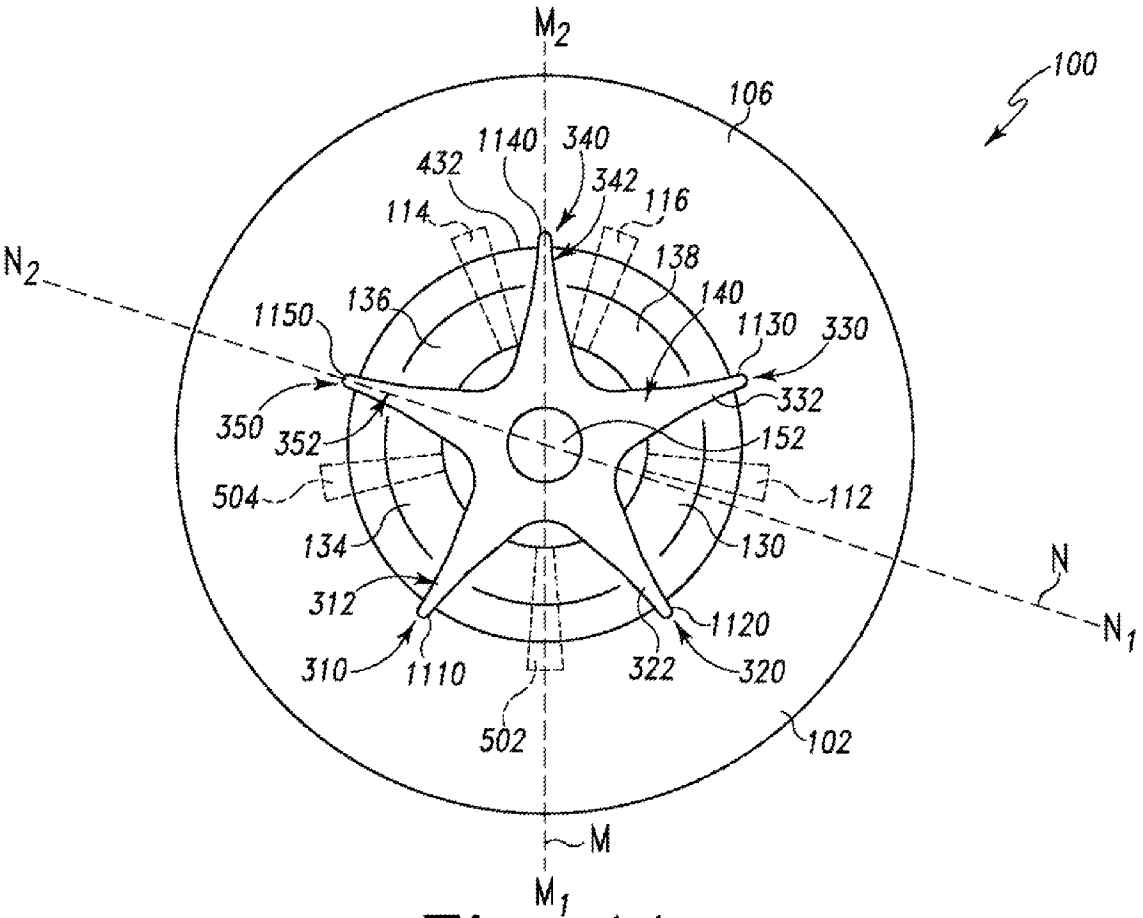
FIG. 11 depicts a top view of an example of a phase plug.

FIG. 11 further depicts phase plug 100 from the perspective of the first surface 106. The relative position of the support members 112, 114, 116, 502 and 504 are depicted as dashed lines positioned about orifice 140. The first support member 112 provides structural support for the first petal 130. The support member 112 may be positioned off an axis of symmetry of the first petal 130. The fourth support member 114 provides structural support for the fourth petal 136. Similar to support member 112, support member 114 may be positioned off an axis of symmetry of the fourth petal 136.

Referring back to FIG. 9, the end point 344 of the fourth notch 340 may extend up to or beyond the edge 432 of the second member 104. As a result, the fourth notch 340 may overlap the fourth opening 576. In FIG. 10, the end point 334 of the third notch 330 may extend up to or beyond the edge 432. As a result, the third notch 330 may overlap with the third opening 574.

Figure 3:
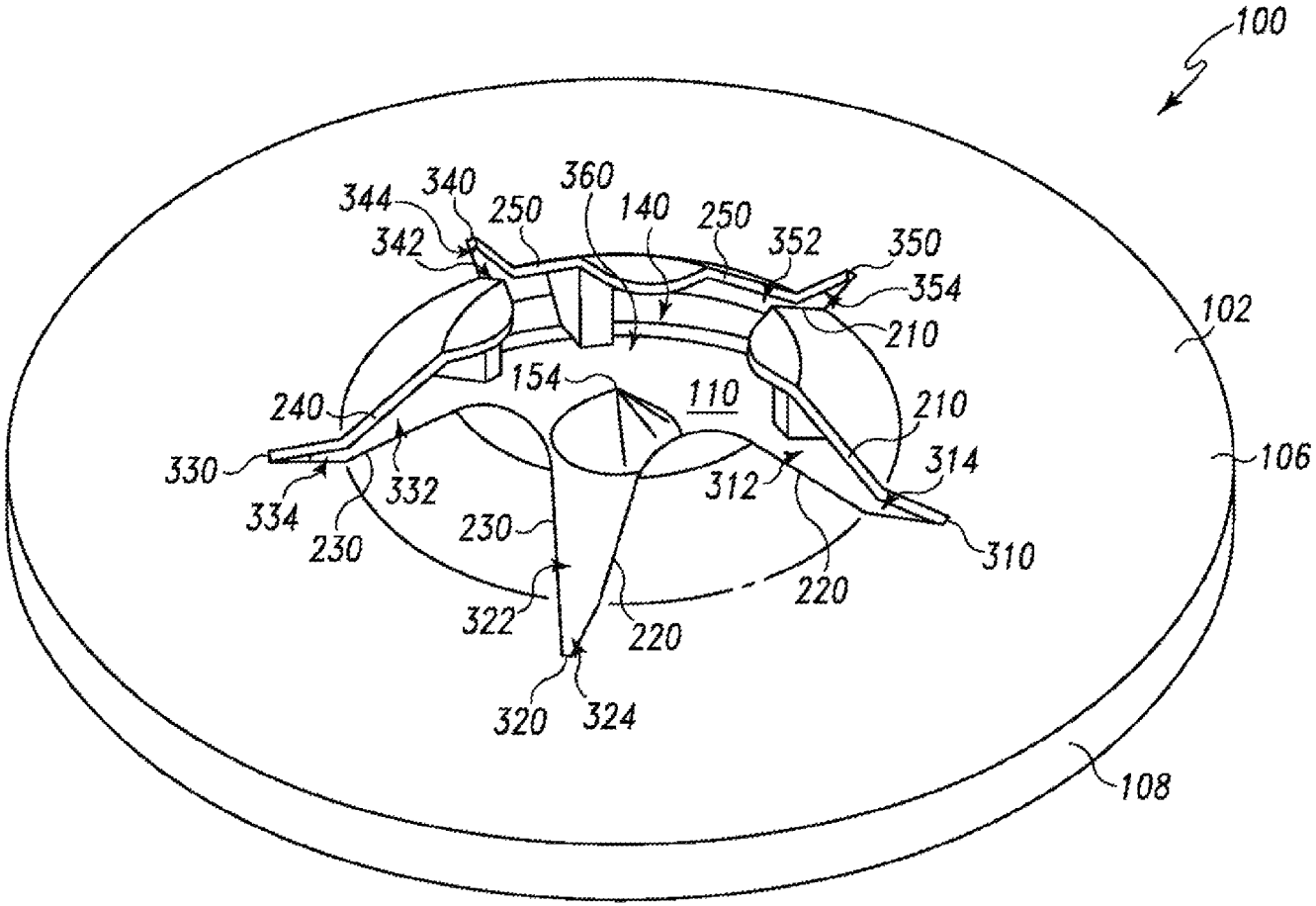
FIG. 3 further depicts a perspective view of the top of an example of a phase plug as shown in FIGS. 1 and 2.

Referring to FIGS. 3 and 11, viewing the assembly of the first and second member from the perspective of the first surface 106, the end points 314, 324, 334, 344, and 354 may each extend beyond the deflections 212, 222, 232, 242, and 252. Alternatively, the first end point 314 may extend past the edge 432 of the second member 104 to create a first passage 1110 between the first surface 106 and the fourth surface 410. The second end point 324 may extend past the edge 432 to create a second passage 1120 through phase plug 100. The third end point 334 may extend past the edge 432 to create a third passage 1130 between the first surface 106 and the fourth surface 410. The fourth end point 344 may extend past the edge 432 to create a third passage 1140 between the first surface 106 and the fourth surface 410. And, the fifth end point 354 extends past the edge 432 to create a fifth passage 1150 between the first surface 106 and the fourth surface 410. Each of the passages, 1110, 1120, 1130, 1140, and 1150, may provide a means for sound energy to be directed from the sound producing surface of a speaker (not shown) to the surrounding ambient without incurring a physical encumbrance.

Even so, to provide other aspects of asymmetry and the frequency response of the phase plug, other examples may have only some or none of the end points may extend pass edge 432. The depth of the over lap of each notch 310, 320, 330, 340, and 350 with the openings, 270, 272, 274, 276, and 278, may be different so as to change the frequency response of each slice or passageway through phase plug 100. While FIG. 11 depicts each of the five radiating slices 312, 322, 332, 342, and 352 as having substantially uniform widths and shapes, other examples may include radiating slices with different widths or shapes.

Furthermore, even though FIGS. 1-11 depict petals having substantially uniform shapes and widths, other examples may include at least one petal having a non-uniform width, a non-uniform shape, an asymmetric form, a non-uniform curvature, and/or a combination thereof. Still other examples may provide other variations, including but not limited to the height above or below a single surface, thickness, uniformity, width, or taper of edges, to at least one or more of the petals 130, 132, 134, 136, 138, and/or petal edges 210, 220, 230, 240, and 250 to further alter the response of the phase plug radiating into an ambient.

Adjusting the distance between the support members may provide for additional asymmetrical or non-uniform openings. As a result, the distance between the first support member 112 and second support member 114 may be located relatively close in proximity relative to the other proximate support members. Alternatively, varying distances between the supports or the alignments of the supports with respect to other features may be included to provide a more uniform or desirable response or change the position of a peak or a null in the response of the phase plug 100 or overall speaker assembly.

While FIGS. 1-11 depict an odd number of protrusions such that the number of protrusion or channels contained in each opening is different, other examples of the phase plug 100 may include the same number of protrusions or channels. Other examples of the phase plug 100 may include a number of protrusions such that the number of protrusions or channels in each opening is the same.

Figure 12:
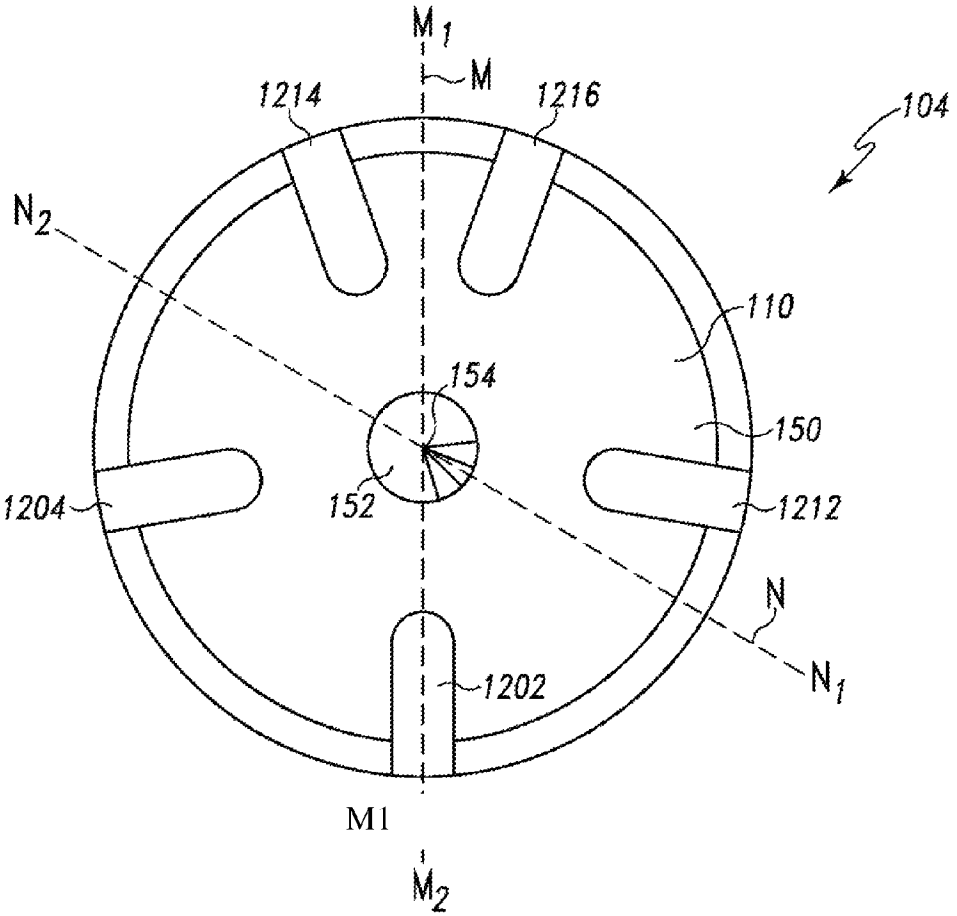
FIG. 12 depicts a top view of an example of a member of a phase plug.

FIG. 12 depicts the third surface 110 of the second member 104. The third surface 110 includes a first ledge 1200 that encumbrances the raised or domed feature 150. The third surface 110 further includes a first support position 1212, a second support position 1202, a third support position 1204, a fourth support position 1214, and a fifth support position 1216. The first support position 1212 may be configured to interconnect with or fluidly join to support member 112. The second support position 1202 may be configured to interconnect with or fluidly join to support member 502. The third support position 1204 may be configured to interconnect with the third support member 504. The fourth support position 1214 may be configured to interconnect with or fluidly join to support member 114. The fifth support position 1216 may be configured to interconnect with or fluidly join to support member 116. The interconnection of each respective support member, 112, 502, 504, 114, and 116, may interconnect or join with the corresponding support position 1212, 1202, 1204, 1214, and 1216 by virtue of an ultrasonic soldering process. Alternatively, the respective support member and support position may be attached using a spin friction process or adhesive.

For descriptive purposes only, FIG. 12 further includes a first axis M defining a vertical plane or slice M. The first axis is further defined by points of view/end points M1 and M2. From viewpoint M2 the vertical plane M passes approximately through the midpoint between the fourth support position 1214 and the fifth support position 1216. From the point M1 the vertical plane M also passes approximately through the symmetrical center of the second support position 1202. The axis M passes through protuberance or protrusion 152 and zenith 154.

For further descriptive purposes only, FIG. 12 also includes a second axis N defining a vertical plane or slice N. The second axis N is further defined by points of view/end points N1 and N2. The second axis N also passes through the protuberance or protrusion 152 and zenith 154. From viewpoint N2, the vertical plane N passes between the third support position 1204 and the fourth support position 1214. From viewpoint in N1, the vertical N passes between the first support position 1212 and the second support position 1202.

Figure 13:
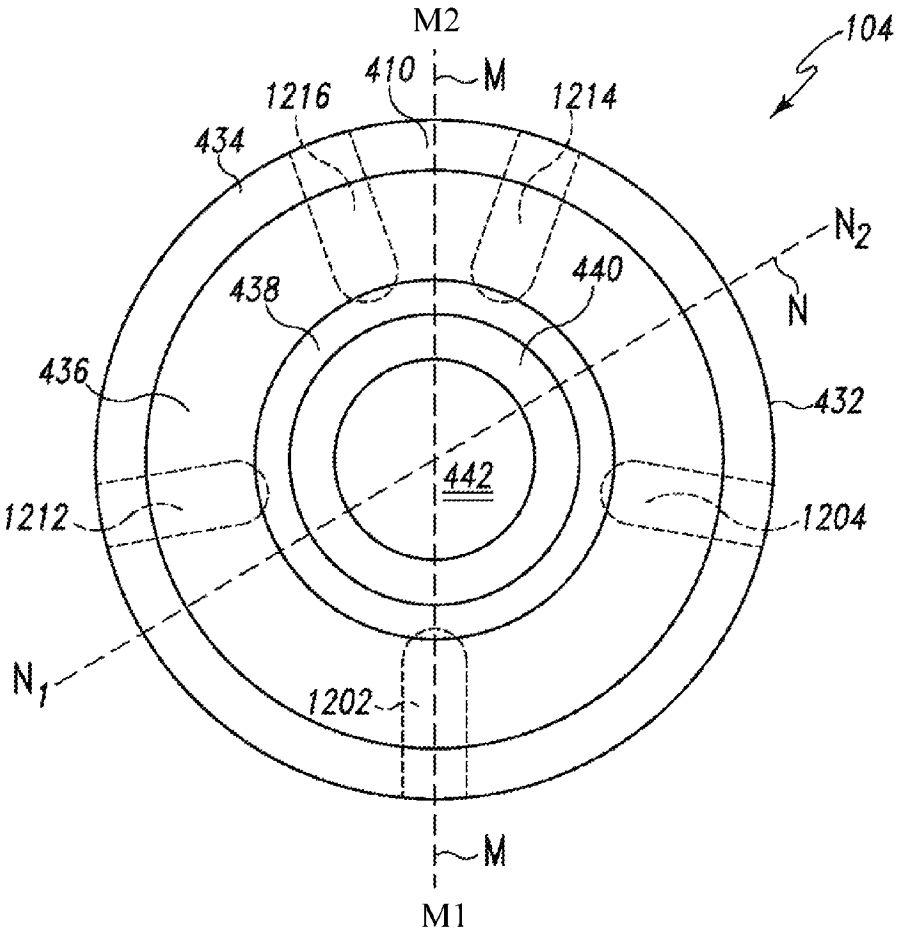
FIG. 13 depicts a bottom view of an example of a member of a phase plug.

FIG. 13 depicts the position of the fourth surface 410 of the second member 104. The dashed lines depict and correspond to the first support position 1212, the second support position 1202, the third support position 1204, the fourth support position 1214, and the fifth support position 1216.

Figure 14:
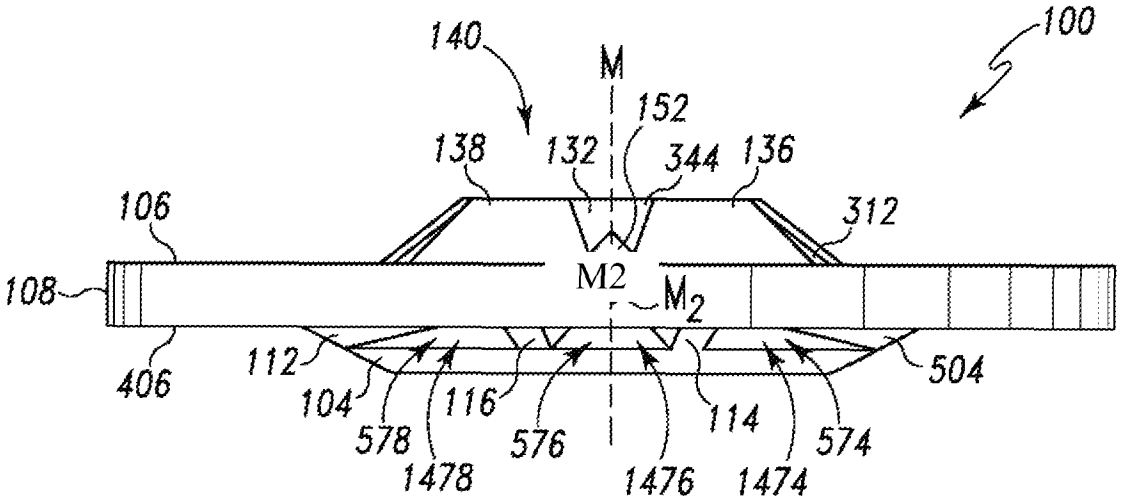
FIG. 14 depicts a side view of an example of a phase plug.
Figure 15:
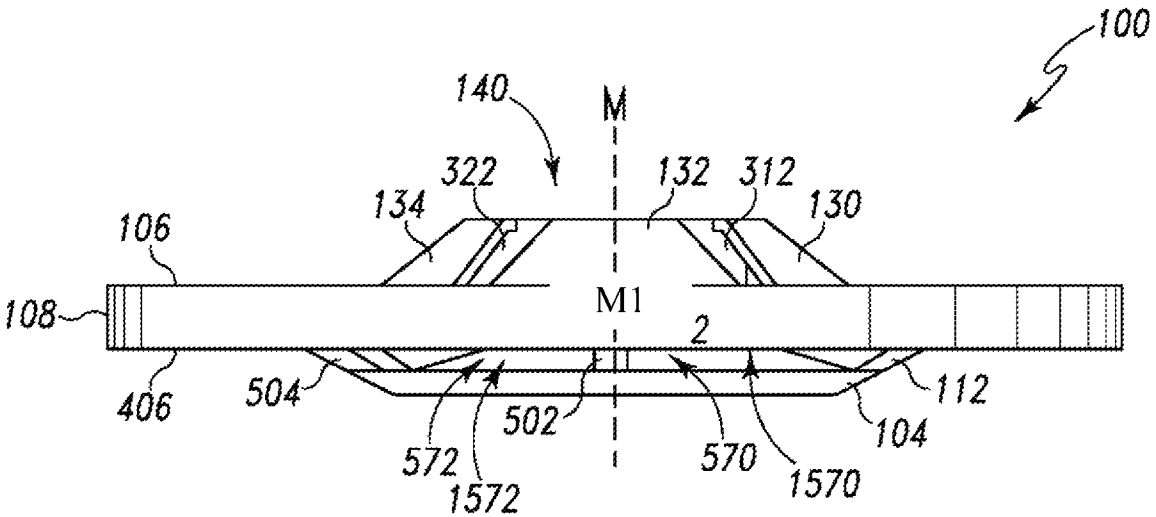
FIG. 15 further depicts a side view of an example of a phase plug in FIG. 14.

FIGS. 14 and 15 depict the phase plug along the first axis M from the perspective of the viewpoint M1. From the viewpoint of M2, the protuberance 152 protrudes above a portion of the first surface 106 and into orifice 140. The relative positioning of support members 114 and 116 in combination with the second member 104 and second surface 406 of the first member 102 may create the fourth opening 576. The fourth opening 576 may be positioned symmetrically below the fourth slice 342 and opposite the location of petal 132. The third opening 574 is formed by support members 114 and 504 in combination with the second support member 104 and second surface 406 of first member 102. The fifth opening 578 is formed by support members 112 and 116 in combination with the second support member 104 and second surface 406 of first member 102.

In FIG. 14, the third opening 576 encompasses a cross-sectional area 1476. The second opening 574 encompasses a cross-sectional area 1474. The fifth opening 578 encompasses a cross-sectional area 1478. By inspection, the cross-sectional area 1476 of the fourth opening 576 may be less than the cross-sectional area 1478 of the fifth opening 578 or the cross-sectional area 1474 of the third opening 574. The differences in cross-sectional area of the openings contribute to the asymmetry of the phase plug, which correlates with improved the high frequency response of the phase plug 100.

In addition, the combination of the fourth radiating slice 342 with the opening 576 provides a degree of asymmetry with respect to the flow of sound energy through the surface area 1476 to the orifice 140. In contrast, the combination of the third opening 574 and the fourth petal 136 combine to provide another degree of asymmetry. Likewise, the combination of the fifth opening 578 with the fifth petal 138 provides another degree of asymmetry. In addition to the added degrees of asymmetry, the variance in structures provides different path lengths for the sound energy. The different path lengths further provide for varying high frequency responses that tend to prevent null points from emerging or dominating the frequency response of the phase plug 100.

In contrast, FIG. 15 depicts, from the viewpoint M1, a second view of the phase plug 100 also along the first axis M. The first opening 570 encompasses a cross-sectional area 1570. The second opening 572 encompasses a cross-sectional area 1572. By inspection, the cross sectional areas 1570 and 1572 may have the same or approximately the same surface area. The support member 502 may be positioned to divide the second petal 132 into symmetrically equal portions.

The first opening 570 combines with radiating slice 312, first petal 130, and second petal 132 to form a channel for sound energy to pass from the first opening 570 to the orifice 140. The second opening 572 combines with radiating 322 and second petal 132, and third petal 134 to form a path or channel for sound energy to pass from the opening 572 to orifice 140. As depicted, the channel associated with the first opening 570 may be a mirror image of the channel associated with the second opening 572. In other examples, the respective channels may include different openings and/or slice geometries or sizes.

The relative positing of the support member 112, 114, 116, 502, and 504 to the petal openings may also provide addition symmetrical or asymmetrical geometries that may be adjusted to provide different frequency response characteristics of the phase plug 100.

Figure 16:
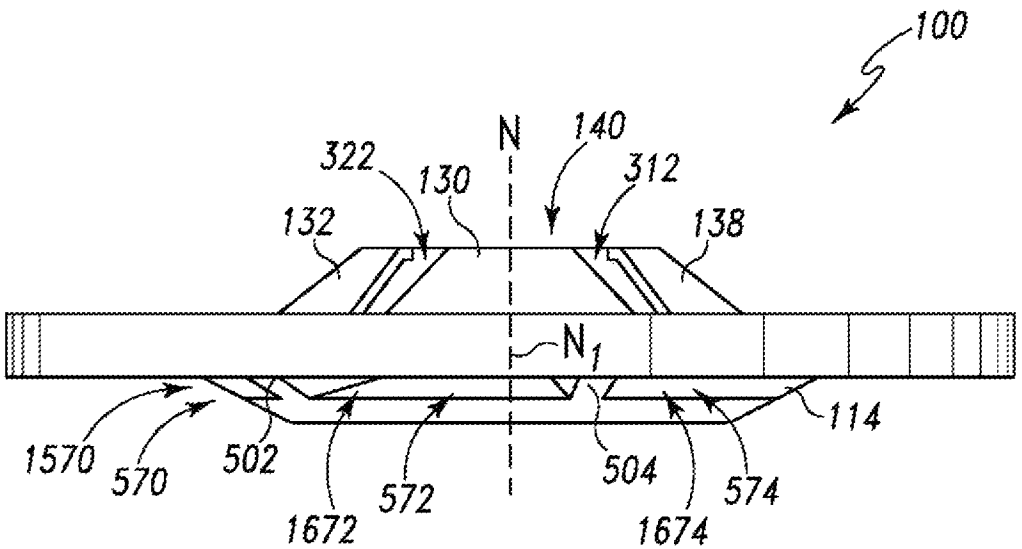
FIG. 16 depicts a side view of an example of a phase plug in FIGS. 14 and 15.

FIG. 16 depicts, from the viewpoint N1, a first view of the phase plug 100 along the second axis N. The opening 572 encompasses a cross-sectional area 1672. The second opening 272 combines with the second radial slice 322 and first petal 130 to form a channel for passing sound energy through the cross-sectional area 1672 to orifice 140. A portion of second opening 272 may be aligned with the second radial slice 322. Another portion of the second opening 272 may be aligned with the first petal 130.

Figure 17:
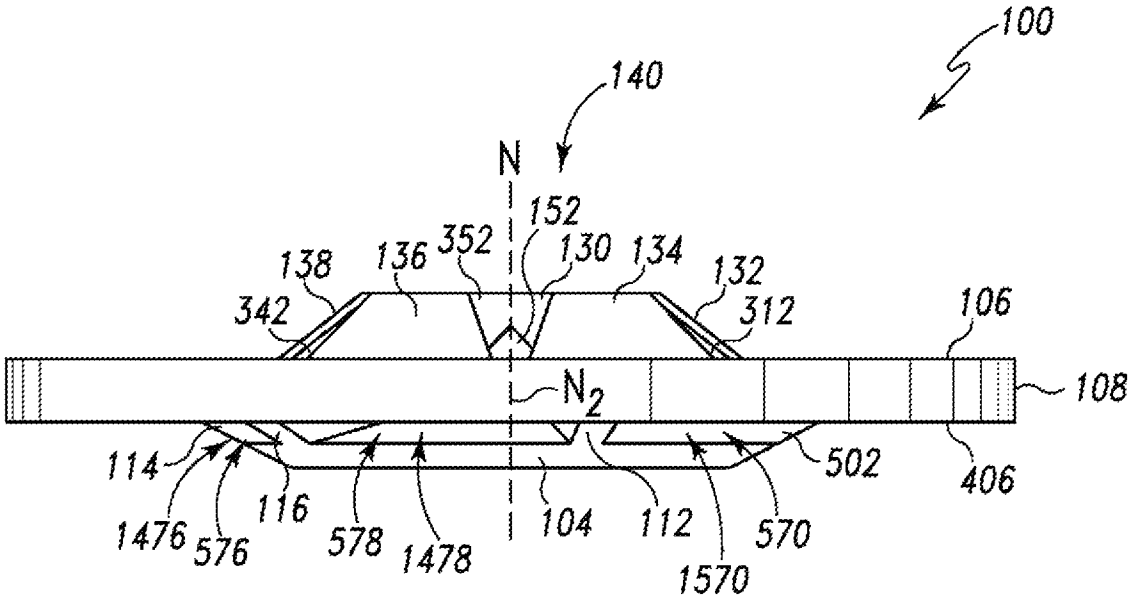
FIG. 17 depicts a side view of an example of a phase plug as depicted in FIGS. 14, 15, and 16.

FIG. 17 depicts, from the viewpoint N2, a second view of the phase plug 100 along the second axis N. In particular, FIG. 17 provides a second perspective of the arrangement of the fifth opening 578 with respect to the fourth petal 136, the third petal 134, and the fifth radial slice 352. In the contrasting FIGS. 16 and 17, the fifth opening 578 of FIG. 17 may be a mirror image of the second opening 572 of FIG. 16. Alternatively, the respective support members of each respective opening may be adjusted to increase or decrease respective cross-sectional areas of each opening. By adjusting the cross-sectional areas of each opening, the symmetric imagery of the respective openings may be modified to optimize the desired frequency response of the phase plug. Alternatively, the symmetric imagery of the respective openings may be adjusted to optimally move or place nulls in the frequency response of the phase plug to provide an optimal or desired frequency response of the phase plug.

Figure 18:
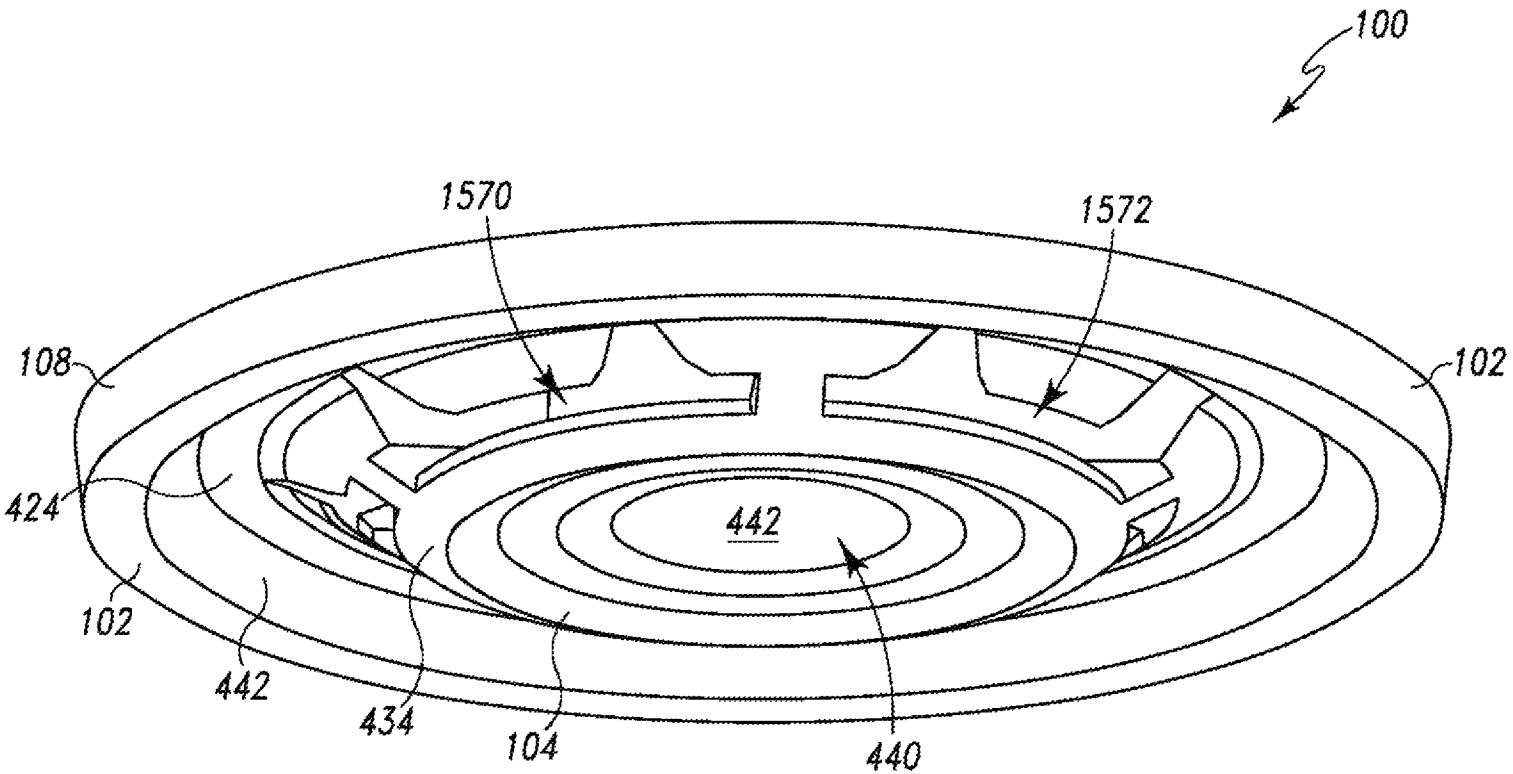
FIG. 18 depicts a perspective view of the bottom of an example of a phase plug.

FIG. 18 depicts the phase plug 100 from the perspective of the second member 104. The second member 104 is attached to the first member 102 via support members. The combination of the first member 102 and second member 104 with the support members 112, 114, 116, 502, and 504 create openings for sound energy or air flow to pass through phase plug 100. The location of nadir 442 in combination with depression 440 provides a cavity to be positioned above a central portion of a speaker. In other examples, the fourth surface may be formed to provide a minimum cavity or project outward to provide for a consistent or uniform air gap between the sound producing surface of a speaker and the surface of the phase plug that is positioned proximate to the speaker. The mounting collar 420 may be conformed to form a lip or edge of the phase plug 100 to interface with a speaker in a speaker assembly. Mounting collar 420 may further include features, not shown, to lock or detachably secure the phase plug in place upon being incorporated into a speaker assembly.

Figure 19:
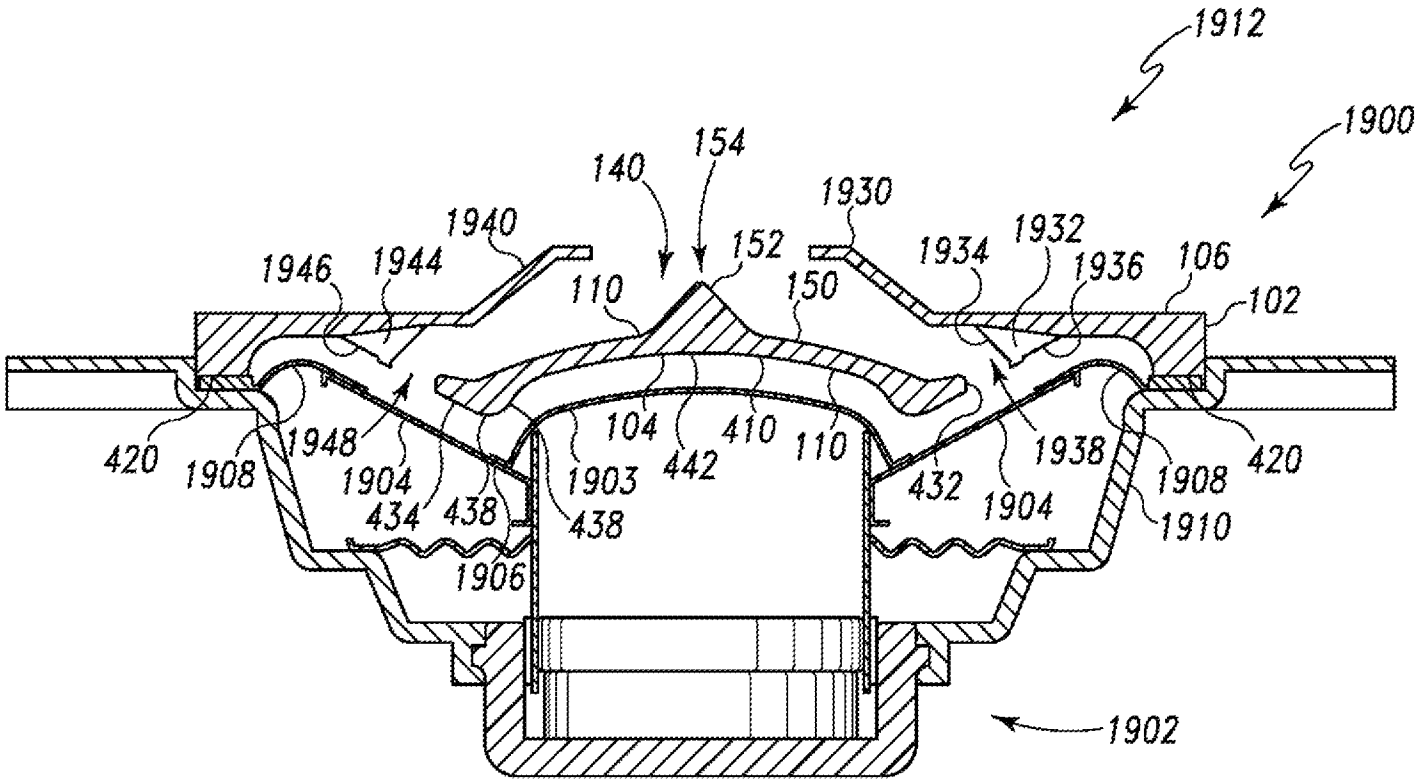
FIG. 19 depicts a cross-sectional view of an example of an assembly including a phase plug and a speaker.

FIG. 19 depicts a cross-sectional view of a speaker assembly 1900 including a speaker 1902 with a conical diaphragm. The speaker 1902 includes a dustcap 1903 attached to a cone 1904 at an interface 1906. The cone 1904 attaches to surround 1908. The surround 1908 rest on a basket 1910 of the speaker 1902.

The speaker assembly 1900 further includes phase plug 1912, which is another example of the phase plug 100. Phase plug 1912 includes a first member 102 and a second member 104. The first member 102 and second member 104 are attached by support members (not shown). The fourth surface 410 is positioned over the dustcap 1903 and cone 1904.

The first sloping surface 434, the second sloping surface 438 and the rounded surface or edge 436 may be positioned proximate to the interface 1906. The curvature or relief of the edge 436 may be formed to minimize turbulence of air moving across or through the volume between the fourth surface 410 and the dustcap 1903. The fourth surface 410 further includes a domed or curved portion positioned above the dustcap 1903. The curved portion has a nadir 442 positioned proximate the center of the dustcap 1903 and opposite the apex or zenith 154 of protrusion 152.

The first member 102 includes a first petal 1930 and first protrusion 1932 having a first face 1934 and a second face 1936. The edge 432 of the second member 104 combines with the first face 1934 to form a passage 1938. Passage 1938 permits sound energy to pass from the surface of the cone 1904 and dustcap 1903 into the interior of the phase plug 1912. The dome feature 150 and protrusion 152 of the third surface 110 combines with the first petal 1930 to form a channel for sound energy to pass through the aperture 140.

The first member 102 also includes a second petal 1940 and a second protrusion 1942 having a first face 1944 and a second face 1946. The edge 432 of the second member 104 combines with the first face 1934 to form a passage 1948. Passage 1948 permits sound energy to pass from the surface of the cone

1904 and dustcap 1903 into the interior of the phase plug 1912. The dome feature 150 and protrusion 152 of the third surface 110 also combines with the second petal 1940 to form a channel for sound energy to pass through the aperture 140.

In contrast to the cross-sectional view in FIGS. 10 and 11, the cross-section of phase plug 1912 depicts substantially similar passages 1938 and 1948. In addition, the channels formed by the petals in relationship to the domed portion 150 and protuberance 152 are depicted as having a substantially symmetrical form.

The speaker in FIG. 19 may be combined with any of the phase plug examples as in FIGS. 1-18 as well as the alternate examples described herein. Furthermore, while the speaker in FIG. 19 includes a conical diaphragm, other diaphragm types may be combined with the phase plugs described herein.

Figure 20:
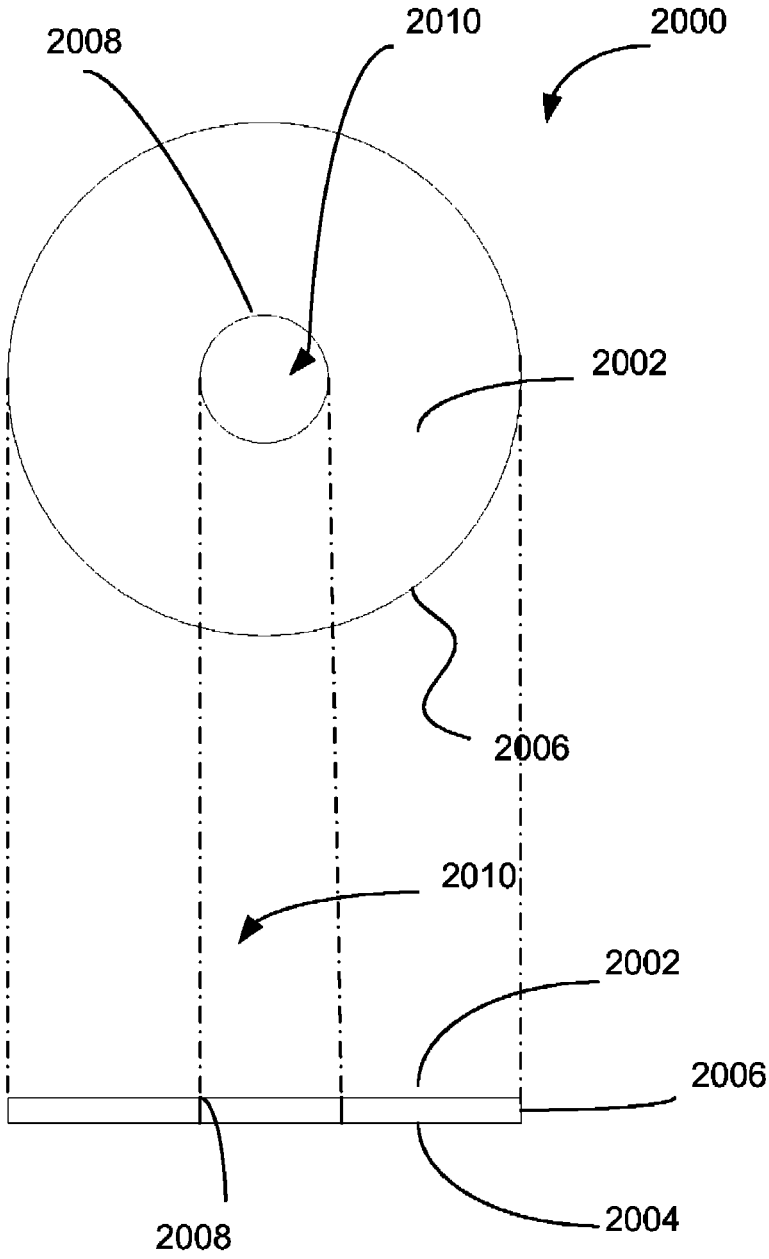
FIG. 20 depicts a top view and cross-sectional view of an example of an acoustic lens.

FIG. 20 depicts a top view and cross-sectional view of acoustic lens 2000. The acoustic lens 2000 may be configured to mount over the sound producing surface of a speaker (not shown). The acoustic lens 2000 includes first surface 2002 and second surface 2004. The first surface 2002 and the second surface 2004 form a union to create an exterior edge or lip 2006. The exterior lip or edge 2006 may be configured to rest upon a mounting feature of the speaker. The first surface 2002 and second surface also form a union to form an interior lip or edge 2008. The interior lip 2008 delineates an aperture 2010, where the interior lip 2008 delineates a cross-sectional area of aperture 2010.

As a non-limiting example, the aperture 2010 includes an axisymmetric opening in or near the central location of the first surface 2002 and the second surface 2004. The interior lip or edge 2008 may have a thickness of between 0.5-2.5 mm thick.

In other examples, the interior lip 2008 delineates a cross-sectional area of the aperture 2010 that includes about 15% or more of the surface area of the acoustic lens 2000. The acoustic lens 2000 further includes features to mate to a frame of a speaker (not shown) while providing clearance for the moving diaphragm assembly of the speaker. The acoustic lens 2000 may be composed of various rigid materials of varying flexibility. Illustratively, in one example, acoustic lens 2000 may be composed of plastic. In other examples, the acoustic lens 2000 may be composed of metal. In still other examples, the acoustic lens 2000 may be composed of other suitable materials or composite materials.

The second surface 2004 is mounted proximate to the radiating surface of a speaker, not shown. The aperture 2010 of the acoustic lens 2000 effectively reduces the radiating area of the speaker. The smaller radiating area delineated by the interior lip 2008 reduces the directivity of the speaker, which provides a more uniform sound pressure level frequency response (spectral balance) over a wider coverage area and to a higher frequency.

Additionally, the stiffness of the volume of air between the diaphragm of the speaker, (mounted proximate to the second surface 2004), and the acoustic lens 2000 resonates with the mass of the air in the aperture 2010 (Helmholtz resonance). As a result, the sound pressure level of the speaker in the frequency range increases around this resonance frequency. Above the Helmholtz resonance frequency range, the volume of air between the diaphragm and the acoustic lens acts as an acoustic lowpass filter, reducing the sound pressure level of the speaker. This effect is typically most prominent in the octave immediately above the Helmholtz resonance frequency range.

Above the Helmholtz resonance frequency range, other resonances occur due to standing waves within the volume of air between the diaphragm and the acoustic lens 2000 ("cavity resonances"). The cavity resonances cause peaks and dips in the sound pressure level frequency response measured at a position located on the side of the acoustic lens 2000 corresponding to the first surface 2002.

The reduced radiating area of the aperture typically reduces the sound pressure level ("insertion loss") and increases the sound pressure distortion. These effects can occur throughout the operating bandwidth of the speaker, but are typically most significant and easily identified in the one or two octaves immediately below the Helmholtz resonance frequency range. These effects worsen (increase) as the aperture area decreases.

Figure 21:
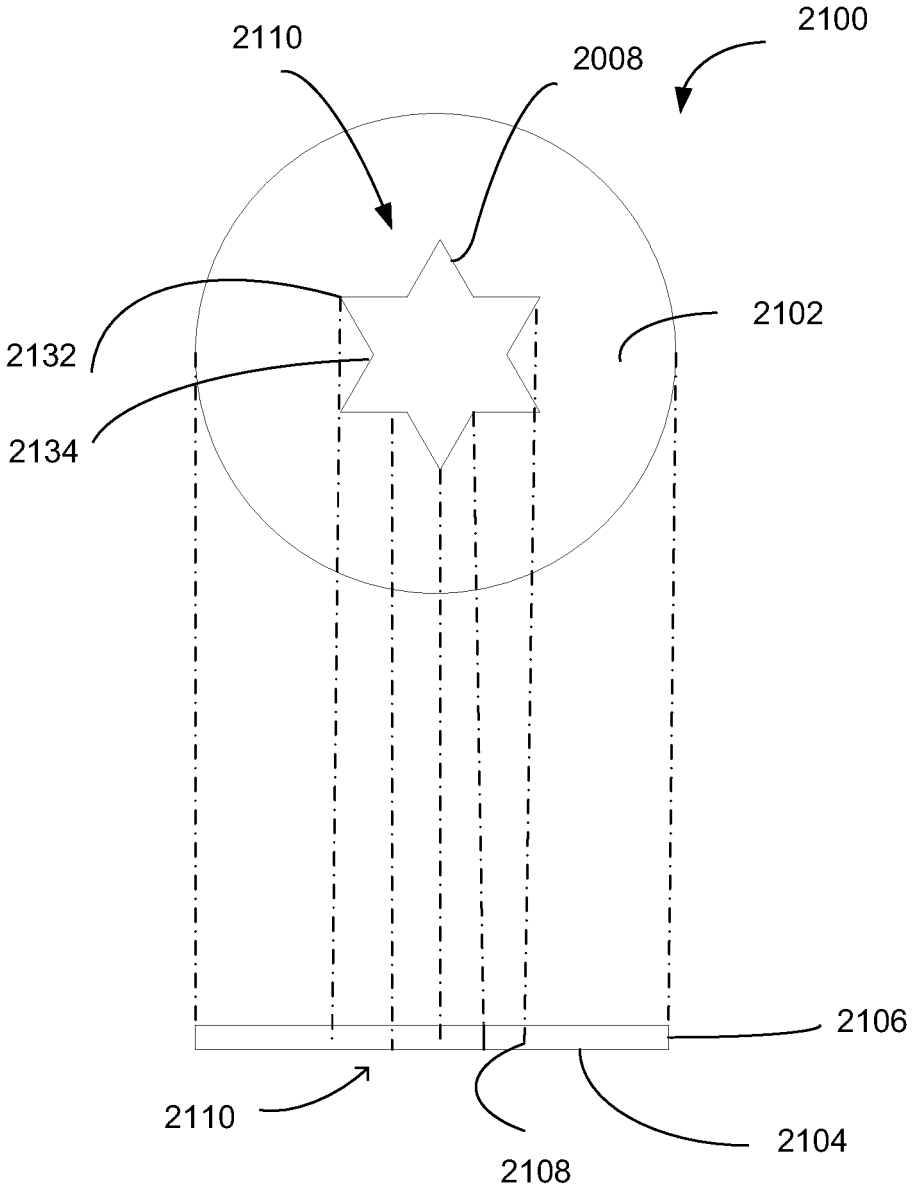
FIG. 21 depicts a top view and cross-sectional view of another example of an acoustic lens.

FIG. 21 depicts a top view and cross-sectional view of the acoustic lens 2100. The acoustic lens 2100 may be configured to mount over the sound producing surface of a speaker (not shown). The acoustic lens 2100 includes a first surface 2102 and a second surface 2104. The first surface 2102 and the second surface 2104 form a union to create an exterior edge or lip 2106. The exterior lip or edge 2106 may be configured to rest upon a mounting feature of the speaker. The first surface 2102 and second surface also form a union to form an interior lip or edge 2108. The interior lip 2108 delineates an aperture 2110, where the interior lip 2108 delineates a cross-sectional area of the aperture 2110.

The interior lip 2108 may be configured to include edges of various geometric shapes. Illustratively, the interior lip 2108 may be configured to resemble an etoile, an estoile, or a star-like shape having a plurality of vertices 2132 and 2134. Illustratively, some vertices, similar to the vertex 2134, may project into the aperture 2110. Other vertices, similar to the vertex 2134, may project outwardly from a center of aperture 2110. Although depicted as a star-like shape, an estoile shape, or a etoile shape including six radiating points, other examples include an etoile, an estoile, or star-like shaped aperture having an odd number of radiating points.

Some examples of the acoustic lens 2100 may have a thickness of between about 0.5-2.5 mm. The aperture 2110 may be non-axisymmetric about the center of the body of acoustic lens 2100. The cross-sectional area delineated by the interior lip 2108 of the aperture 2110 is typically 15% or more of the surface area of the acoustic lens 2100. In some examples, the aperture 2110 may include an odd—typically prime—number, of non-axisymmetric features. The non-axisymmetric features may extend to an outer diameter whose dimensions are typically similar to the dimensions of the outer diameter of the diaphragm of a speaker mounted proximate to the second surface 2104, which is not shown. For example, the acoustic lens 2100 includes five triangular features radiating from a central aperture. The five triangular features may be joined to form a "five pointed star" shaped aperture. The acoustic lens 2100 may include features to mate to a frame and be further configured to provide a clearance to accommodate movement of a diaphragm assembly of the speaker. Similar to acoustic lens 2000, the acoustic lens 2100 may be composed of plastic or metal, but can be composed of other suitable materials.

Performance of the acoustic lens 2100 is similar to the acoustic lens 2000, except the cavity resonances are suppressed and/or distributed. This typically provides a higher and smoother sound pressure level at high frequencies. Additionally, the directivity typically changes more smoothly with frequency, but may be higher in some frequency ranges.

Figure 22:
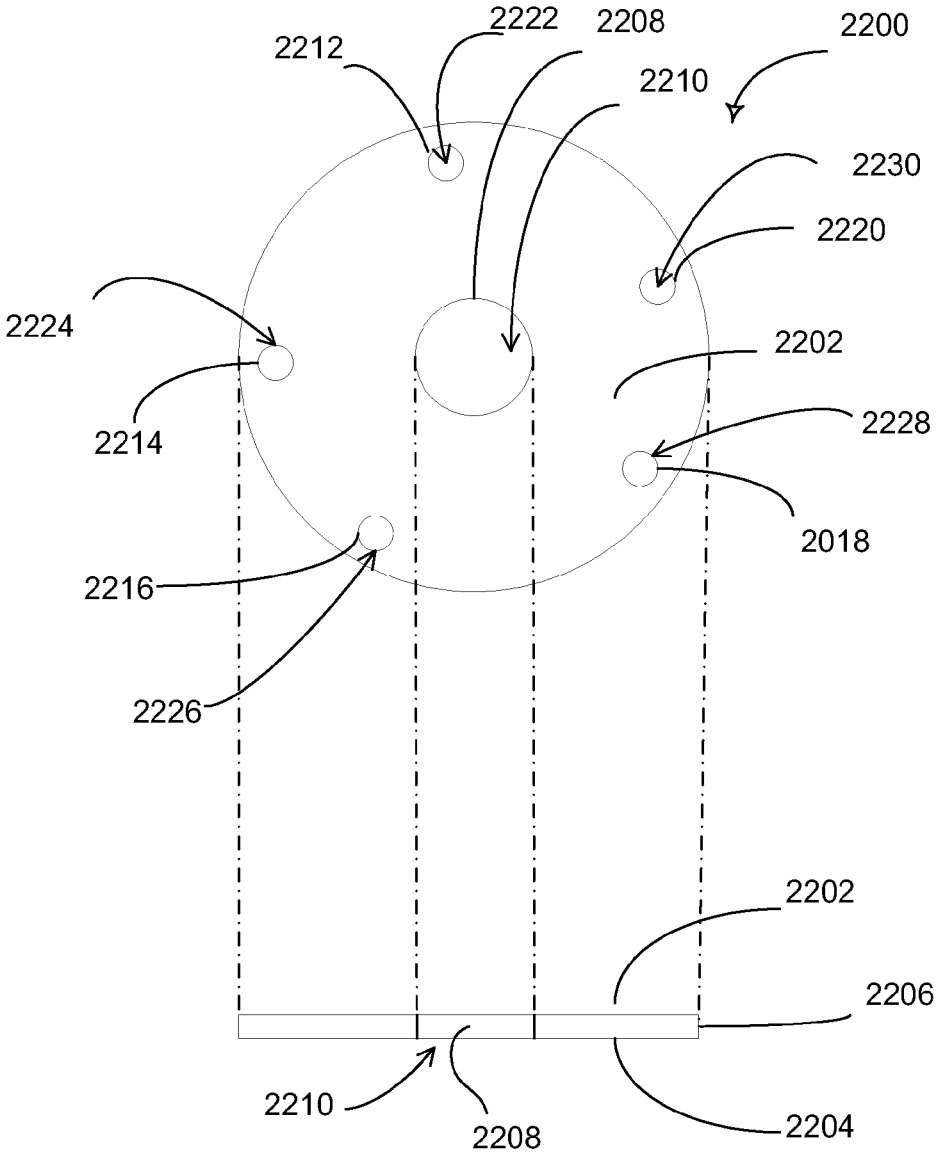
FIG. 22 depicts a top view and cross-sectional view of another example of an acoustic lens.

FIG. 22 depicts a top view and cross-sectional view of an acoustic lens 2200. The acoustic lens 2200 is similar to the acoustic lens 2000. The acoustic lens 2200 may be configured to mount over the sound producing surface of a speaker (not shown). The acoustic lens 2200 includes the first surface 2202 and the second surface 2204. The first surface 2202 and the second surface 2204 form a union to create an exterior edge or lip 2206. The exterior lip or edge 2206 may be configured to rest upon a mounting feature of the speaker. The first surface 2202 and the second surface also form a union to form an interior lip or edge 2208. The interior lip 2208 delineates an aperture 2210, where the interior lip 2208 delineates a cross-sectional area of aperture 2210.

Also similar to the acoustic lens 2000, the acoustic lens 2200 may be configured to locate the aperture 2210 as an axisymmetric opening in or near the central location of the first surface 2202 and second surface 2004. The interior lip or edge 2208 may have a thickness of between 0.5-2.5 mm thick.

In addition, to the axisymmetric opening of aperture 2210, the first surface 2202 and the second surface 2204 may unite to form additional interior lips 2212, 2214, 2216, 2218, and 2220, where each of the vent lips 2212, 2214, 2216, 2218, and 2820 delineate respective vent apertures 2222, 2224, 2226, 2228, and 2230. In FIG. 22, each respective aperture is located about the axisymmetric opening 2210. In some examples, the vent apertures 2222, 2224, 2226, 2228, and 2230 may be distributed proportionally. In other examples, the vent apertures 2222, 2224, 2226, 2228, and 2230 may be distributed approximately the same distance from the central axis of aperture 2210. However, in other examples, the vent apertures 2222, 2224, 2226, 2228, and 2230 may be distributed at varying distances from the center of aperture 2210.

The surface area of the aperture 2210 may be typically 15% or more of the surface area of the acoustic lens 2200. Additionally, there may be a number of axisymmetric "vent" apertures 2222, 2224, 2226, 2228, and 2230 located close to or on an outer diameter whose dimensions are typically similar to the dimensions of the outer diameter of the diaphragm. In some configurations, the acoustic lens 2200 includes an odd number of vent apertures. In other examples, the acoustic lens 2200 includes a prime number of vent apertures.

Each of the vent apertures includes a cross-sectional area delineated by respective vent lips. The combined cross surface area of the "vent" apertures may be less than or equal to the surface area of the aperture 2210. The acoustic lens may include features to mate to a frame of a speaker assembly and provides sufficient clearance from the moving parts of the speaker diaphragm assembly. The acoustic lens may be typically composed of plastic or metal, but could be composed of other suitable materials.

Performance of the acoustic lens 2200 is similar to the acoustic lens 2100. However, the combination of the aperture 2210 and the vent apertures 2222, 2224, 2226, 2228, and 2230 increase the effective aperture area provided to the acoustic lens 2200. Accordingly, the acoustic lens 2200 exhibits a higher Helmholtz resonance frequency. In addition, the acoustic lens 2200 may have a wider Helmholtz resonance frequency range and a lower Helmholtz resonance sound pressure level increase.

The directivity of the acoustic lens 2200 is typically higher from the Helmholtz resonance frequency to the frequency with a corresponding wavelength approximately equal to pi ($\pi$) times the effective radius of the central aperture. Above this frequency, the sound pressure level and directivity are typically essentially unchanged. The sound pressure "insertion loss" and distortion are typically reduced.

Figure 23:
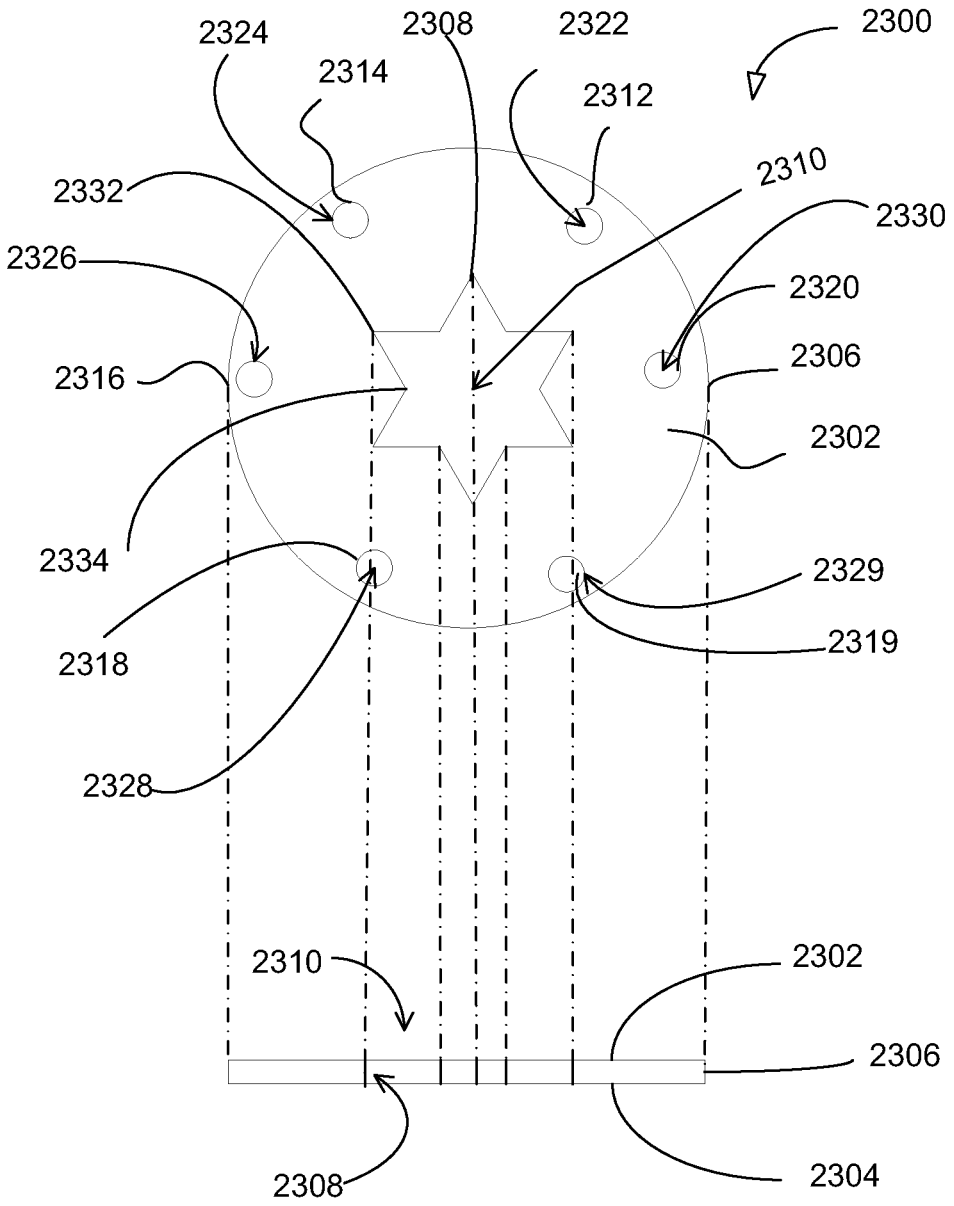
FIG. 23 depicts a top view and cross-sectional view of another example of an acoustic lens.

FIG. 23 depicts a top view and a cross-sectional view of an acoustic lens 2300. The acoustic lens 2300 is formed similar to acoustic lens 2100, where like numbers and features correspond. In addition, the acoustic lens 2300 further includes the vent apertures 2322, 2324, 2326, 2328, 2329, and 2330 similar to the vent apertures of the acoustic lens 2200.

In FIG. 23, the aperture 2310 includes an even number of star points. However, similar to other disclosed examples, the aperture 2310 may includes an odd or prime number of non-axisymmetric features, which extend to an outer diameter whose dimensions are typically similar to the dimensions of the outer diameter of the diaphragm. For example, the vertices 2332 are formed by a triangular feature radiating from a central aperture 2310, producing a "6 pointed star" shaped aperture. Additionally, the acoustic lens 2300 may further include a number of axisymmetric "vent" apertures located near an outer diameter of the acoustic lens 2300 whose dimensions are typically similar to the dimensions of the outer diameter of the diaphragm. The number of axisymmetric vent apertures may be an odd number or a prime number. The combined surface area of the "vent" apertures is typically less than or equal to the surface area of the aperture 2310. The acoustic lens 2300 may include features to mate to a frame of a speaker or speaker assembly, while providing clearance for the moving diaphragm assembly. The acoustic lens 2300 is typically composed of plastic or metal, but could be composed of other suitable materials.

Figure 24:
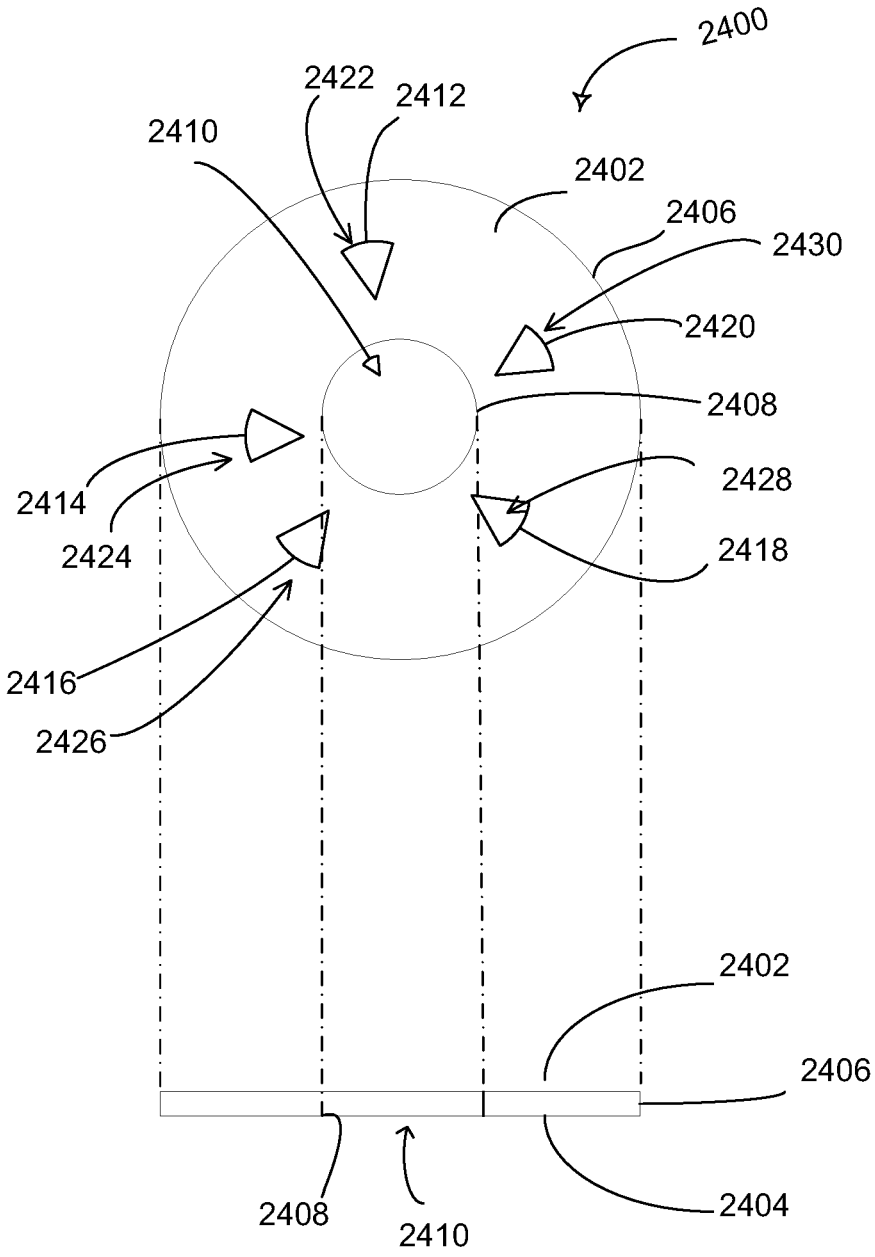
FIG. 24 depicts a top view and cross-sectional view of another example of an acoustic lens.

Acoustic lens 2300 has similar performance of the acoustic lens 2200, however, the acoustic lens 2300 provides further suppression and/or distribution of the cavity resonances. The improved cavity resonance performance provides a higher and smoother sound pressure level at high frequencies. Additionally, the directivity typically changes more smoothly with frequency and may in some examples be higher in some frequency ranges FIG. 24 depicts a top and cross-sectional view of an acoustic lens. As depicted, an acoustic lens 2400 may include a form similar to the acoustic lens 2200, where like numbers and features correspond. The acoustic lens 2400 further includes vent apertures 2422, 2424, 2426, 2428, 2430 similar to the vent apertures of the acoustic lens 2200. However, the vent apertures of the acoustic lens 2400 may be non-axial symmetric. Furthermore, the vent apertures of the acoustic lens 2400 may be wedge shaped or triangular shaped. Accordingly, the vent apertures of the acoustic lens 2400 may be a polygonal shaped aperture having odd numbers of sides or a prime number of sides. Furthermore, the sides of vent apertures of the acoustic lens 2400 may further include curved features.

The surface area of the aperture 2410 is typically at least 15% of the surface area of the acoustic lens 2400. Additionally, the non-axisymmetric "vent" apertures may be located on an outer diameter, whose dimensions are typically similar to the dimensions of the outer diameter of the diaphragm of the speaker over which the acoustic lens 2400 is positioned.

In some examples, the combined surface area of the "vent" apertures is typically less than or equal to the surface area of a centrally located aperture similar to the aperture 2410. The acoustic lens 2400 may include features to mate to a frame of a speaker assembly or speaker while providing clearance for the moving diaphragm assembly. The acoustic lens 2400 may be composed of plastic, metal, or other suitable materials.

Figure 25:
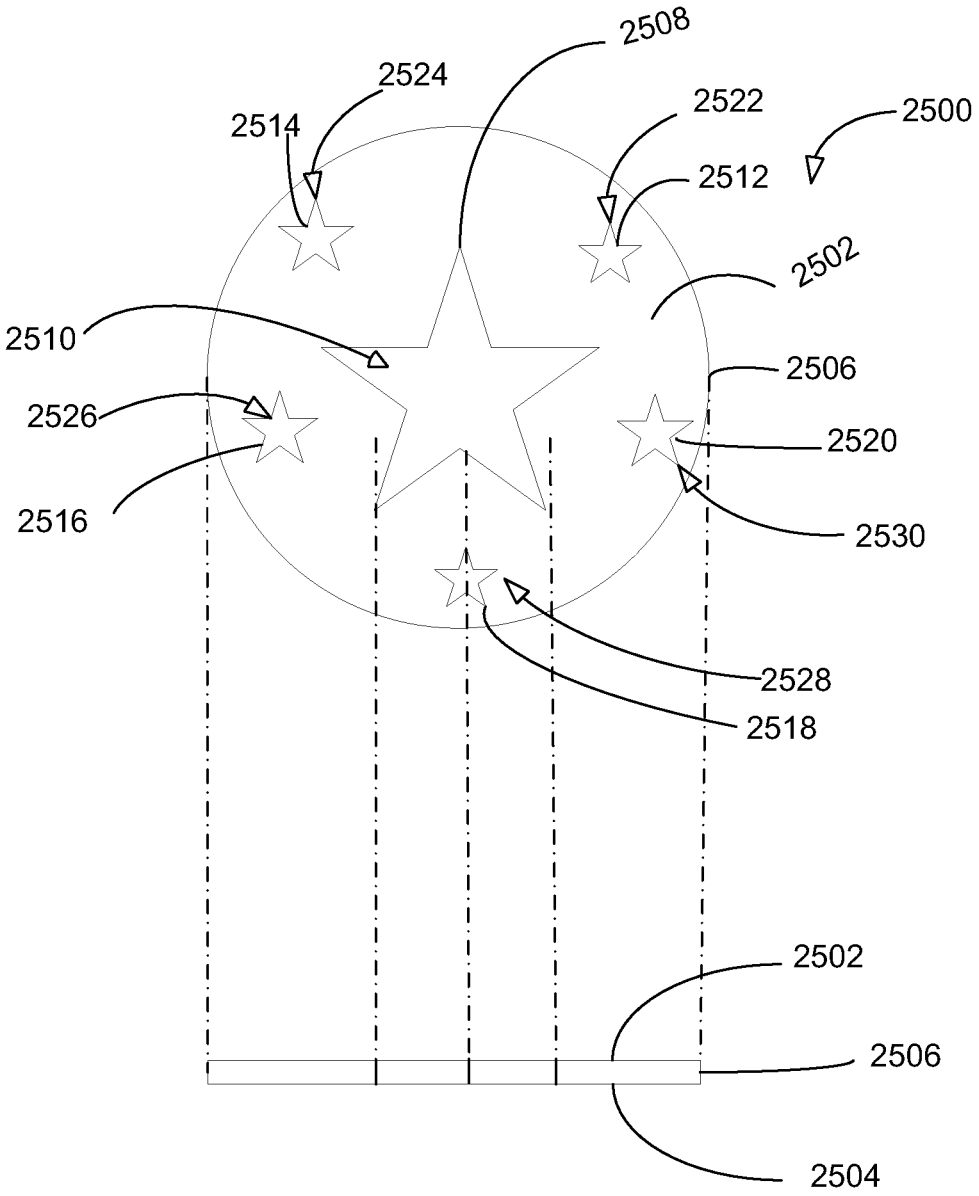
FIG. 25 depicts a top view and cross-sectional view of another example of an acoustic lens.

In FIG. 25, a top and a cross-sectional view of acoustic lens 2500. In FIG. 25, the acoustic lens 2500 may include a form similar to the acoustic lens 2300, where like numbers and features correspond. However, unlike the acoustic lens 2300, the acoustic lens 2500 is depicted as having an aperture 2410 that is substantially shaped as a five pointed etoile or five pointed star. In addition, unlike the vent opening of acoustic lens 2300, the vent openings of the acoustic lens 2500 may be configured as an estoile or star shape. While FIG. 25 depicts the vent apertures as beings substantially shaped as a five pointed star, some examples of the acoustic lens 2500 may include a vent aperture with a different number of radiating point than the aperture 2510.

Figure 26:
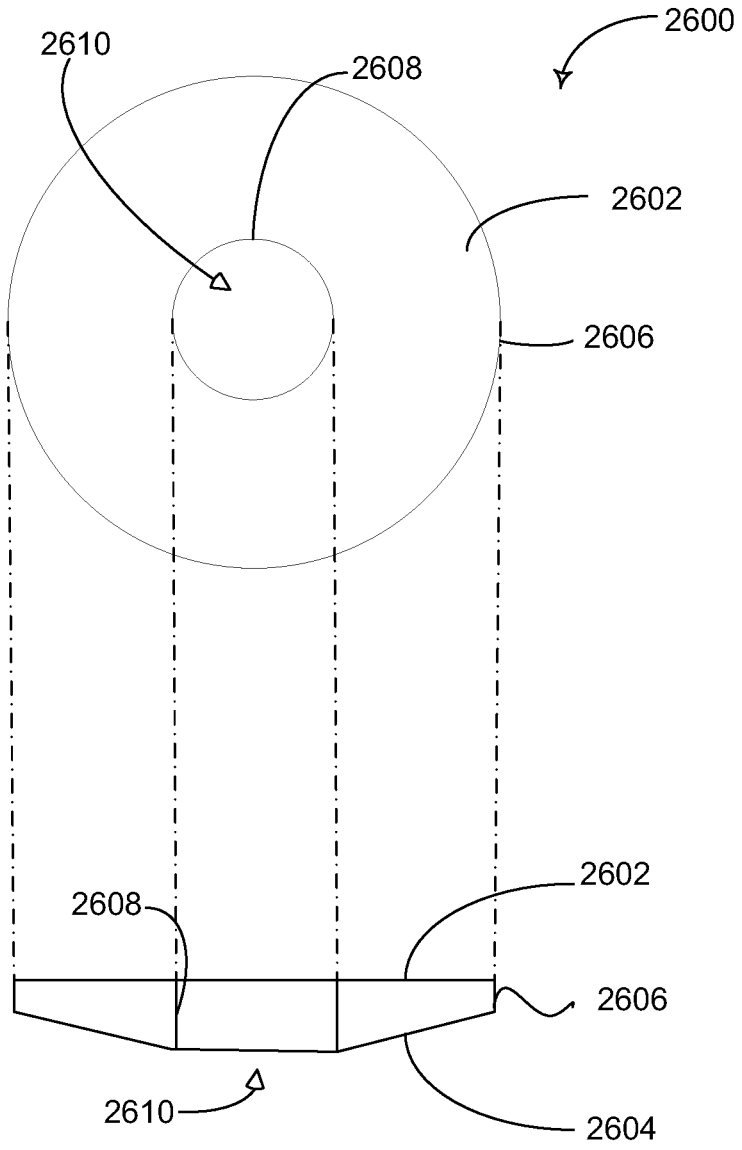
FIG. 26 depicts a top view and cross-sectional view of another example of a phase plug.

FIG. 26 depicts a top and cross-sectional view of phase plug 2600. In FIG. 26, the phase plug 2600 may be configured to mount over the sound producing surface of a speaker (not shown). The phase plug 2600 includes a first surface 2602 and a second surface 2604. The first surface 2602 and the second surface 2604 form a union to create an exterior edge or lip 2606. The exterior lip or edge 2606 may be configured to rest upon a mounting feature of the speaker. The first surface 2602 and the second surface 2604 unite to form an interior lip or edge 2608. The interior lip 2608 delineates an aperture 2610, where the interior lip 2608 delineates a cross-sectional area of the aperture 2610.

As a non-limiting example, the aperture 2610 includes an axisymmetric opening in or near the central location of the first surface 2602 and the second surface 2604. The exterior or edge 2008 may have a thickness of between 0.5-2.5 mm thick. However, unlike the acoustic lens 2000, the phase plug 2600 plug fills in more of the cavity created when the phase plug 2600 is mounted to a speaker, which is not shown. Upon mounting the phase plug 2600 on the speaker, a cavity is formed between the second surface 2604 and the diaphragm (not shown) of the speaker.

The surface area of the cross-section of the aperture 2610 may be 15% or more of the surface area of the top of the plug. The phase plug 2600 may include features to mate to a frame of a speaker. The phase plug 2600 may be configured to allow a clearance between the speaker and the second surface 2610. The clearance allows for non-interference between the phase plug 2600 and the diaphragm assembly. Accordingly, the clearance permits the movement of the diaphragm assembly without coming into contact with the phase plug 2600. The phase plug 2600 may be composed of plastic, metal, or other suitable materials.

Performance of the phase plug 2600 is similar to the phase plug 2000. However, phase plug 2600 decreases the volume of the cavity between the diaphragm and the plug. The decreased cavity volume increases the Helmholtz resonance frequency. The decreased cavity volume may increases the Helmholtz resonance frequency range while decreasing the Helmholtz resonance sound pressure level.

The increase in the length of the aperture 2610 ("port") causes a decrease in the Helmholtz resonance frequency, a decrease in the frequency range, and an increase in sound pressure level. The net result depends on the relative contributions of volume decrease and "port length" increase of the aperture 2610. The port length increase of aperture 2610 may also cause peaks and dips due to port resonances, which may be in addition to cavity resonances. The directivity of the phase plug 2600 is similar to the phase plug 2000, except at highest frequencies. The use of the phase plug 2600 may increase the sound pressure "insertion loss" and distortion.

Figure 27:
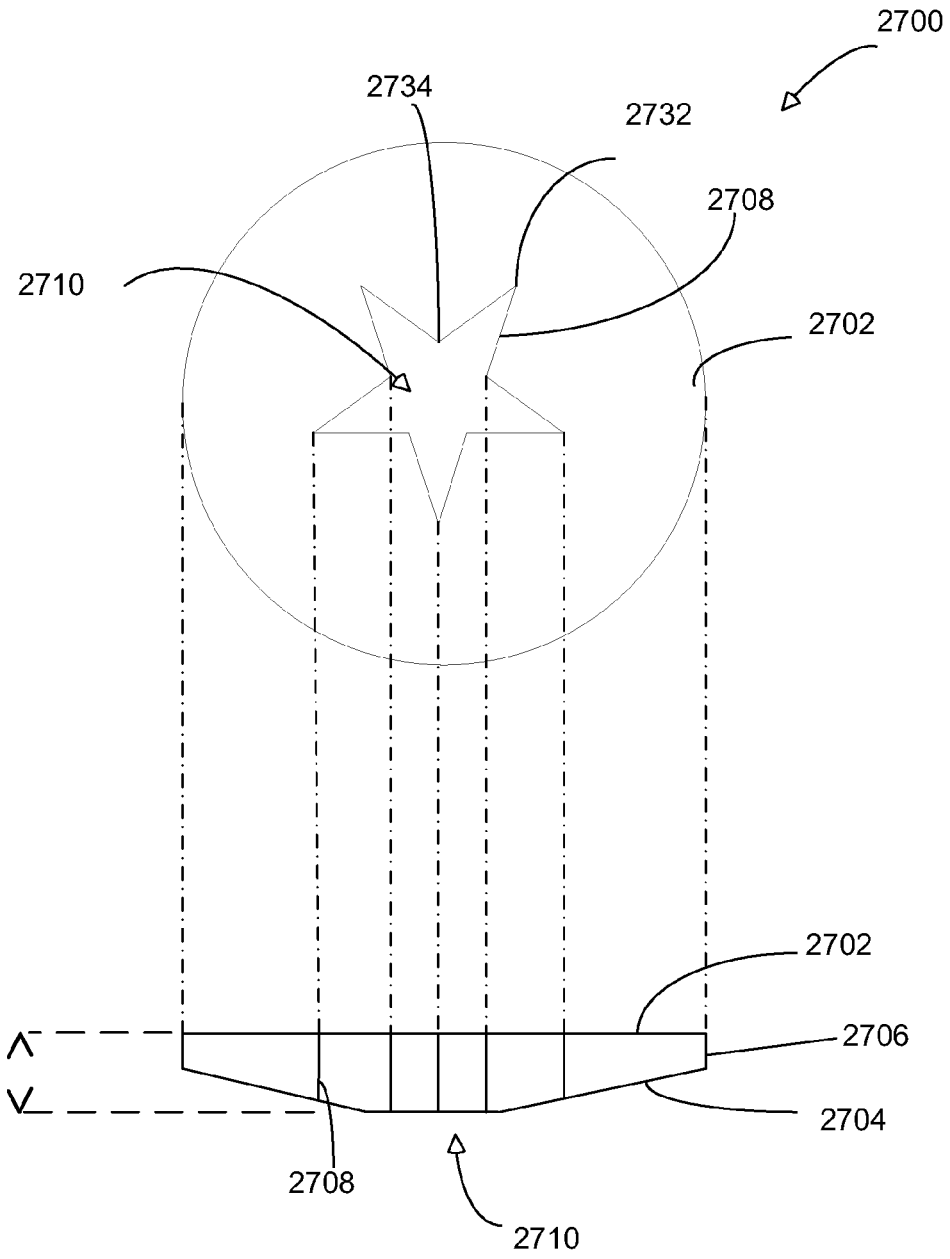
FIG. 27 depicts a top view and cross-sectional view of another example of a phase plug.

FIG. 27 depicts a top view and a corresponding cross-sectional view of a phase plug 2700. The phase plug 2700 may be configured to mount over the sound producing surface of a speaker (not shown). The phase plug 2700 includes a first surface 2702 and a second surface 2704. The first surface 2702 and the second surface 2704 unite to form an exterior edge or lip 2706. The exterior lip or edge 2706 may be configured to rest upon a mounting feature of the speaker. The first surface 2702 and second surface also form a union to form an interior lip or edge 2708. The interior lip 2708 delineates an aperture 2710, where the interior lip 2708 delineates a cross-sectional area of the aperture 2710.

The interior lip 2708 may be configured to include edges of various geometric shapes. Illustratively, the interior lip 2708 may be configured to resemble an etoile, an estoile, or star-like shape having a plurality of vertices 2712 and 2714. Illustratively, some vertices, similar to the vertex 2714, may project into the aperture 2710. Other vertices, similar to the vertex 2714, may project outwardly from a center of the aperture 2710. Although depicted as a star having five radiating points, other examples may include an etoile, estoile, or star shaped aperture having an odd number of radiating points. Still other examples may include an aperture as an irregular polygon, an estoile, or an etoile.

Some examples of the phase plug 2700 may include a tapered or sloped portion to conform the second surface 2704 to interface with a speaker assembly (not shown). At the exterior edge 2706, phase plug 2700 may have a thickness of between about 0.5-2.5 mm at the exterior edge.

The aperture 2710 may be non-axisymmetric about the center of the body of the phase plug 2700. The cross-sectional area delineated by the interior lip 2708 of the aperture 2710 is typically 15% or more of the surface area of the phase plug 2700. In some examples, the aperture 2710 may include an odd—typically prime number, of non-axisymmetric features. The non-axisymmetric features may extend to an outer diameter whose dimensions are typically similar to the dimensions of the outer diameter of the diaphragm of a speaker mounted proximate to the second surface 2704 (not shown).

For example, the phase plug 2700 includes five triangular features radiating from a central aperture. The five triangular features may be joined to form a "five pointed star" shaped aperture. The phase plug 2700 may include features to mate to a frame and be further configured to provide a clearance to accommodate movement of a diaphragm assembly of the speaker. Similar to the acoustic lens 2100, the phase plug 2700 may be composed of plastic or metal, but could be composed of other suitable materials.

As a non-limiting example, the aperture 2710 includes an axisymmetric opening in or near the central location of the first surface 2702 and the second surface 2704. The exterior or edge 2708 may have a thickness of between 0.5-2.5 mm thick. However, unlike the acoustic lens 2000, the phase plug 2700 plug fills in more of the cavity created when the phase plug 2700 is mounted to a speaker, which is not shown. Upon mounting the phase plug 2700 on the speaker, a cavity is formed between the second surface 2704 and a diaphragm of the speaker (not shown).

The surface area of the cross-section of the aperture 2710 may be 15% or more of the surface area of the top of the plug. The phase plug 2700 may include features to mate to a frame of a speaker. The phase plug 2700 may be configured to allow a clearance between the speaker and the second surface 2710. The clearance allows for non-interference between the phase plug 2700 and the diaphragm assembly. Accordingly, the clearance permits the movement of the diaphragm assembly without coming into contact with the phase plug 2700. The phase plug 2700 may be composed of plastic, metal, or other suitable materials.

The phase plug 2700 performs similar to the phase plug 2600. However, the phase plug 2700 better suppresses and/or distributes the port and cavity resonances. As a result, examples of the phase plug 2700 typically provide a higher and smoother sound pressure level at high frequencies. Additionally, the typical directivity of the phase plug 2700 changes more smoothly with frequency, but may be higher in some frequency ranges.

Figure 28:
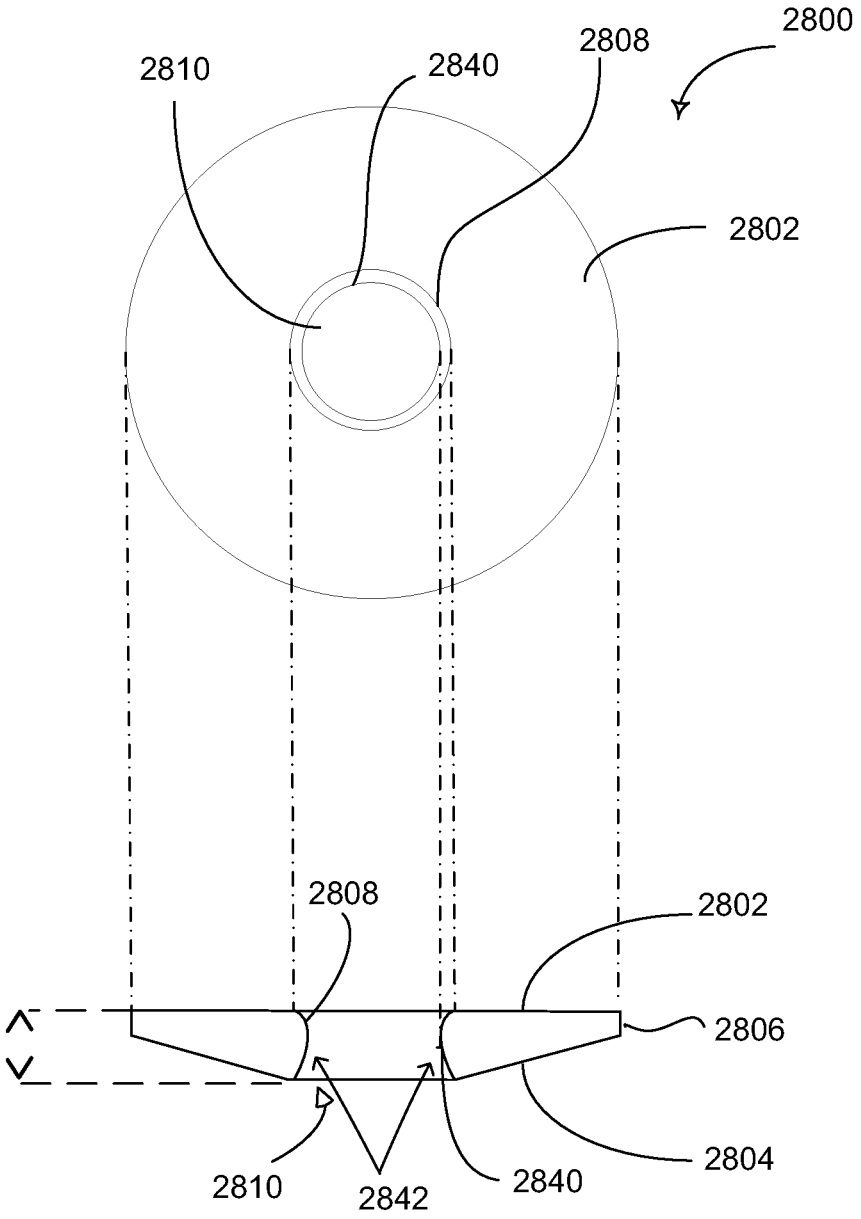
FIG. 28 depicts a top view and cross-sectional view of another example of a phase plug.

FIG. 28 depicts a top view and a cross-sectional view of the phase plug 2800. The phase plug 2800 may be configured to mount over the sound producing surface of a speaker (not shown). The phase plug 2800 includes a first surface 2802 and a second surface 2804. The first surface 2802 and the second surface 2804 form a union to create an exterior edge or lip 2806. The exterior lip or edge 2806 may be configured to rest upon a mounting feature of the speaker. The first surface 2802 and second surface also form a union to form an interior lip or edge 2808. The interior lip 2808 delineates an aperture 2810.

As shown in the cross-sectional view of FIG. 28, a port feature 2832 of the phase plug 2800 may bulge inwardly to constrict the aperture 2810. Accordingly, the edge of the port feature 2842 delineates an effective cross-sectional area of the aperture 2010. Although not depicted in FIG. 28, the port feature 2832 may include asymmetric features or otherwise be non-symmetric. In addition, in FIG. 28, the second surface 2804 of the phase plug 2800 may include an interior curved feature 2840 that forms a portion of the interior edge 2808.

As a non-limiting example, the aperture 2810 includes an axisymmetric opening in or near a central location of the first surface 2802 and the second surface 2804. The exterior lip or edge 2808 may have a thickness of between 0.5-2.5 mm thick.

The aperture 2810 of the phase plug 2800 may include an axisymmetric feature located approximately in the center of first surface 2802. Similar to the phase plug 2700, the phase plug 2800 fills the cavity between the diaphragm of the speaker (not shown) and the second surface 2804. One or both ends of the aperture may be contoured. The surface area of the aperture 2810 is typically 15% or more of the surface area of the top of the plug. The plug has features to mate to a frame while providing clearance for the moving diaphragm assembly of a speaker. The phase plug 2800 may be composed of plastic, metal or other suitable materials.

The phase plug 2800 performs similar to the phase plug 2700, except that the frequency response of the phase plug 2800 may be smoother. In addition, the phase plug 2800 may have a significantly reduced sound pressure "insertion loss." In addition, the phase plug 2800 may have a significant reduction in distortion.

Figure 29:
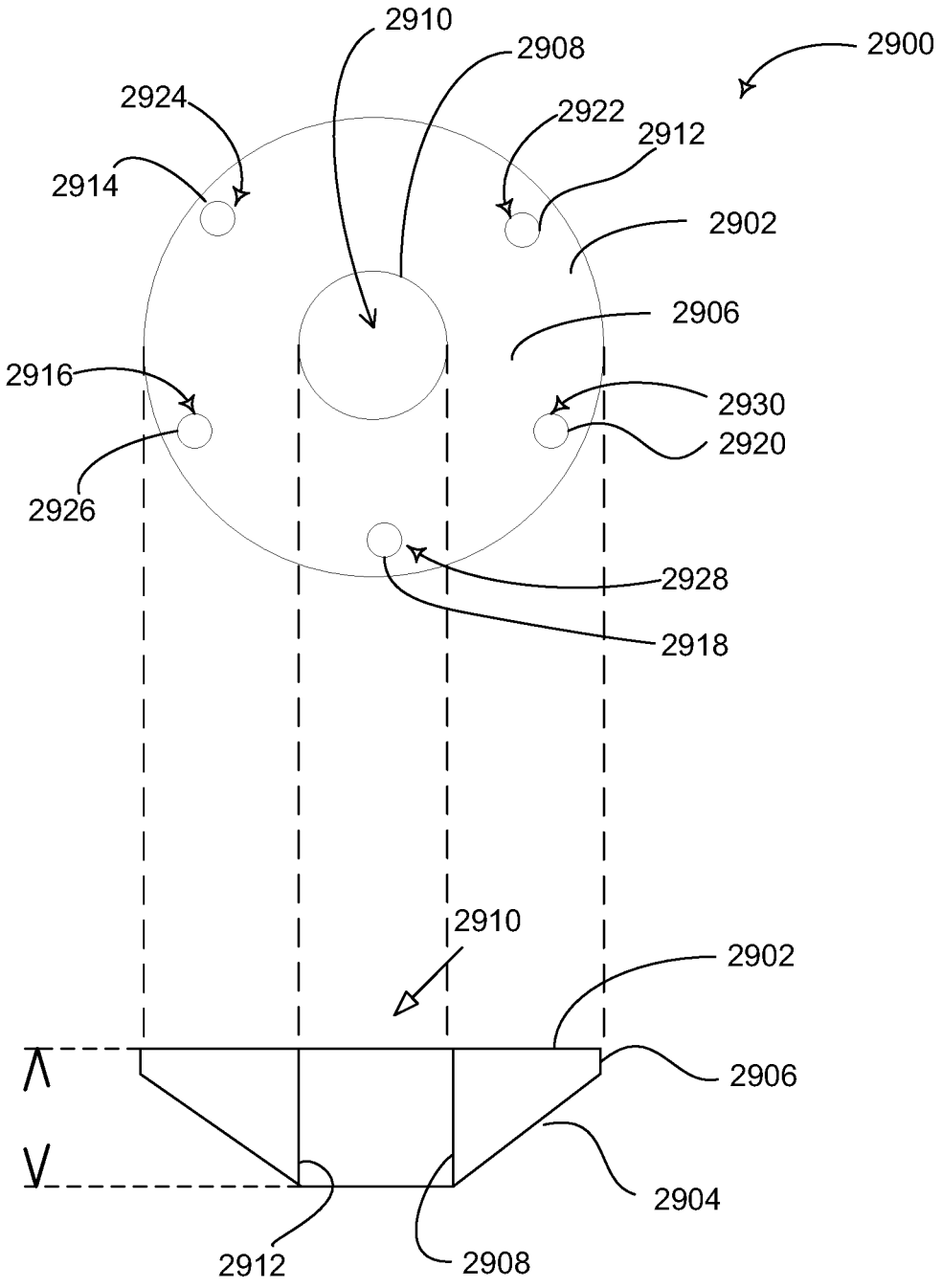
FIG. 29 depicts a top view and cross-sectional view of another example of a phase plug.

FIG. 29 depicts a top and cross-sectional view of a phase plug 2900. The phase plug 2900 may be configured to mount over the sound producing surface of a speaker (not shown). The phase plug 2900 includes a first surface 2902 and a second surface 2904. The first surface 2902 and the second surface 2904 form a union to create an exterior edge or lip 2906. The exterior lip or edge 2906 may be configured to rest upon a mounting feature of the speaker. The first surface 2902 and second surface also form a union to form an interior lip or edge 2908. The interior lip 2908 delineates an aperture 2910, and where the interior lip 2908 delineates a cross-sectional area of aperture 2910.

Similar to the phase plug 2600, the phase plug 2900 may include the aperture 2910 configured as an axisymmetric opening in or near the central location of the first surface 2902 and the second surface 2904. The exterior or edge 2908 may have a thickness of between 0.5-2.5 mm thick. However, unlike the phase plug 2600, the phase plug 2900 plug fills in more of the cavity created when the phase plug 2900 is mounted to a speaker, which is not shown. Upon mounting the phase plug 2900 on the speaker, a cavity is formed between second surface 2904 and a diaphragm (not shown) of the speaker.

The surface area of the cross-sectional area of the aperture 2910 may be 15% or more of the surface area of the top of the phase plug 2900. The phase plug 2900 may include features to mate to a frame of the speaker. The phase plug 2900 may be configured to allow a clearance between the speaker and the second surface 2910. The clearance allows for non-interference between the phase plug 2900 and the diaphragm assembly of the speaker. Accordingly, the clearance permits the movement of the diaphragm assembly without coming into contact with the phase plug 2900. The phase plug 2900 may be composed of plastic or metal. Phase plug 2900 may also be composed of other suitable materials.

Performance of the phase plug 2900 is similar to the phase plug 2600. However, the phase plug 2900 decreases the volume of the cavity between the diaphragm and the plug. The decreased cavity volume increases the Helmholtz resonance frequency. The decreased cavity volume may increase the Helmholtz resonance frequency range while decreasing the Helmholtz resonance sound pressure level.

Similar to the phase plug 2200, in FIG. 22, the phase plug 2900 further includes additional "vent" apertures. In FIG. 29, like numbered elements of phase plug 2200 are similar to like numbered elements of the phase plug 2900.

In FIG. 29, the first surface 2902 and second surface 2904 may unite to form additional interior lips 2912, 2914, 2916, 2918, and 2920, where each of the vent lips 2912, 2914, 2916, 2918, and 2820 delineate respective vent apertures 2922, 2924, 2926, 2928, and 2930.

In FIG. 29, each respective aperture is located about the axisymmetric opening 2910. In some examples, the vent apertures 2922, 2924, 2926, 2928, and 2930 may be distributed proportionally. In other examples, the vent apertures 2922, 2924, 2926, 2928, and 2930 may be distributed approximately the same distance from the central axis of the aperture 2910. However, in other examples, the vent apertures 2922, 2924, 2926, 2928, and 2930 may be distributed at varying distances from the center of aperture 2910. Although FIG. 29 depicts five "vent" apertures located about the exterior diameter, near the outer edge 2906 of the phase plug 2900, other examples may include vent apertures distributed asymmetrically about the aperture 2910. In addition, other examples may include non-axisymmetric "vent" apertures or a combination of different types of vent apertures similar to the vent apertures depicted in the acoustic lens 2400 and 2500. The combination of the vent apertures 2922, 2924, 2926, 2928, and 2930 and the aperture 2910 provide an increase in total aperture area.

Examples of the phase plug 2900 may have a similar performance as phase plug 2600. However, the phase plug 2900 may exhibit a higher Helmholtz resonance frequency. In addition, compared to the phase plug 2600, the phase plug 2900 may have a wider Helmholtz resonance frequency range and a lower Helmholtz resonance sound pressure level. The higher Helmholtz resonance frequency, wider frequency range, and lower sound pressure level are due to the increase total aperture area. The directivity of the phase plug 2900 is typically higher from the Helmholtz resonance frequency to the frequency with a corresponding wavelength approximately equal to pi times the effective radius of the central aperture. Above this frequency, the sound pressure level and directivity are typically essentially unchanged. In addition, the phase plug 2900 typically has a reduced sound pressure "insertion loss" and distortion.

Figure 30:
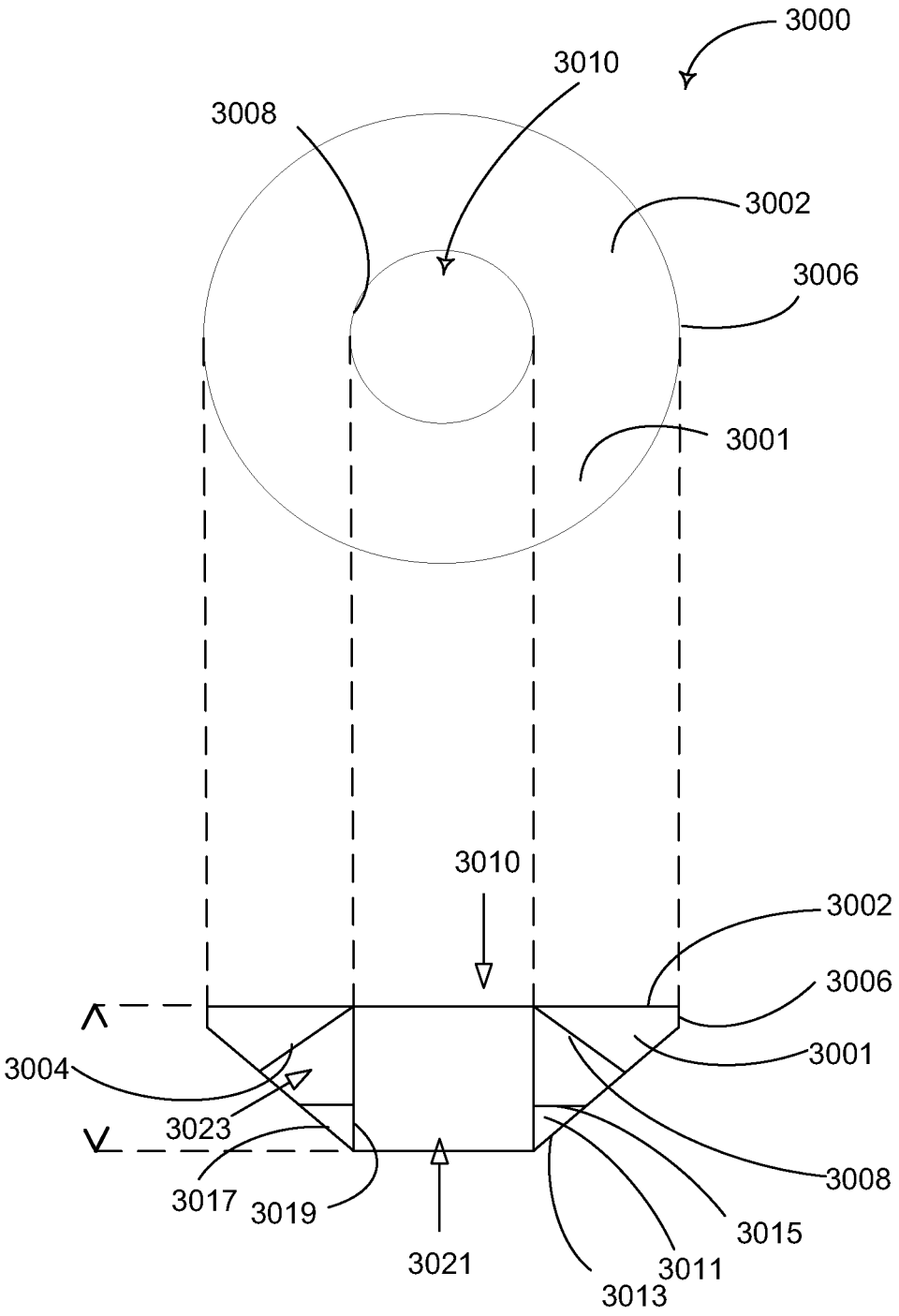
FIG. 30 depicts a top view and cross-sectional view of another example of a phase plug.

FIG. 30 depicts a phase plug 3000. Similar to the phase plug 100, the phase plug 3000 may include a first member 3001. The first member 3001 may include a first surface 3002 and a second surface 3004. The first surface 3002 and the second surface 3004 of first member 3001 may unite to from a first exterior edge 3006 and a first interior edge 3008. The first interior edge 3008 may delineate a first aperture 3010.

The phase plug 3000 may further include a second member 3011 that may include a third surface 3013 and a fourth surface 3015. The third surface 3013 and the fourth surface 3015 may united to form a second exterior edge 3017 and a second interior edge 3019. The interior edge 3019 may delineate a second aperture 3021.

Similar to acoustic lens 100, phase plug 3000 may be formed by joining the first member 3001 and the second member 3011. In FIG. 3000, similar to phase plug 100, the second surface 3004 and third surface 3013 are located in opposition to form at least one aperture 3023 between the first member 3001 and the second member 3011.

In some examples of the phase plug 3000, the apertures 3010, 3021, and 3023 may join together to form a passage through the phase plug 3000.

The phase plug 3000 may include an axisymmetric passage through the center of phase plug 3000. Similar to the phase plug 100, the phase plug 3000 fills the cavity between the diaphragm of a speaker and the fourth surface 3019. The surface areas of the first aperture 3010 and second aperture 3021 are typically 15% or more of the surface area of the first surface 3002 of the phase plug 3000. The total surface area of aperture(s) 3023 is typically less than 15% of the surface area of the first surface 3002 of the phase plug 3000.

In some examples, the phase plug 3000 may include an odd or prime number of cross-sectional area slots that extend from the side of the aperture/passage 3010 to the bottom surface of the phase plug 3000. The combined surface area of the slots is typically less than or equal to the surface area of the central aperture 3010. The phase plug 3000 may include features to mate to a frame of a speaker while providing clearance for a moving diaphragm assembly of the speaker. The plug is typically composed of plastic or metal, but could be composed of other suitable materials.

The performance of the phase plug 3000 is similar to the phase plug 2600. However, the phase plug 3000 may have a lower Helmholtz resonance frequency, a wider frequency range, and a lower sound pressure level increase. The sound pressure level and directivity are typically lower above the Helmholtz resonance frequency. In comparison to the phase plug 2600, the sound pressure "insertion loss" and distortion of the phase plug 3000 are typically reduced.

Figure 31:
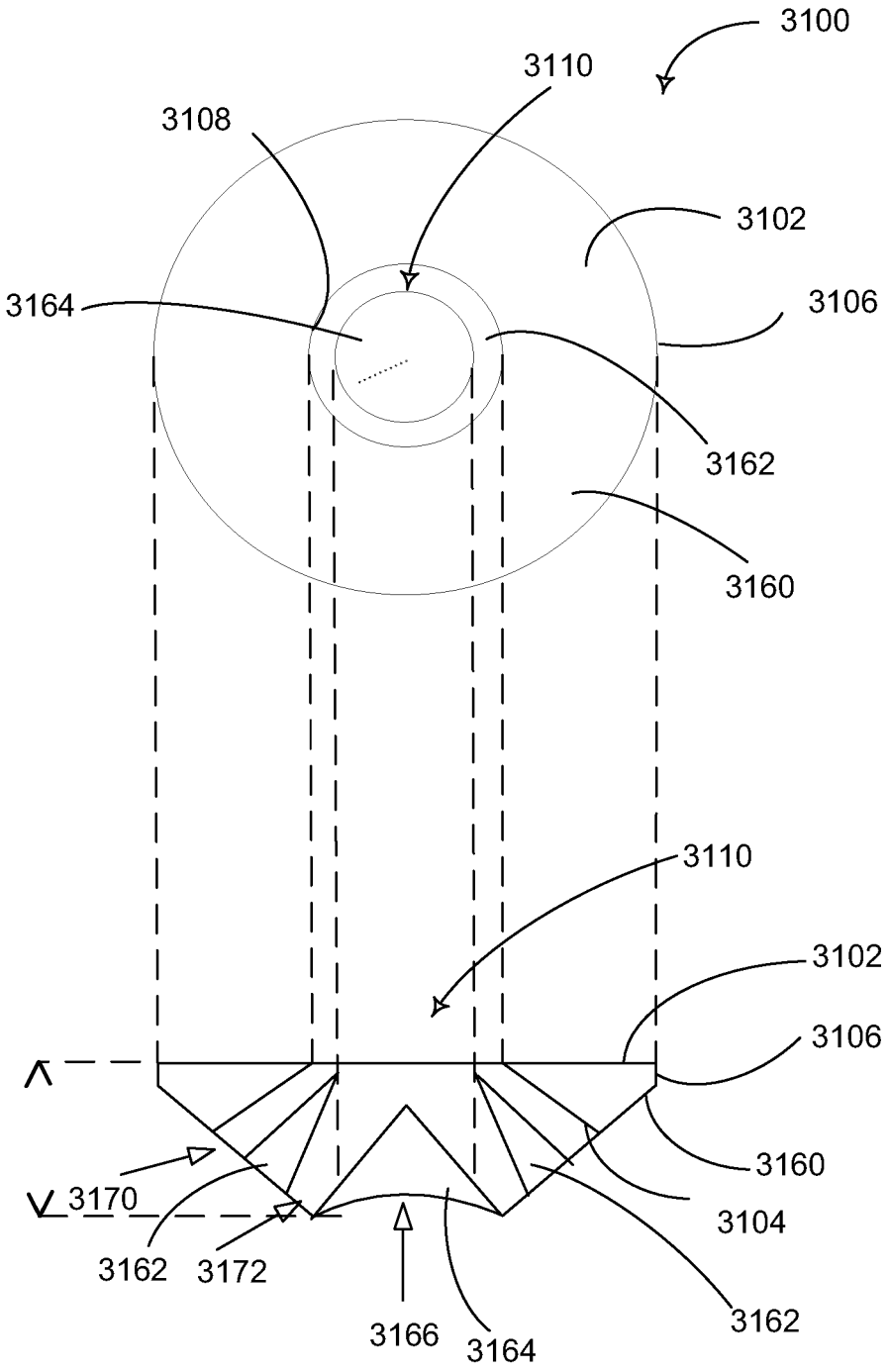
FIG. 31 depicts a top view and cross-sectional view of another example of a phase plug.

FIG. 31 depicts a phase plug 3100, which is similar to the phase plug 100. The phase plug 3100 includes a first member 3160, a second member 3162, and a third member 3164. The first member 3160 may be joined to the second member 3162 by support members similar to the support members of phase plug 100. The second member 3162 may be joined to the third member 3164 by support members similar to the support members of the phase plug 100.

In FIG. 31, a third member 3164 includes a protuberance similar to the protuberance 152 of the phase plug 100. The third member 3164 may further include a rounded or beveled surface 3166 configured to be positioned over a dustcap of a speaker (not shown).

The first member 3160 and the second member 3162 form at least one aperture 3170 to permit sound energy to pass through phase plug 3100 into a central orifice 3110. The second member 3162 and the third member 3164 form at least one aperture 3172 configured to permit sound energy to pass through the phase plug 3100 into the central orifice 3110.

Figure 32:
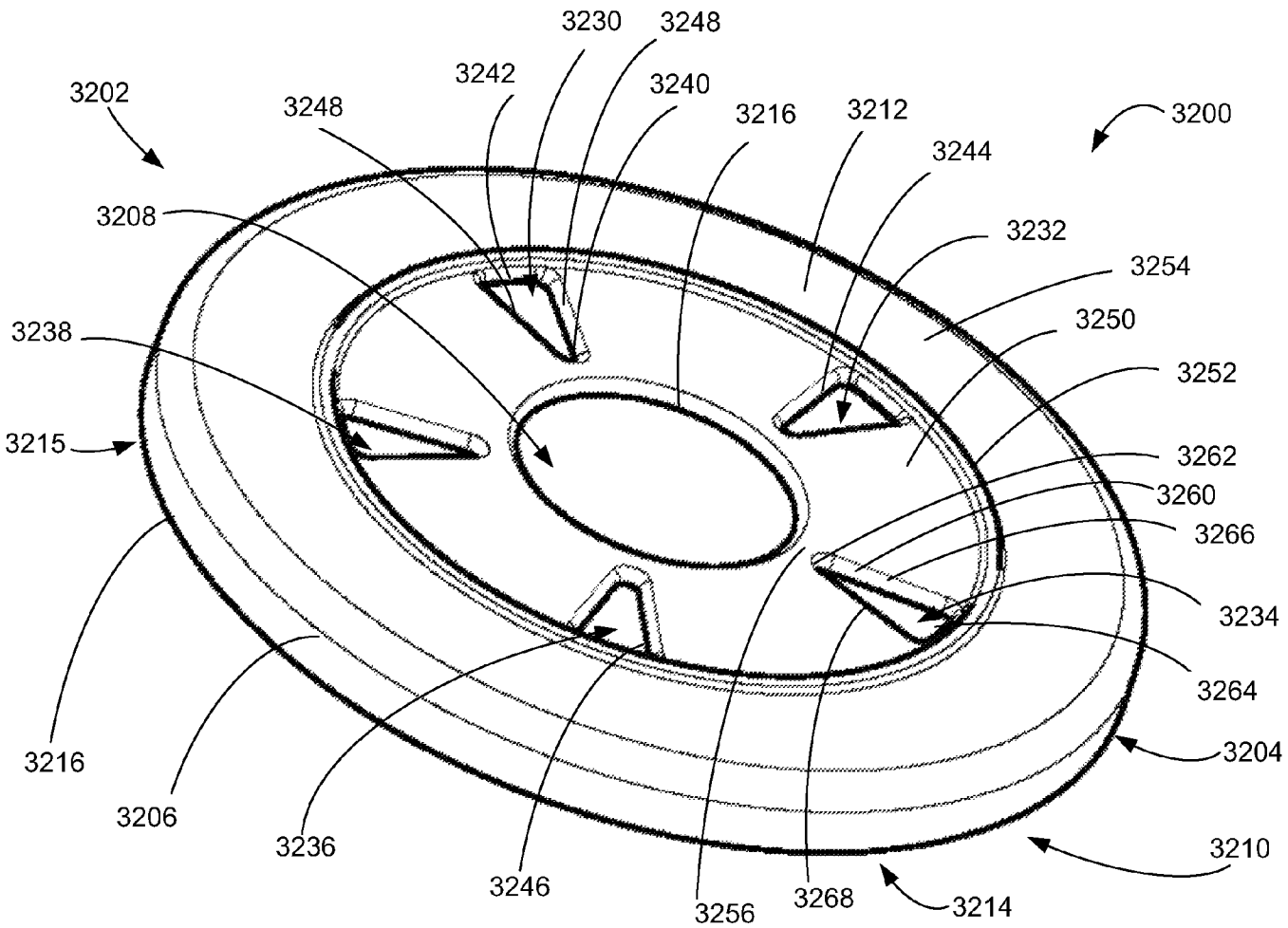
FIG. 32 depicts a perspective view of an example of an acoustic lens 3200.
Figure 33:
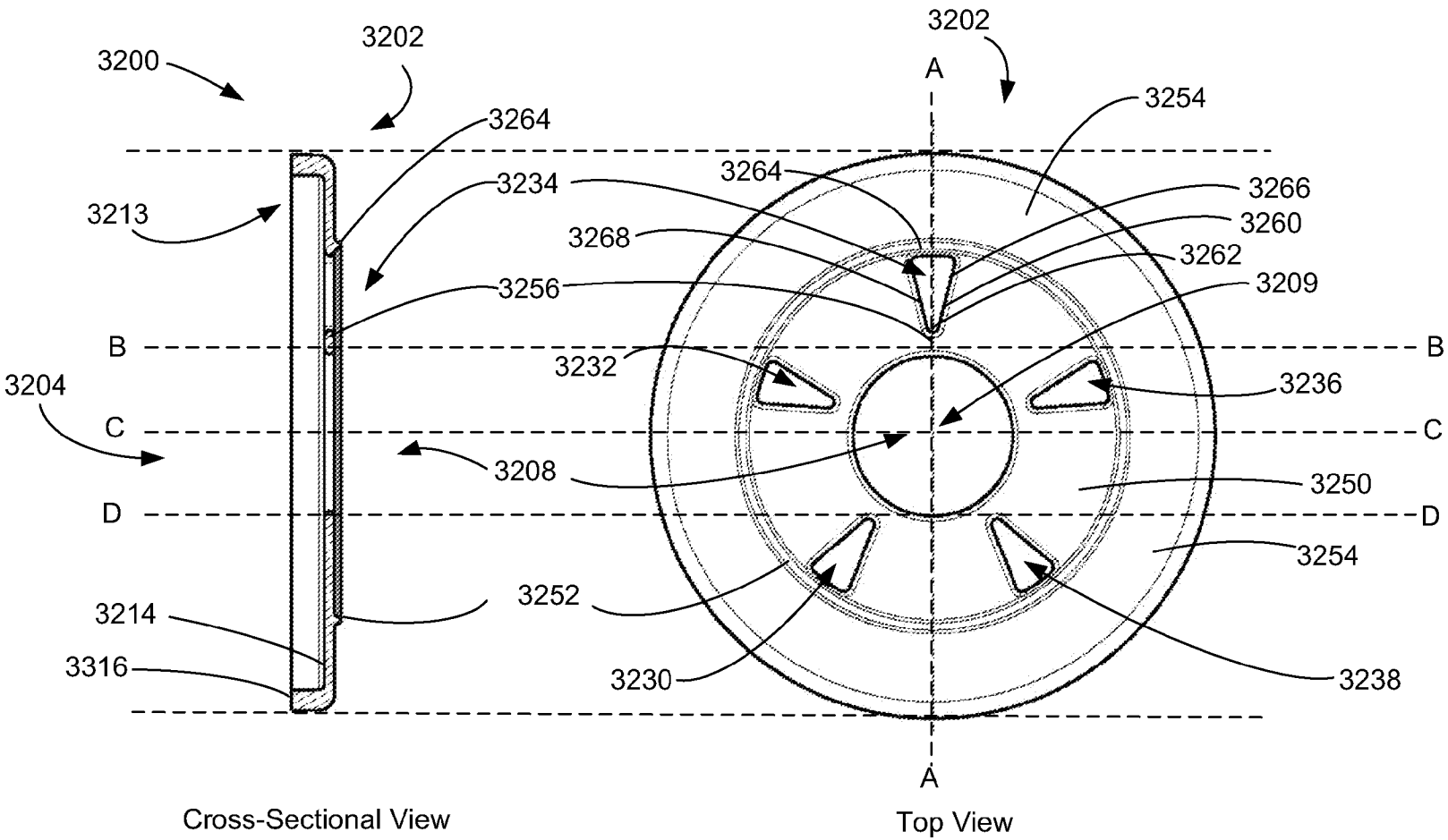
FIG. 33 further depicts a cross-sectional view and top view of an example of a acoustic lens similar to the acoustic lens as shown in FIG. 32.
Figure 34:
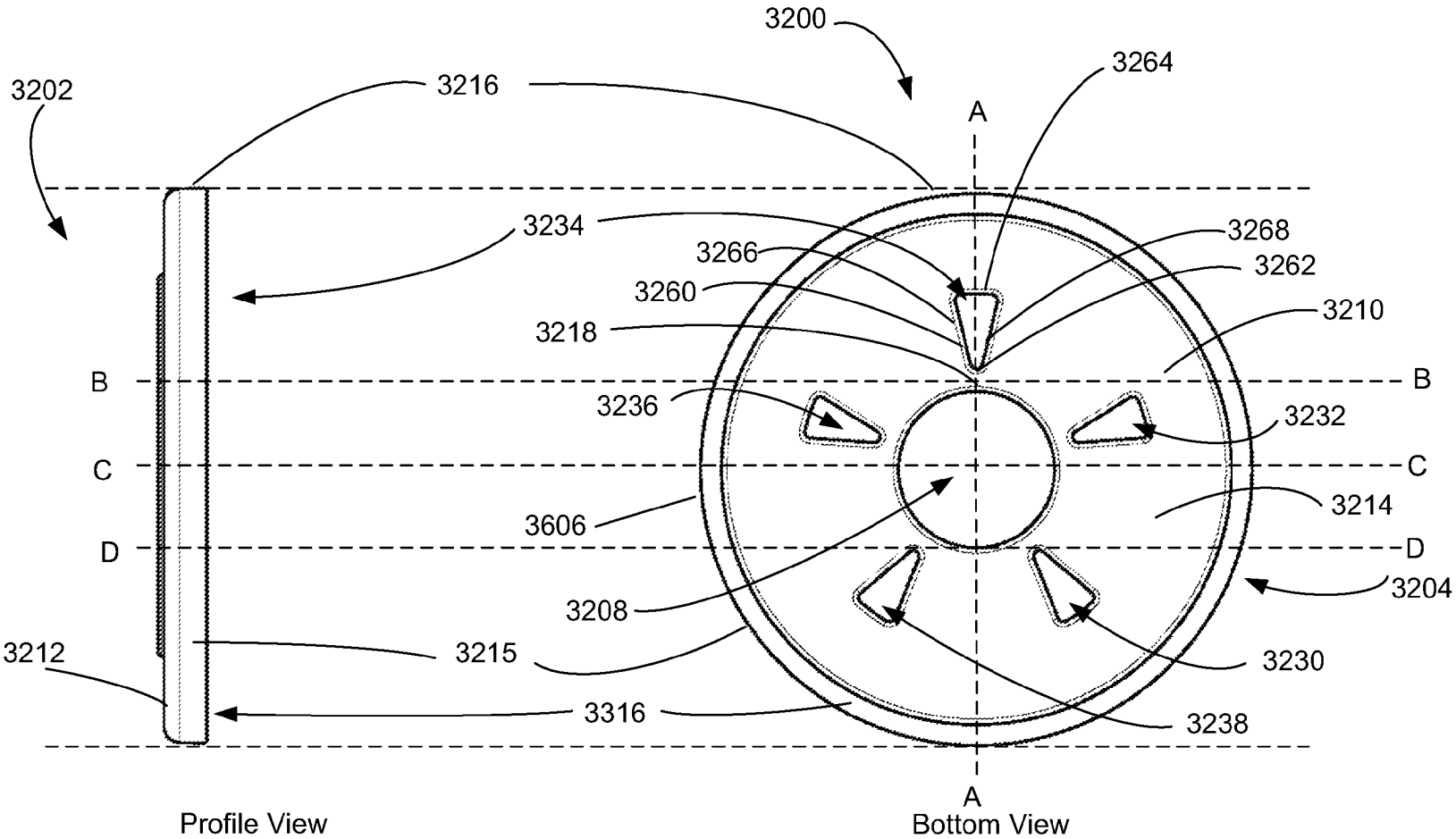
FIG. 34 depicts a side view and bottom view of an example of an acoustic lens similar to the acoustic lens depicted in FIGS. 32 and 33.

Acoustic lens 3200 is depicted in various profiles and orientations in FIGS. 32, 33, and 34. In addition, in FIG. 35, a perspective view of an assembly including acoustic lens 3200 is further shown. In FIG. 24, acoustic lens 3200 is similar, although not the same as, acoustic lens 2400.

In FIG. 32, a perspective view of acoustic lens 3200 is shown with an orientation including the top 3202 of acoustic lens 3200. As such, the bottom 3204 of acoustic lens 3200 is depicted in the later described FIG. 34.

Acoustic lens 3200 may include an orifice or an aperture 3208 located approximately or near the center of member 3210. Member 3210 includes a first side 3212 and a second side 3214, where the second side is visible in the bottom view of FIG. 34. The first side 3212 unites with the second side 3214 to form an exterior edge 3216. In addition, member 3210 is conformed to produce a rim 3206. In FIG. 32, rim 3206 may include a uniform distance from the center of the orifice 3208. However, depending upon the speaker to which the acoustic lens 3200 is to be mated, the rim 3206 may be adapted to have other forms including but not limited to an elliptical form.

The first side 3212 may also unite with the second side 3214 to form the interior lip 3216, which defines the outer boundary of orifice 3208. The interior lip 3216 may include a beveled edge, a tapered edge, a straight edge, a rounded edge, or a combination thereof.

Member 3210 may include an exterior edge 3216 that in combination with rim 3206 forms a mounting feature 3215. In FIG. 33, the mounting feature 3213 may include a foot feature or mounting surface 3316.

In FIG. 32, member 3210 may further include a supplementary aperture 3230, which are similar to the apertures 2422, 2424, 2426, 2428, and 2430, as in FIG. 24.

The first surface 3212 and the second surface 3214 may further unite to form supplementary apertures 3230, 3232, 3234, 3236, and 3238. As an example, the first surface 3212 and second 3214 may unite to form lip 3244. Lip 3244 may define the outer triangular-like perimeter of supplementary aperture 3232.

As another example, the triangular aperture 3230 may include a vertex 3240 oriented towards aperture 3208. Vertex 3240 may be rounded or curved. The triangular form of supplementary aperture 3230 may also include a base or first side 3240 oriented to be substantially parallel to the exterior edge 3216. As another example, the lip 3244 of supplementary aperture 3236 may further include a second side 3246 and a third side 3448. The second side 3246 and the third side 3248 may connect the base or first side 3242 to the vertex 3240.

Member 3210 may include a central portion 3250. The central portion 3250 may encompass the aperture 3208 in the proximate center 3209 of member 3210. The central portion 3250 may further include one or more of the supplementary apertures 3230, 3232, 3234, 3236, and 3248. The central portion 3250 may be slightly elevated above an outer portion or ring 3254.

In FIG. 32, with reference to supplementary aperture 3234, central portion 3250 may include a setback portion 3254. The setback portion 3254 separates each of the supplementary apertures 3230, 3232, 3234, 3236, and 3248 from the centrally located aperture 3208.

As an additional example, in FIGS. 32 and 33, the first surface 3212 may unite with the second surface 3214 to form lip 3260 of supplemental aperture 3230. The lip 3260 may define boundary of the supplementary aperture 3230. The supplemental boundary may include a base or first side 3264, a second side 3266 and a third side 3268. The second side 3266 and third side 3268 may unite to form a vertex 3262. The second side 3266 and third side 3268 may also unite with first side or base 3264 to form a triangular shape. The first side 3264, the second side 3266, and the third side 3268 may each have a different length. Alternatively, the second side 3266 and the third side 3268 may have identical lengths.

FIGS. 33 and 34 depict a top view and cross-sectional view of acoustic lens 3200. The dashed-line A depicts the location of the cross-sectional view of acoustic lens 3200. The dashed-lines B and D show the outer perimeters of the orifice 3208 as it aligns with the cross-sectional view. In the cross-sectional view of FIG. 33, the element 3256, that separates orifice 3208 and supplementary aperture 3234 may be seen. In addition, dashed-line C, when taken with dashed-line A, shows the approximate center position 3209 of the aperture 3208, as well and the approximate location of the center location in the cross-sectional view.

In addition, FIGS. 33 and 34 depict the second side 3214 and the mounting feature 3215. The mounting feature 3213 includes a foot feature 3260, upon which the acoustic lens 3200 may rest upon a speaker assembly 3212. The mounting feature 3213 and foot feature 3316 are depicted as a ring-like feature to offset the second surface 3214 from the mounting surface.

Figure 35:
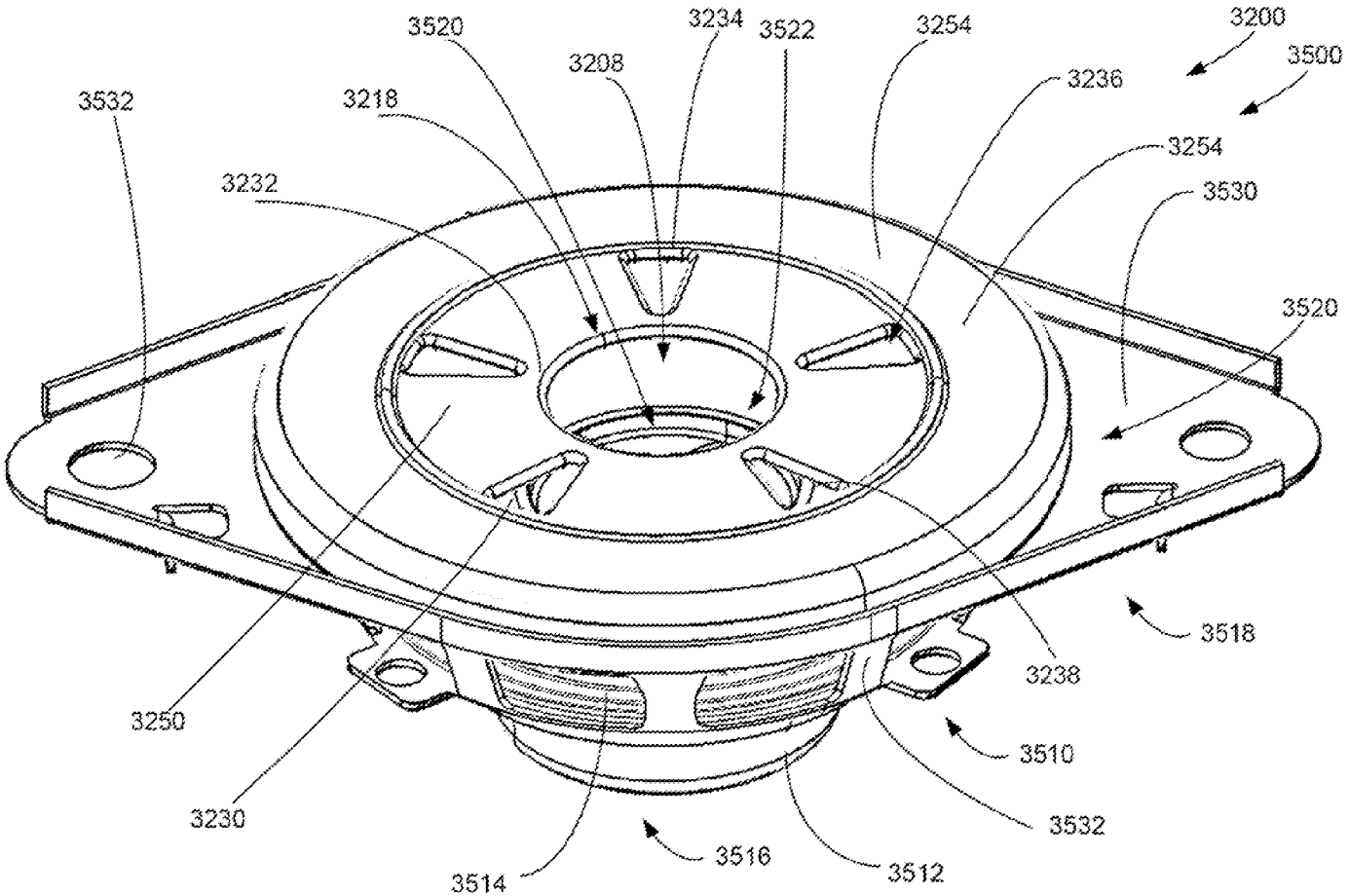
FIG. 35 depicts a perspective view of one example of an assembly including an acoustic lens similar to the acoustic lens depicted in FIGS. 32, 33, and 34.

FIG. 35 depicts a perspective view of an assembly 3500. Assembly 3500 may include an acoustic lens 3200 coupled to speaker 3510. The speaker 3510 may include a motor pot assembly 3512 and a diaphragm assembly 3514. In addition, the speaker 3510 may include a basket/bracket assembly 3530 to facilitate mounting of the speaker assembly 3500. Bracket 3530 may further include one or more mounting holes 3532, through which various fasteners may be passed to secure the speaker assembly 3500 in a final installation.

The speaker 3510 and the acoustic lens 3200 are joined by a substantially airtight seal 3520. The substantially airtight seal may be created by the use of various adhesives to glue the foot 3316 of acoustic lens 3200 to bracket 3530. Alternatively, clip-like features or other fasteners (not shown) may be used in combination with a gasket (not shown) inserted between bracket 3530 and acoustic lens 3200 to create the substantially airtight seal 3530. The gasket may include ferromagnetic or thermally conductive material.

A magnet structure of the loudspeaker 3510 may include a plurality of magnets (not shown), contained within a motor pot assembly 3512. The acoustic lens 3200 may be composed of ferromagnetic material. Accordingly, magnetic flux generated by the plurality of magnets may be collected by the acoustic lens, which acts at least in part as a magnetic flux collector.

Figure 54:
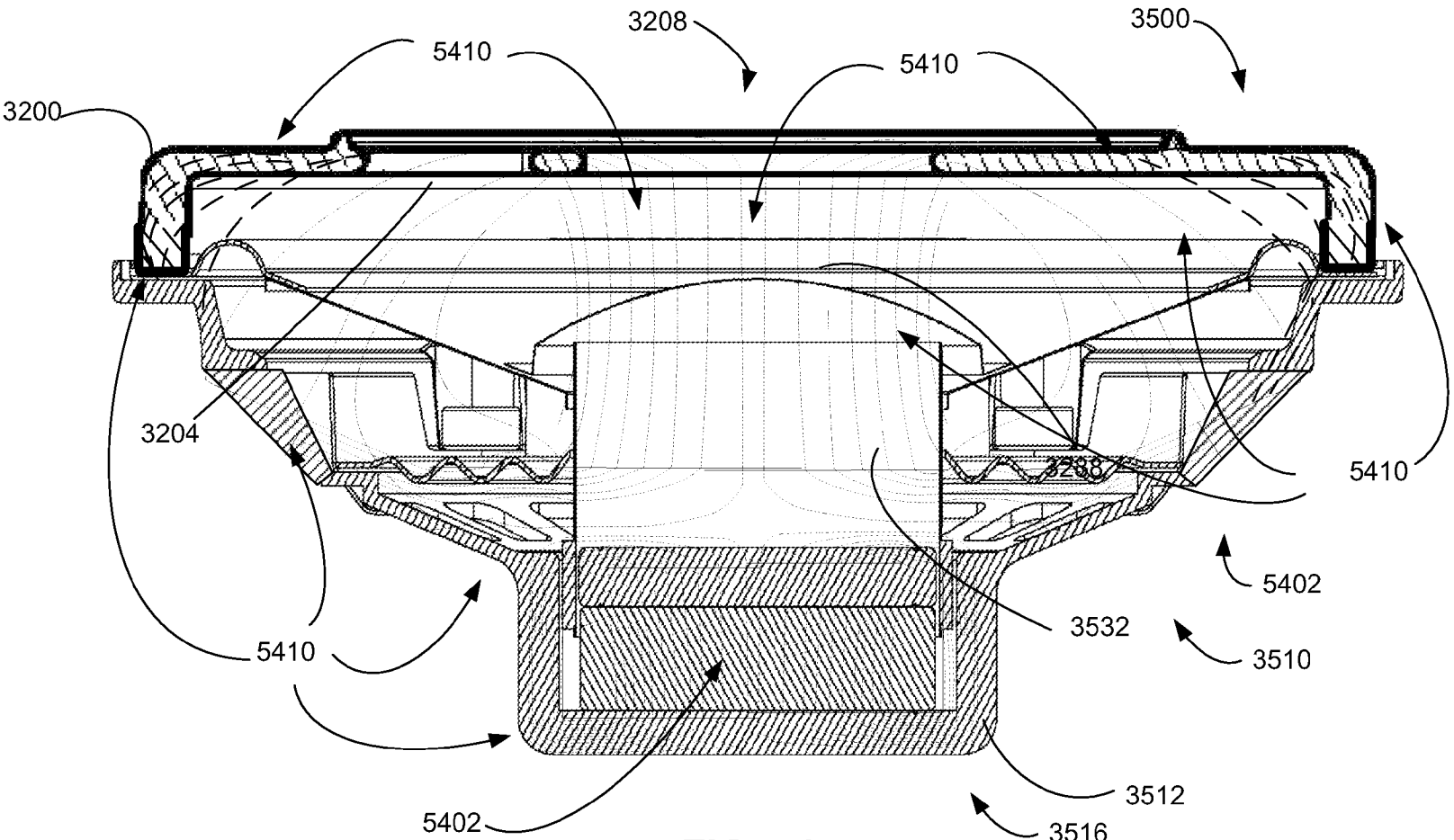
FIG. 54 depicts an example of a cross-sectional view of the assembly of FIG. 35 and return flux lines passing through an example magnetically conductive acoustic lens.

FIG. 54 depicts an example of a cross-sectional view of the assembly of FIG. 35. In in FIG. 54, return flux lines 5410 passing through an example ferromagnetic acoustic lens 3200. The distance that the magnetic flux lines may travel are reduced by collection on the top surface 3202 and bottom surface 3204. Alternatively or in addition, flux lines may be conducted through member 3210 of acoustic lens 3200. The ferromagnetic acoustic lens, in combination with the bracket 3530 and speaker frame 3532, may provide a direct, low reluctance, and controlled path for magnetic energy to be channeled into an air gap included in the loudspeaker 3510.

The acoustic lens 3200 may be constructed of a ferromagnetic material. Alternatively, the acoustic lens 3200 may be coated or painted with ferromagnetic material. The acoustic lens 3200 may be coupled with the magnet housing of the loudspeaker.

In FIG. 54, the loudspeaker 3510 may include multiple magnets disposed (not shown) in a predetermined configuration in the magnet housing 3516, which houses one or more magnets 5402. The ferromagnetic acoustic lens 3200 may attract and focus magnetic energy back into the magnet housing and into the air gap. The ferromagnetic acoustic lens 3200 may be further coupled with a magnetic flux collector 5402 integrated into the magnet housing 3516, into a frame of the loudspeaker 3532, flux collector 5402, and adjoining the magnet housing 3516, or a combination of the magnet housing and the frame 3532.

In FIG. 54, magnetic flux lines 5410 are substantially contained within the speaker apparatus 3500. At least some portion of the magnetic flux lines 5410 generated by magnet 5402 are collected by the magnetically conductive ac ferromagnetic acoustic lens 3200 and returned to the magnet housing 3516 via a combination of the frame of the loudspeaker 3532 and/or magnetic flux collector 5402. In some examples, the magnetic flux collector 5410 and frame 3532 may be combined into a single piece.

The loudspeaker 3510 may be manufactured by separately constructing a first assembly and a second assembly. The first assembly and the second assembly may each be a portion of the loudspeaker 3510. The first assembly may include a magnet housing 3516 and a magnetic flux collector 5410. The second assembly may include a support frame and a cone of the loudspeaker. The first assembly and second assembly may be detachably coupled to form the loudspeaker. Accordingly, the first assembly or second assembly may be replaceable parts. Thus, either the first assembly or the second assembly may be replaced with a different first assembly or second assembly by detaching the first and second assemblies, replacing one of the first assembly or second assembly, and reusing the other of the first assembly or the second assembly to form a loudspeaker.

Figure 36:
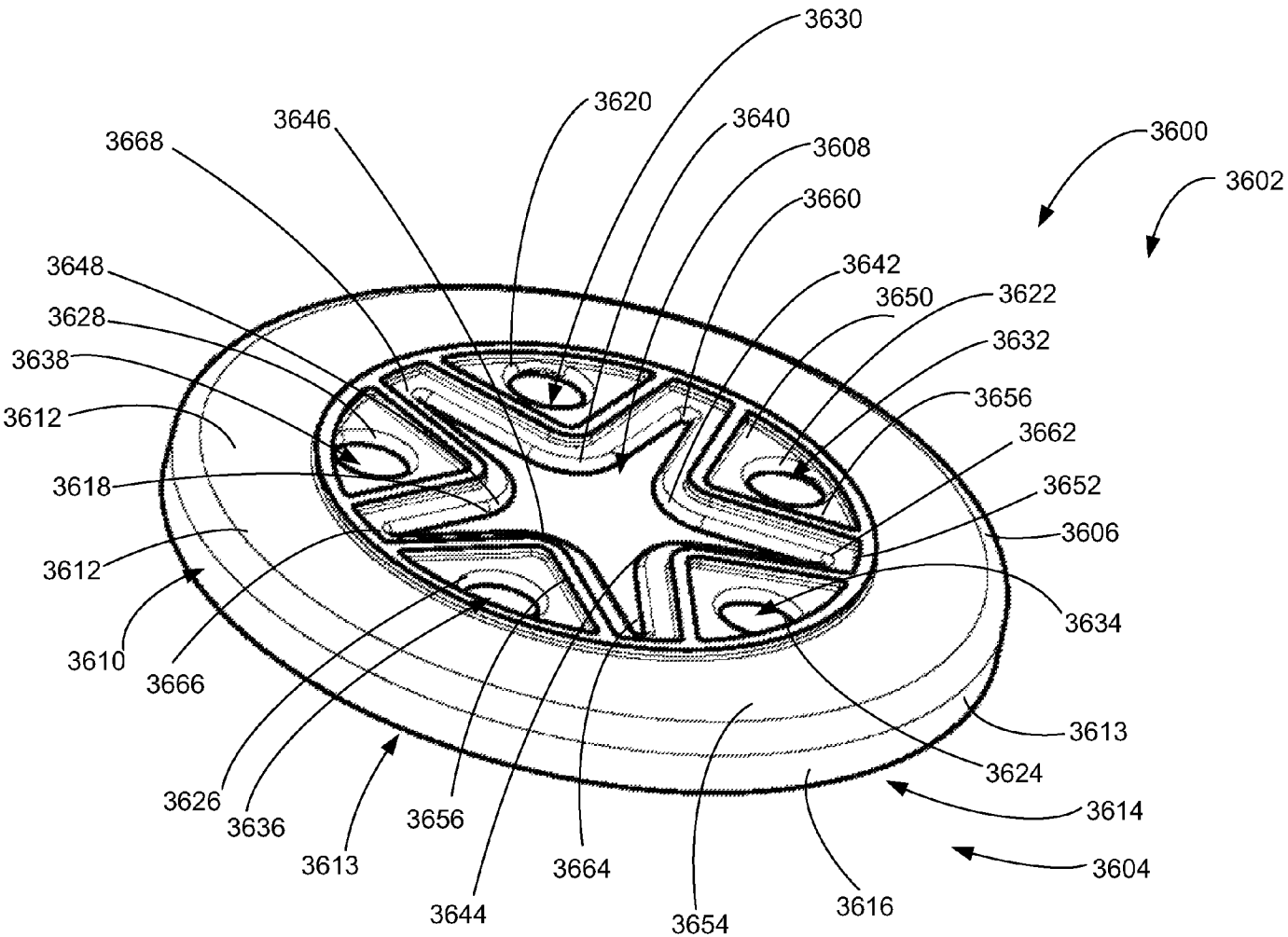
FIG. 36 depicts a perspective view of an example of an acoustic lens.
Figure 37:
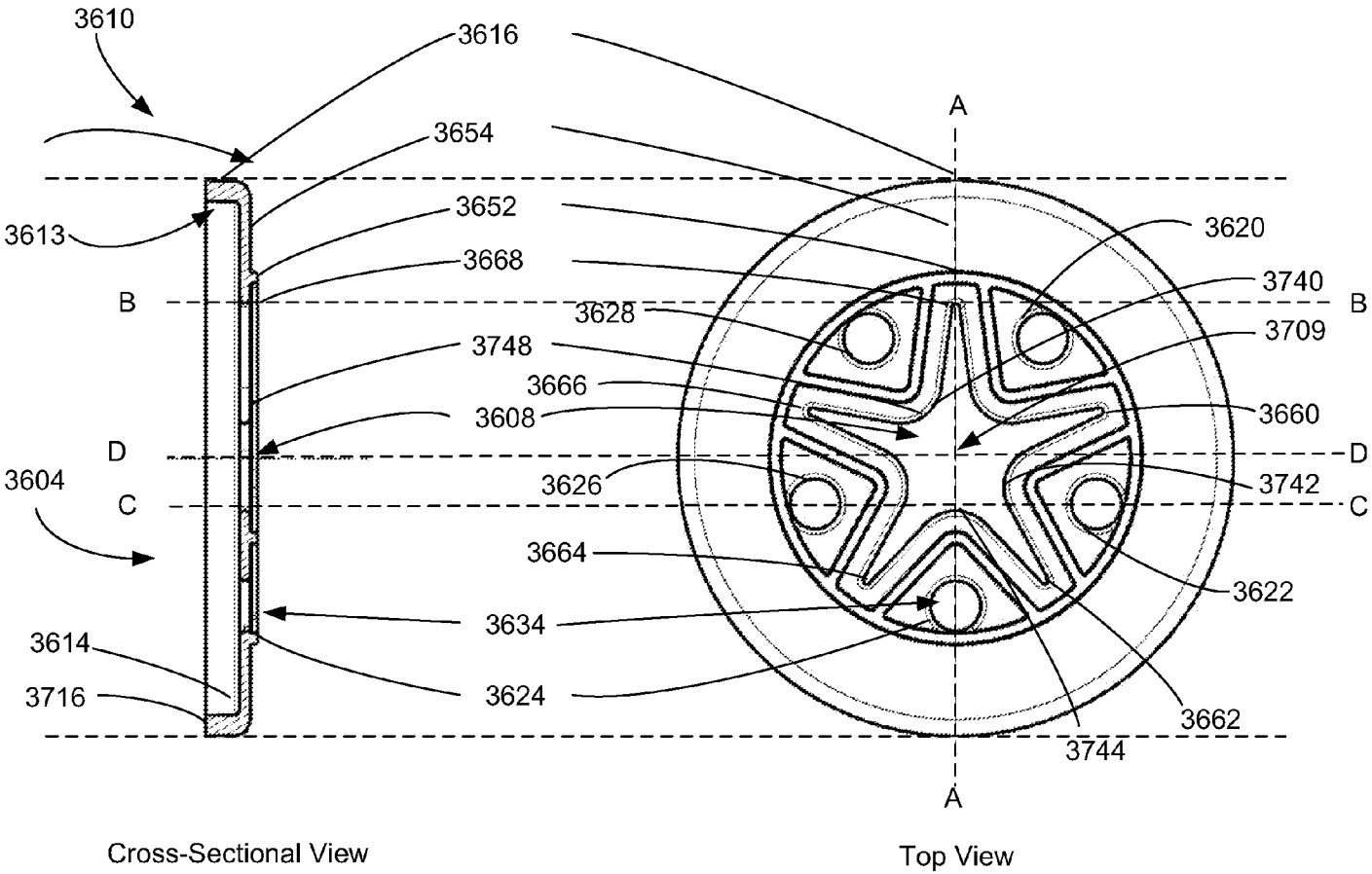
FIG. 37 further depicts a top view and a cross-sectional view of an example of an acoustic lens similar to the acoustic lens depicted in FIG. 36.
Figure 38:
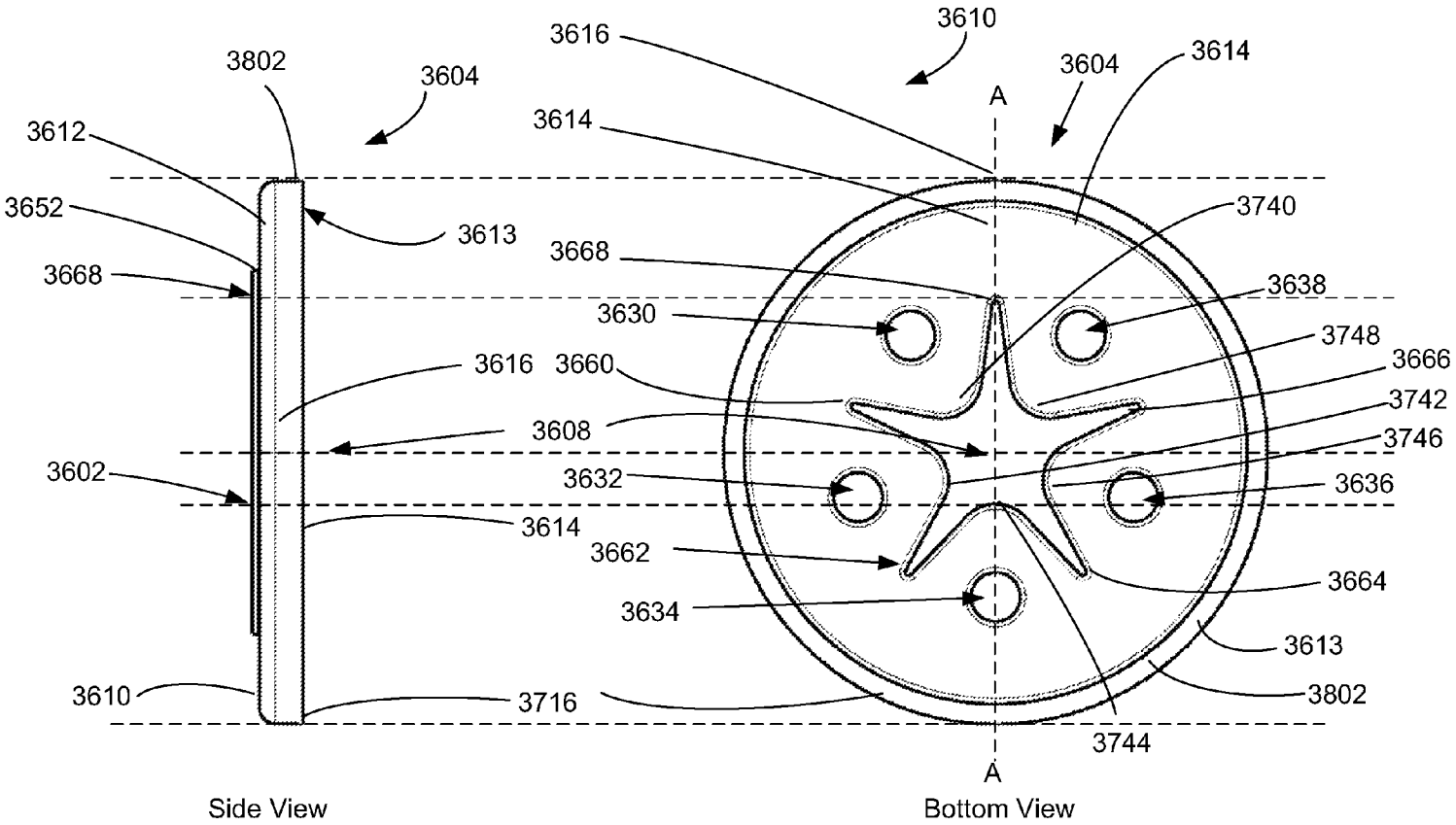
FIG. 38 depicts a side view and bottom view of an example of an acoustic lens similar to the acoustic lenses depicted in FIGS. 36 and 37.

FIGS. 36, 37, and 38 depict a acoustic lens 3600, which is similar to the acoustic lenses in FIGS. 21, 25, and 27. Acoustic lens 3600 includes a top 3602. In addition, acoustic lens 3600 includes a bottom 3604 and a plurality of orifices or apertures located in and around a center portion. Member 3610 includes a first surface 3612 and second surface 3614. First surface 3612 and second surface 3614 unite to form an internal lip 3618. Internal lip 3618 substantially defines the outline of an orifice 3608. Orifice 3608 is located approximately in the center of member 3610.

The first surface 3612 and the second surface 3614 may also unite to form a plurality of lips 3620, 3622, 3624, 3626, and 3628. Each of the lips 3620, 3622, 3624, 3626, and 3628 correspond to secondary apertures, orifices or vents, 3630, 3632, 3634, 3636, and 3638, respectively.

In addition, the interior lip 3620 may further define protrusions 3640, 3642, 3644, 3646, and 3648. The protrusions 3640, 3642, 3644, 3646, and 3648 may substantially lie within the same plane. Alternatively, similar to phase plug 100 of FIG. 1, the protrusion 3640, 3642, 3644, 3646, and 3648 may deflect outwardly. Also, the protrusion 3640, 3642, 3644, 3646, and 3648 may deflect inward.

FIG. 36, in combination with FIG. 37, further depicts a segment of the internal lip 3618 that corresponds to protrusion 3640, which defines an internal vertex 3740 of protrusion 3640. The protrusion 3640 may further include at least some portion of supplementary aperture 3630. Another segment of the interior lip 3618 further defines an edge of protrusion 3642. The interior lip 3618 may include a plurality of local paiapsii and local apaspsii relative to the center of the aperture 3608. As an example, the interior lip 3618 may include an interior vertex or local apoapsi of 3742.

Protrusion 3642 includes at least some portion of supplementary aperture 3632. Another segment of internal lip 3618 may define an edge of protrusion 3644. The edge of protrusion 3644 may also include an interior vertex 3744. The protrusion 3644 may further include some portion of aperture 3634. Another segment of interior lip 3618 may define an edge of protrusion 3646, which includes an interior vertex 3746. Protrusion 3646 may further include supplementary aperture 3636. Another segment of internal lip 3618 defines an edge of protrusion 3638, which includes interior vertex 3748. Protrusion 3648 may further include at least a portion of supplementary aperture 3638.

In FIGS. 37 and 38, the dashed-line A and dashed-line D cross at an approximate center position 3709 of orifice 3608. FIG. 37 further depicts a cross-sectional view of acoustic lens 3600. The orifice 3608 may be centrally located within member 3610. In addition, the interior lip 3630, in combination with the protrusions 3640, 3642, 3644, 3646, and 3648, may form a star-like, estoile, or etoile shaped orifice 3608.

In FIGS. 37 and 38, the interior edge of protrusion 3640 meets the interior edge of protrusion 3642 to form an outer vertex or local paiapsii 3660 of orifice 3608. The interior edge of protrusion 3642 may also meet the interior edge of protrusion 3644 to form the outer vertex or local paiapsii 3662 of orifice 3608. The interior edge of protrusion 3644 may also meet the interior edge of protrusion 3646 to form the outer vertex or local paiapsii 3664 of orifice 3608. The interior edge of protrusion 3646 may meet the interior edge of protrusion 3648 to form the outer vertex or local paiapsii 3666 of orifice 3608. The interior edge of protrusion 3648 may meet the interior edge of protrusion 3640 to form the outer vertex or local paiapsii 3668.

The distance between the approximate center 3609 of orifice 3608 to any one of the outer vertices or local paiapsii 3660, 3662, 3664, 3666, and 3668, may be adjusted to further refine the overall directivity or frequency response of the acoustic lens 3600. The distance between the approximate center 3609 of aperture 3608 to any one of the outer vertices or local paiapsii 3660, 3662, 3664, 3666, and 3668 may be uniform or identical. Alternatively, the distance of at least one of the outer vertices or local paiapsii 3660, 3662, 3664, 3666, and 3668 may be different from the distance to another of the outer verticies 3660, 3662, 3664, 3666, and 3668.

Similarly, the distance between the approximate center of the orifice 3608 to the interior vertices or apoapsiis 3740, 3742, 3744, 3746, and 3748, may also be adjusted to further refine the overall directivity or frequency response of the acoustic lens 3600. In addition, the relative distances to each individual interior vertex or outer vertex may be independently adjusted to minimize respective nulls in the frequency response of the acoustic lens. In doing so, an overall frequency response within a desired band of frequencies may be optimized In addition, the shape, size, and relative position of the supplementary orifice 3630, 3632, 3634, 3636, and 3638 may be adjusted to optimize insertion loss and distortion related to the movement of air through the acoustic lens. Although not depicted here, as described in other examples, the overall shape and surface area of each of the supplementary apertures may be the same or different and may have independent sizes depending upon the desired overall frequency response, directivity, insertion loss, and distortion.

In FIG. 38, the bottom view 3604 and side view of acoustic lens 3600. As also shown in FIG. 37, the side view depicts a ridge 3652 that may rise to a central portion 3650 of member 3610. The central portion 3650 may include stiffing portions 3656, as in FIG. 36.

Figure 39:
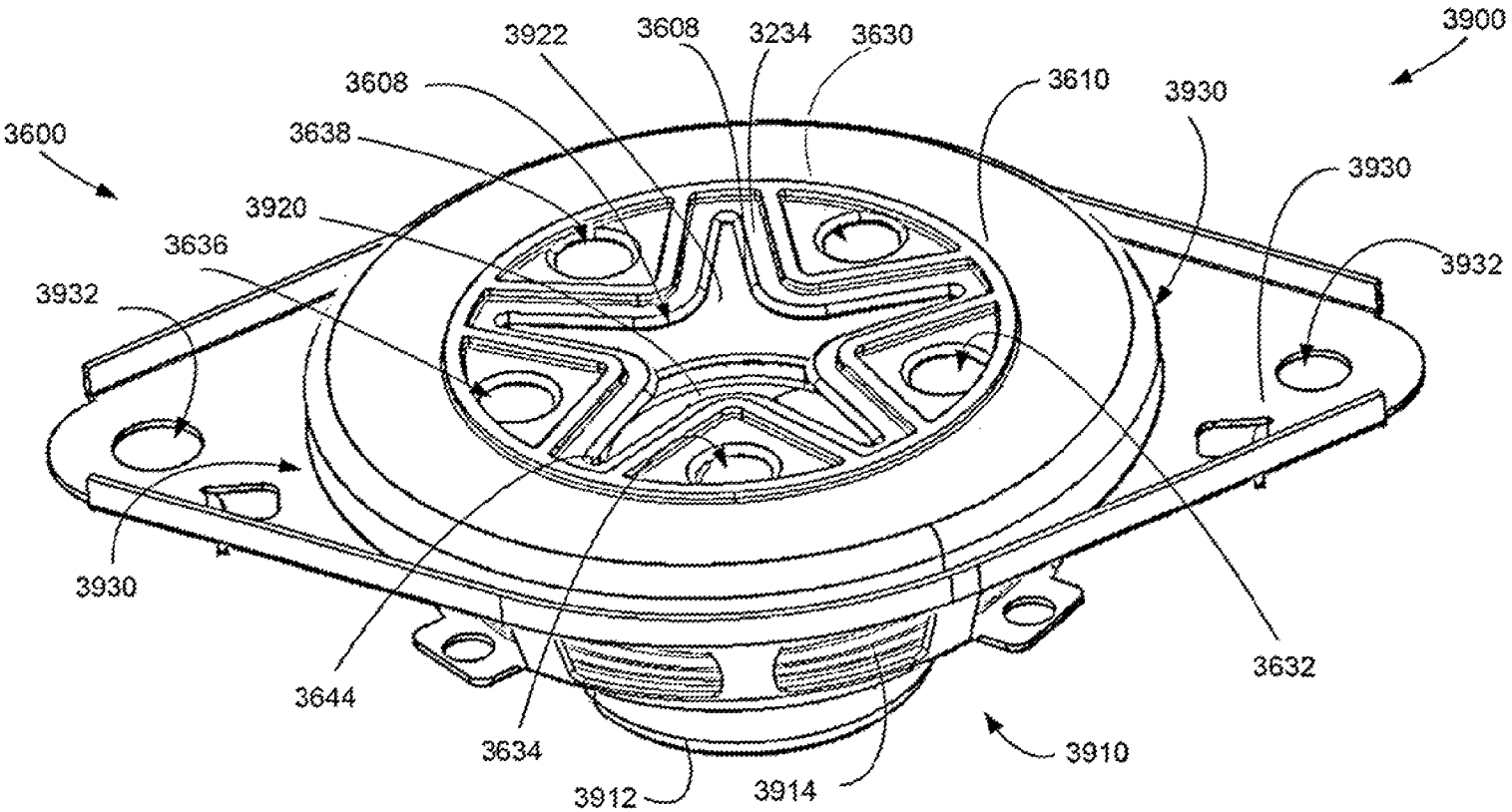
FIG. 39 depicts a perspective view of an assembly including an acoustic lens, an example of an acoustic lens, as shown in FIGS. 36, 37, and 38, mated with a speaker.

FIG. 39 depicts a perspective view of an assembly 3900. Assembly 3900 may include an acoustic lens 3600 coupled to speaker 3910. The speaker 390 may include a motor pot assembly 3912 and a diaphragm assembly 3914. In addition, the speaker 3910 may include a basket/bracket assembly 3930 to facilitate mounting of the speaker assembly 3900. Bracket 0530 may further include one or more mounting holes 3532, through which various fasteners may be passed to secure the speaker assembly 3500 in a final installation.

The speaker 3510 and the acoustic lens 3200 are joined by a substantially airtight seal 3520. The substantially airtight seal may be created by the use of various adhesives to glue the foot 3316 of acoustic lens 3200 to bracket 3530. Alternatively, clip-like features or other fasteners (not shown) may be used in combination with a gasket (not shown) inserted between bracket 3530 and acoustic lens 3200 to create the substantially airtight seal 3530. The gasket may include ferromagnetic or thermally conductive material.

Figure 44:
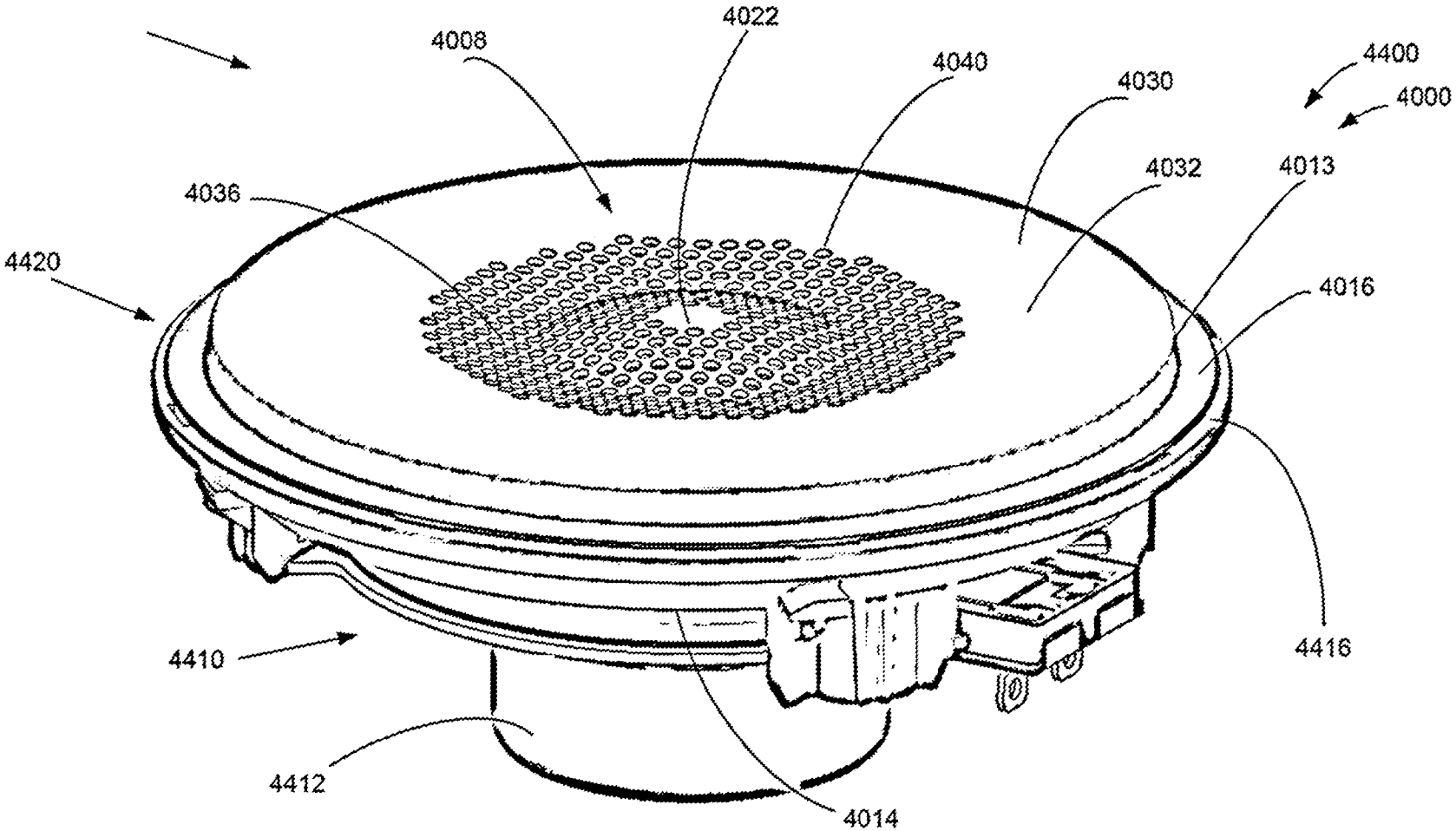
FIG. 44 depicts a perspective view of an assembly including an example of an acoustic lens, in FIGS. 40, 41, 42, and 43, mated with an example of a speaker.
Figure 45:
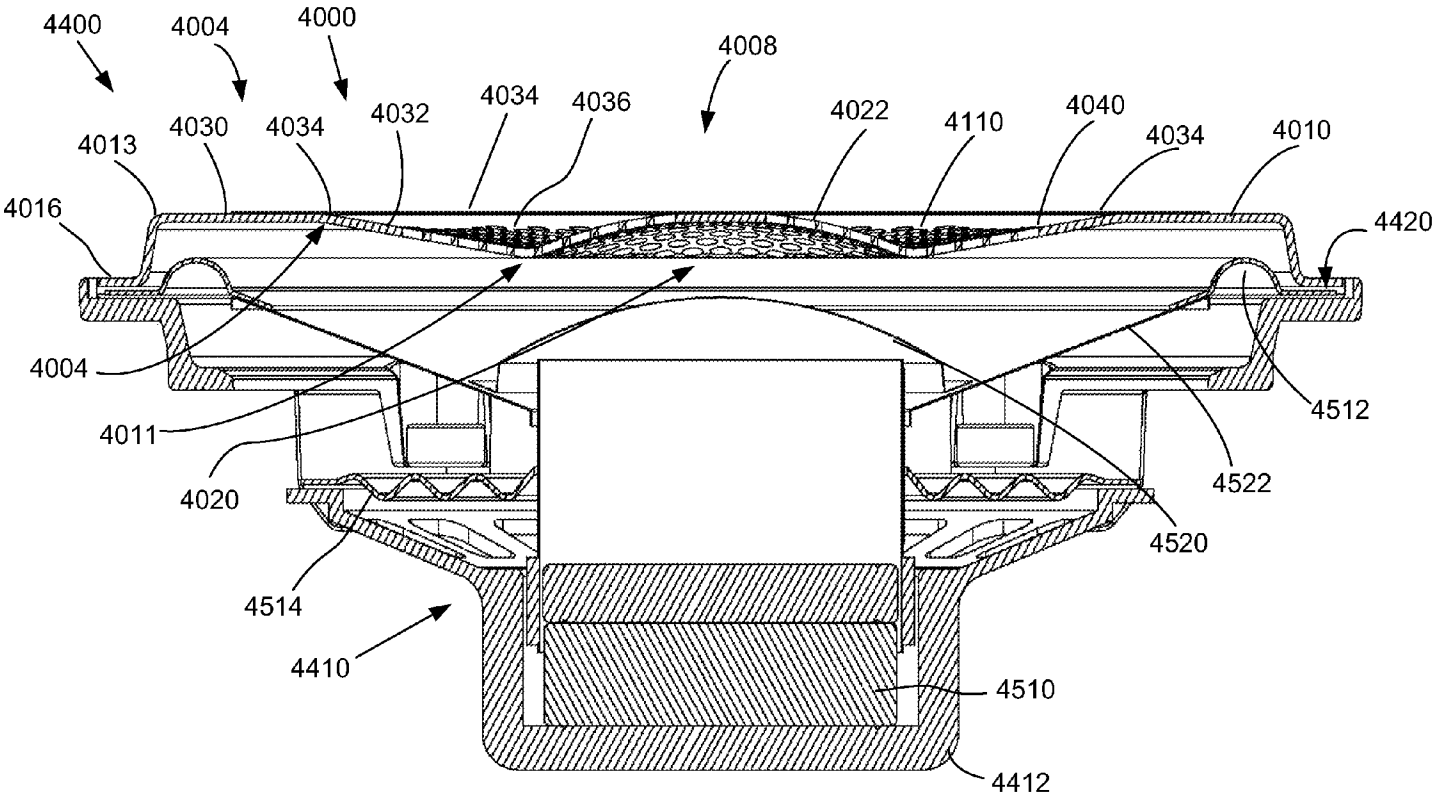
FIG. 45 depicts a cross-sectional view of an example of the assembly in FIG. 44.

FIGS. 40-43 depict acoustic lens 4000. FIGS. 44 and 45 depict the installation of acoustic lens 4000 with a speaker in a speaker assembly 4400.

Figure 40:
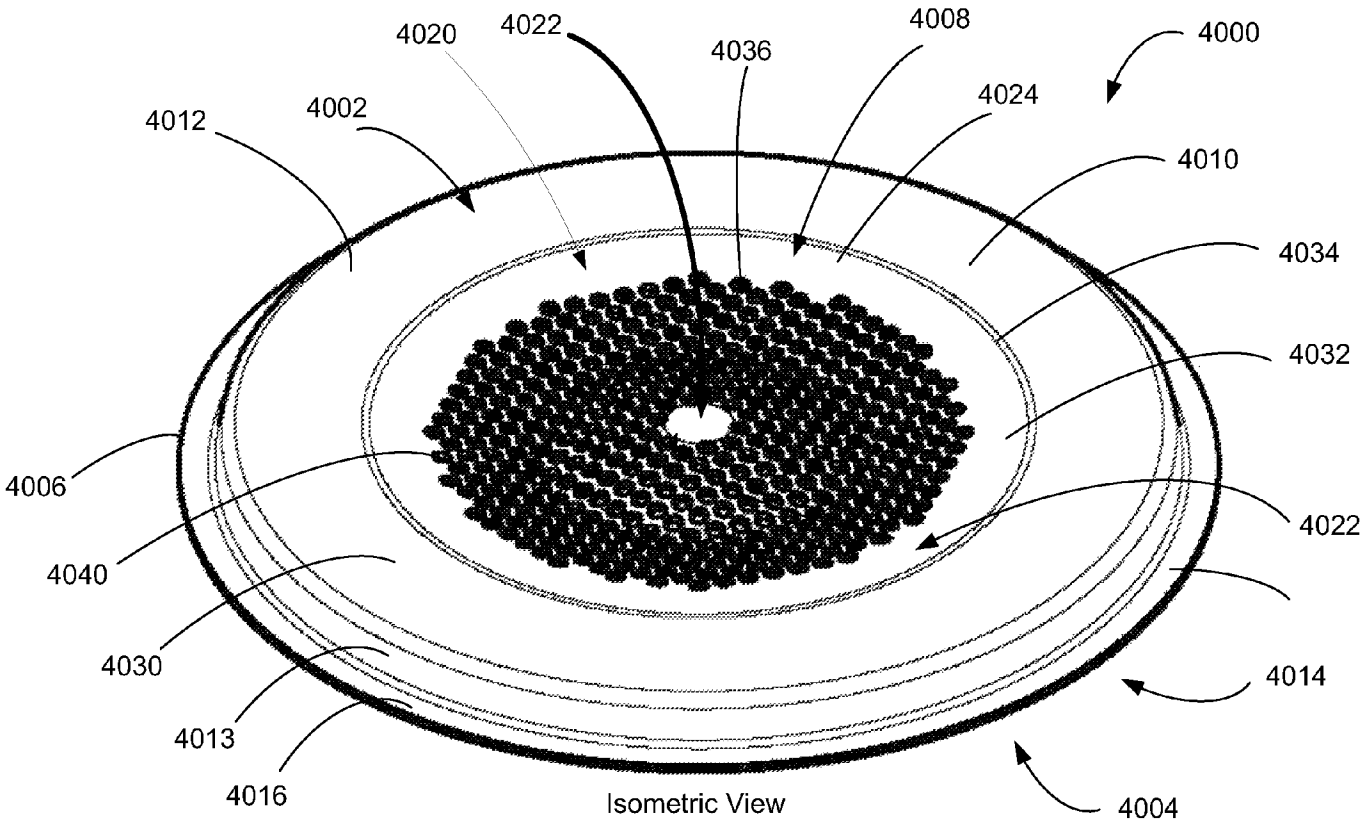
FIG. 40 depicts a perspective view of an example of an acoustic lens.
Figure 42:
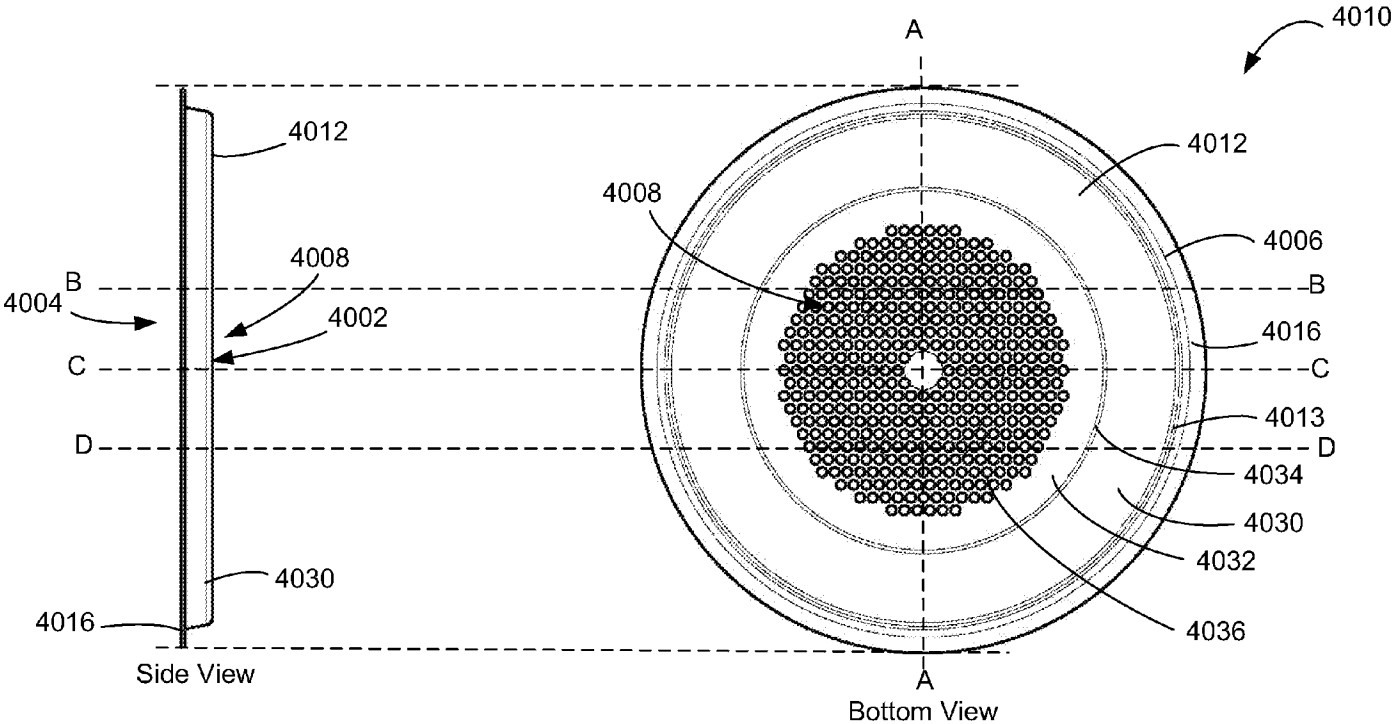
FIG. 42 depicts a bottom view and a side view of an example of the acoustic lens, as shown in FIGS. 40 and 41.
Figure 43:
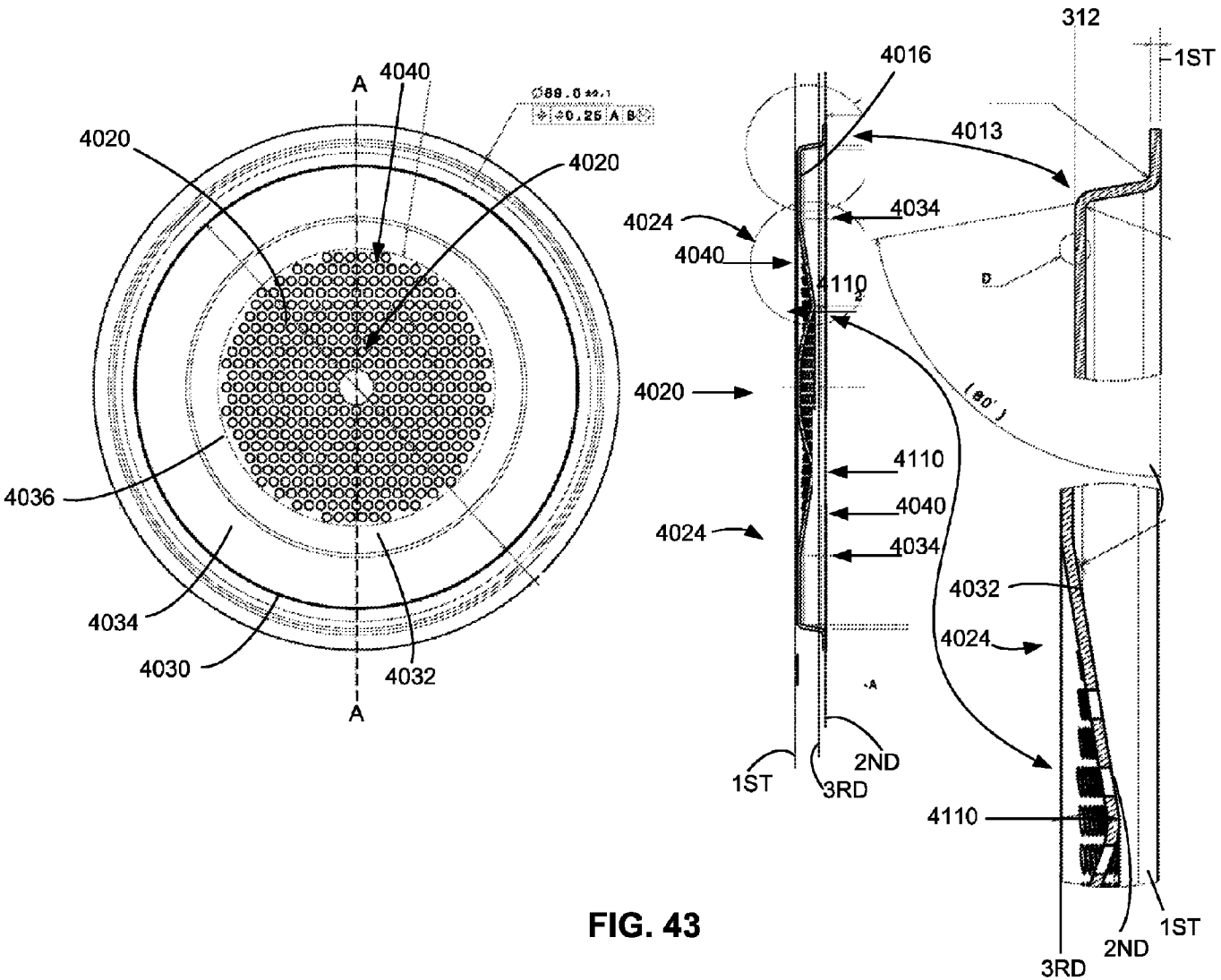
FIG. 43 further depicts a top view and a cross-sectional view of an example of the acoustic lens, as shown in FIGS. 40, 41, and 42.

In FIG. 40, acoustic lens 4000 includes a top side 4002. The acoustic lens 4000 may include a centrally located aperture 4008. The centrally located aperture 4008 includes a plurality of small perforations to permit air to pass through the acoustic lens 4000. In FIG. 42, the acoustic lens 4000 further includes a bottom side 4004. The acoustic lens 4000 further includes an outer perimeter defined by an exterior edge 4006.

The acoustic lens 4000 includes member 4010. In FIG. 42, member 4010 includes a first surface 4012 and a second surface 4014. The first surface 4012 unites with the second surface 4014 to form the exterior perimeter edge 4006. In addition, the exterior edge 4006 is conformed to include a mounting feature 4013. Mounting feature 4013 includes a standoff portion as well as a foot portion 4016. The foot portion 4016 is conformed to mate with a speaker assembly, as will be discussed relative to FIGS. 40 and 45.

FIG. 40 further depicts that the perforated aperture 4008 includes a centrally located dome 4020. Dome 4020 includes a perforated portion and an imperforated portion 4022 located at the apex of the dome 4020. The imperforated portion 4022 is solid and formed to provide a glue point for a scrim.

Member 4010 further includes a conical section 4024. The conical section 4024 connects with the dome 4020 to form a union or fold 4034 in the first surface 4012. The contouring of the member 4010 may provide for structural stiffness. Member 4010 further includes an axisymmetric solid portion that surrounds both the conical section 4024 and the dome 4020. The conical section 4024 unites with the solid portion 4030 to form a union 4034. In addition, the conical section 4024 may be divided into a imperforated or solid portion 4032 and a perforated portion 4036. The outer border of the perforated portion 4040 may be arranged in various geometric shapes, as described relative to other phase plugs and acoustic lenses.

Figure 41:
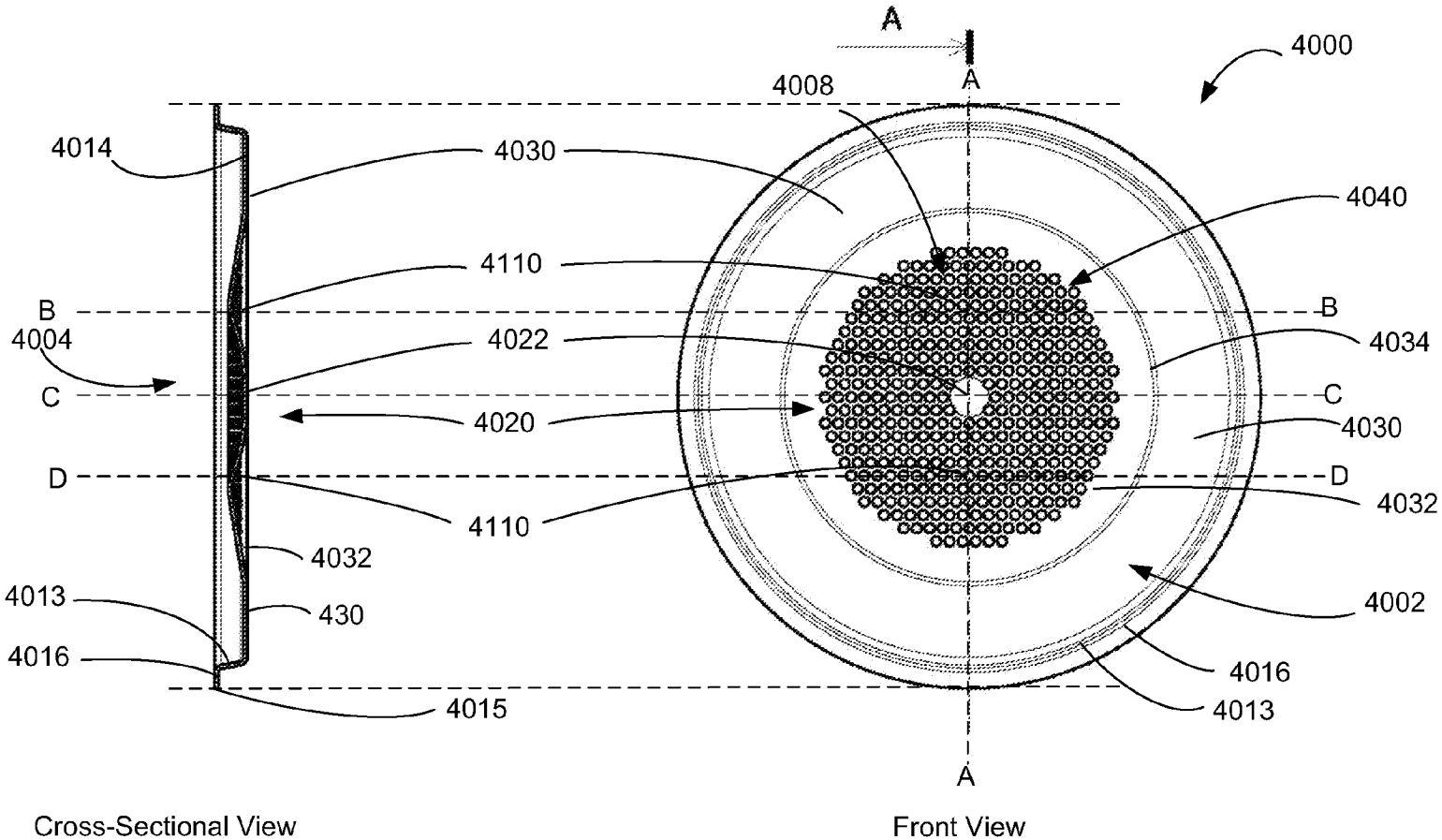
FIG. 41 depicts a top view and a cross-sectional view of an example of the acoustic lens, as shown in FIG. 40.

FIG. 41 depicts a top view and cross-sectional view of acoustic lens 4000. Dashed-line B and dashed lined D indicate a position relative to dashed-line A of the concentric fold created by the union of dome 4020 and conic section 4024. The apex of the dome is located at the intersection of dashed-line A and dashed-line C.

In the case where the acoustic lens 4000 is made of a metal, such as steel, the combination of the concentric folds with the dome feature 4020 provides mechanical strength to stiffen the acoustic lens 4000. The mechanical stiffening may be adjusted to reduce the vibration of the perforated aperture 4008 during sound reproduction. In the cross-sectional view of FIG. 41, the mounting feature 4013 may include a concentric foot 4016. The mounting feature 4013 may include an edge 4015. The edge 4015 may define the outer perimeter or exterior edge 4006.

FIG. 42 depicts the bottom side 4004 of the acoustic lens 4200. Similar to FIG. 41, the dashed-lines B and D border the outer perimeters of dome 4020. In addition, similar to FIG. 41, the dashed-line C passes through the center point of acoustic lens 4000. However, the apex 4022 of dome 4020 may be located either above, below, or near the first plane depending upon the desired stiffness of the perforated aperture 4020. Likewise, the relative location of the fold 4110 may be adjusted with respect to the second plane to provide appropriate stiffening of the effective aperture 4008

FIG. 44 depicts speaker assembly 4400. Speaker assembly 4400 may include acoustic lens 4000 and speaker 4410. In FIG. 45, speaker 4410 may include a speaker pot 4412, which holds a magnet 4510. In addition, the speaker 4410 may further include an exterior shell 4014 and a mounting ring 4416. In the assembly 4400, the acoustic lens 4000 is united with the speaker 4410 to form a substantially air-tight seal at 4420. As previously described, the air-tight seal 4420 may be obtained by the use of an adhesive or a glue. Alternatively, a gasket (not shown) may be inserted between the speaker 4410 and acoustic lens 4000. Additional mounting hardware may be used to hold acoustic lens 4000 in place relative to speaker 4410 to create the substantially air-tight seal 4420.

FIG. 45 depicts a cross-sectional view of the assembly shown in FIG. 44. Speaker 4410 includes a magnet 4510, which resides in motor pot 4412. Speaker 4410 further includes a dustcap 4520 coupled to diaphragm 4522. Diaphragm 4522 couples to surround 4512. Dome 4020 is downwardly convex relative to the dustcap 4520 and speaker 4410. The angle of the conic section 4024 may be adjusted to create a desired volume between the speaker and the bottom 4004 of acoustic lens 4000. In addition, the curvature of dome 4020 in the angle of the conic section 4024 may be adjusted to position the fold 4110 relative to the dustcap 4520 and diaphragm 4522.

Figure 46:
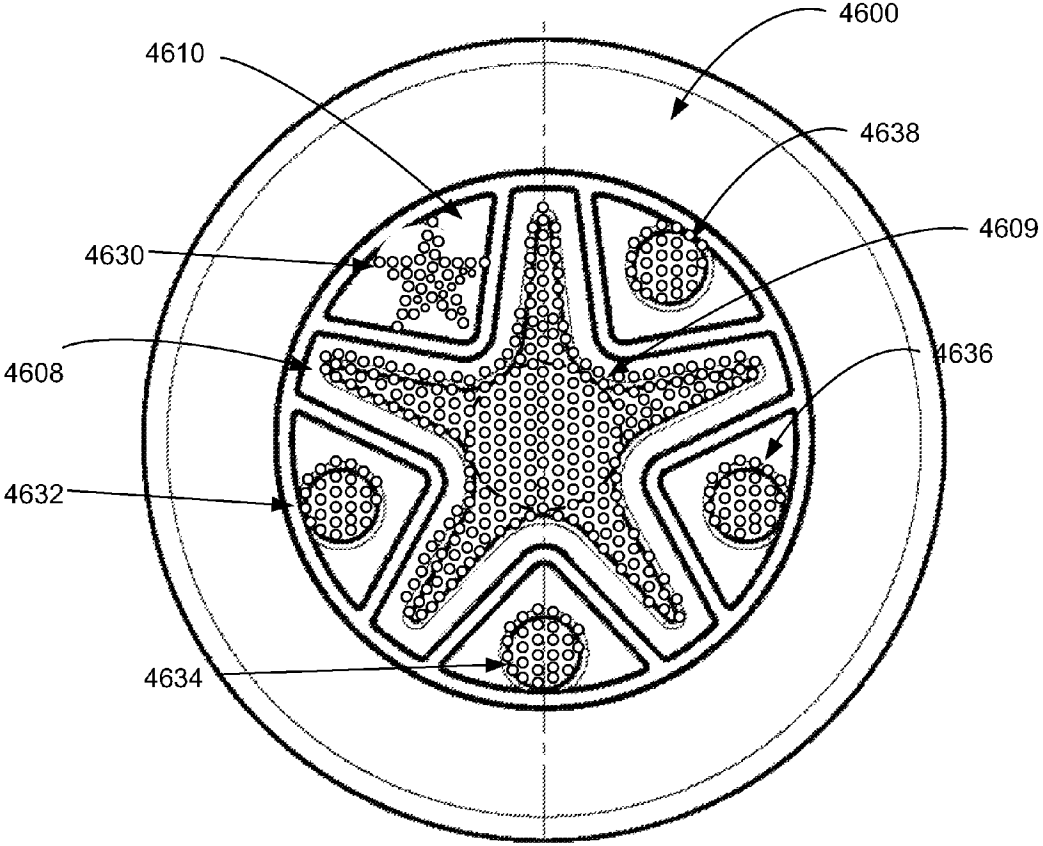
FIG. 46 depicts a top view of an example of the acoustic lens similar to the examples of the acoustic lenses depicted in FIGS. 36-45 and FIG. 27.

FIG. 46 depicts a top view of acoustic lens 4600. The acoustic lens 4600 is similar to the acoustic lens 3600, in FIGS. 36-39, and the acoustic lens 4000, in FIGS. 40-45.

The acoustic lens 4600 includes a plurality of perforations or holes that may be centrally located to form an effective aperture 4608 similar to the acoustic lens 4000. Similar to the acoustic lens 3600, the perforations are arranged to form an effective aperture 4008 that may include a star-like shape, an etoile shape, or an estoile shape. Similar to the acoustic lens 4000, the acoustic lens 4600 may include a dome shaped portion 4609 and conical portion 4610.

In addition, the acoustic lens 4600 may include additional perforations or holes arranged to form supplementary apertures, auxiliary apertures or vents 4630, 4632, 4634, 4636, and 4638.

The supplementary apertures, the auxiliary apertures, or vents 4630, 4632, 4634, 4636, and 4638 may be arranged to define a border, where the border further defines a shape. The border of each of the supplementary apertures, the auxiliary apertures, or vents 4630, 4632, 4634, 4636, and 4638 may define a triangular shape, a star-like shape, an etoile shape, an estoile shape, a circular shape, and/or an elliptical shape. As an example, supplemental aperture 4630 may include a star-like shape. Auxiliary apertures 4632, 4634, 4636, and 4638 may include a circular shape.

The perforations may have an identical form and cross-sectional area. Alternatively, the perforations may have different surface areas. As an example, the perforations that form supplemental aperture 4630 vary in cross-sectional area.

Figure 47:
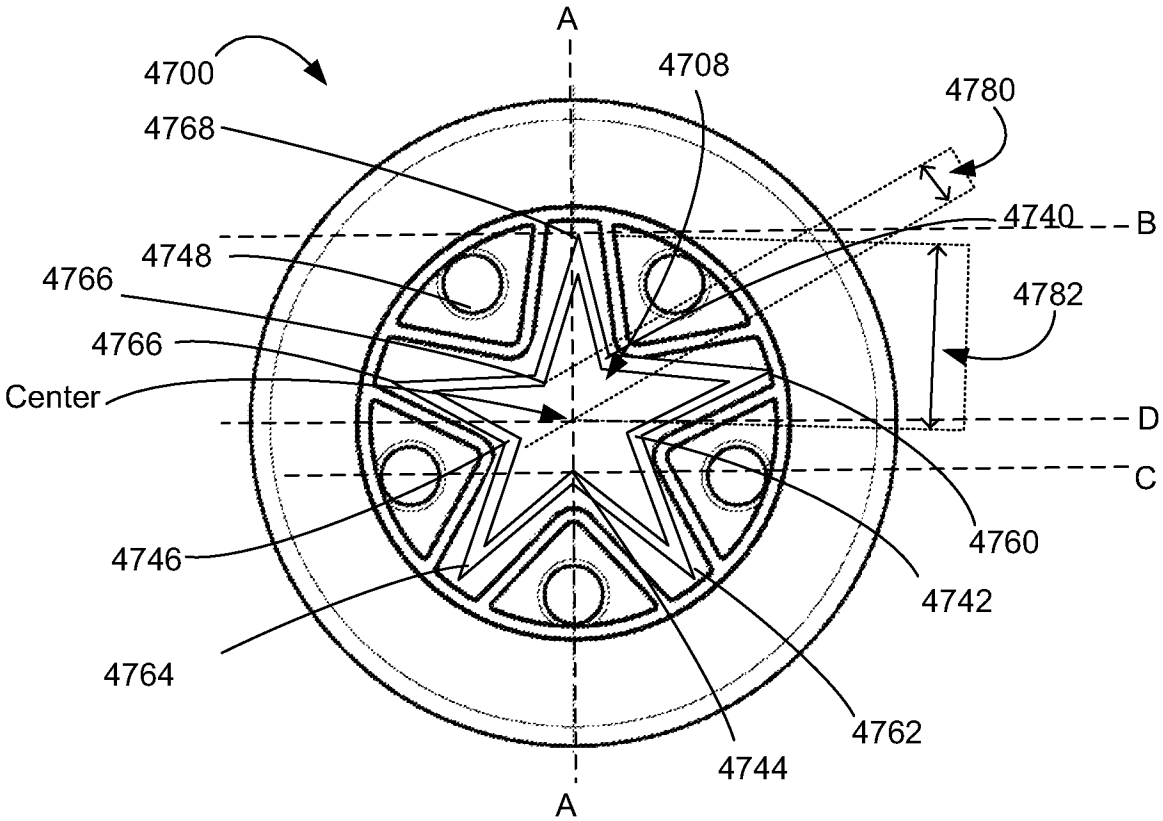
FIG. 47 depicts a top view of an example of the acoustic lens similar to the examples of the acoustic lenses depicted in FIGS. 36-39 and FIG. 27.

FIG. 47 depicts a top view of an acoustic lens 4700, which is similar to the acoustic lens 3600, in FIGS. 36-39, and the acoustic lens 4600, in FIG. 46. The acoustic lens 4700 may include an aperture 4708 that may include a star-like shape, an etoile-like shape, or an estoile-like shape. The acoustic lens 4700 includes an interior lip that defines the aperture 4608. The interior lip includes a plurality of outer vertices or local paiapsii 4760, 4762, 4764, 4766, and 4768 and interior vertices or local apoapsii 4740, 4742, 4744, 4746, and 4748.

Relative to an approximate center of the aperture 4708, the distance to each of the interior vertices or local paiapsii 4740, 4742, 4744, 4746, and 4748 may be different. For example, dashed lines 4782 indicates the distance between the center of aperture 4708 and local paiapsi 4768. Also, relative to an approximate center of the aperture 4708, the distance to each of the interior vertices or local apoapsiis 4740, 4742, 4744, 4746, and 4748 may be different. For example, dashed lines 4780 indicates the distance between the center of aperture 4708 and interior vertex or local apoapsii 4766.

In FIGS. 1-46, the phase plugs and acoustic lenses may include a primary aperture. For example, in FIG. 1, the aperture 140 may be a primary aperture having a primary aperture size. In FIGS. 20-31, acoustic lenses 2000, 2100, 2200, 2300, 2400, 2500, 2600, 2700, 2800, 2900, 3000, and 3100 may include respective primary apertures 2010, 2110, 2210, 2310, 2410, 2510, 2610, 2710, 2810, 2910, 3010 and 3110. In FIGS. 32-46, phase plugs, phase plugs, and acoustic lenses 3200, 3600, 4000, 4600, and 4700 may include primary apertures or effective apertures 3208, 3608, 4008, 4608, and 4708.

The primary aperture size of each of the phase plugs or acoustic lenses may be chosen to meet a given Directivity Index (DI) target within a desired frequency range as follows:

$$DI = 10\log\left[\frac{(ka)^2}{1 - J_1(2ka)/ka}\right] - 10\log[2]$$

where DI=Directivity Index (dB)

$$k = \frac{w}{c} = \frac{2\pi f}{c} = \frac{2\pi}{\lambda},$$

k=wave number ($m^{-1}$), f=frequency (Hz), c=speed of sound in air (m/s)=343, a=aperture radius (m), and $J_1$=Bessel Function of Order 1.

Figure 48:
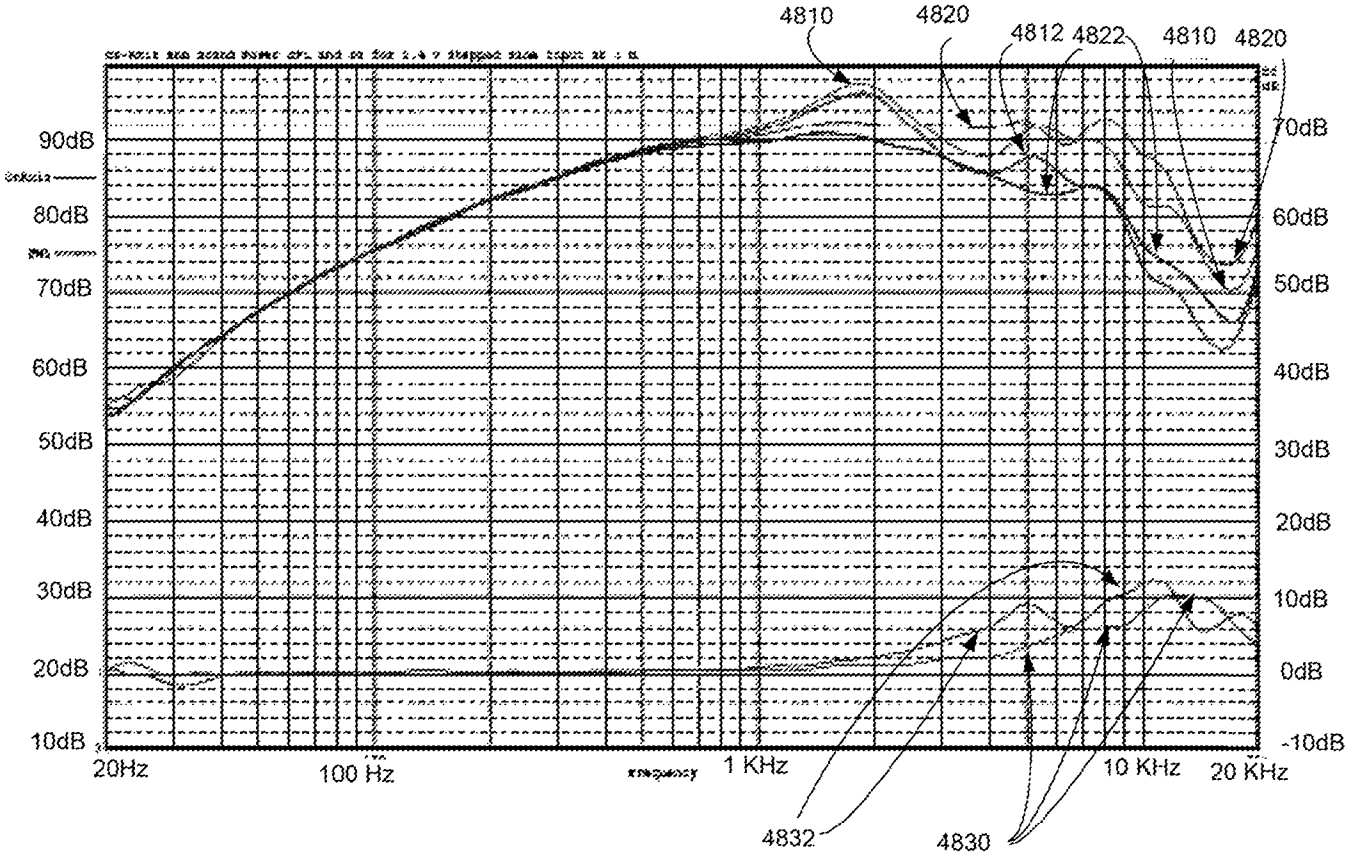
FIG. 48 depicts sound pressure level (SPL), a power watt level (PWL), and directivity index (DI) data from a speaker without an acoustic lens and the same speaker with an acoustic lens.

As a first example, an aperture radius of a=0.023 m, which is a diameter of about 47 mm, and which corresponds to an aperture surface area of about 1735 $mm^2$. Accordingly, at a frequency of 4000 Hz, the expected directivity index (DI) is approximately 2 dB. FIG. 48 depicts the performance of an acoustic lens optimized for use up to around 4000 Hz.

Line 4810 is the on-axis response of the speaker with an acoustic lens. Line 4812 is the power response of the speaker with an acoustic lens. The difference between the line 4810 and line 4812 is the directivity index 4830. Line 4820 is the on-axis response of the speaker without an acoustic lens. Line 4822 is the power response of the speaker without an acoustic lens.

The difference between the line 4820 and line 4822 is the directivity index 4832. As shown in FIG. 48, the speaker assembly with the acoustic lens has lower directivity through 10,000 Hz. In addition, comparing lines 4810 and 4812 to lines 4820 and 4812 at 2000 Hz, the power output of the speaker with the acoustic lens is greater than the speaker without an acoustic lens.

The Helmholtz resonance frequency and "Q" (height of the peak) of each of the phase plugs or acoustic lenses may be chosen to provide gain in a desired frequency range as follows:

$$f_0 = \frac{1}{2\pi} c \sqrt{\frac{S}{L'V}}$$

$$Q = \frac{2\pi f_0 m}{R_r + R_m}$$

where $f_0$=Helmholtz resonance frequency (Hz), c=speed of sound in air (m/s)=343, S=surface area of aperture ($m^2$), L'=effective length [thickness] of aperture (m)≈1.7a, a=aperture radius (m), V=volume of air between the speaker diaphragm and the phase plug ($m^3$), Q=Helmholtz resonance quality factor, $m=\rho_0 SL'$, m=mass of air in aperture (kg), $\rho_0$=density of air ($kg/m^3$)=1.21, $$R_r = \rho_0 c \frac{k^2 S^2}{2\pi},$$

$R_r$=acoustical radiation resistance (Ns/m), and $R_m$=mechanical resistance (Ns/m).

For a phase plug or acoustic lens having an aperture surface area (S) of 1735 $mm^2$, a volume (V) of 40000 $m^3$, an effective aperture thickness (L') of 40 mm, and a mechanical resistance ($R_m$) of 0.27 Ns/m, the Helmholtz resonance frequency ($f_0$) is 1800 Hz and the Helmholtz resonance quality factor (Q) is 6 dB. As shown in the data of FIG. 48, this relationship may be confirmed by comparing the PWL curve 4812 at the top of FIG. 48 to the PWL curve 4822 at the top of FIG. 48. The PWL curve 4812 has a peak centered at 1800 Hz with a height of 6 dB.

The acoustic lowpass behavior and/or "cavity resonances" ($T_\pi$) of the assembly of a speaker and a phase plug or acoustic lens may be estimated. For a speaker having a surface area of the diaphragm ($S_d$), measured in square meters ($m^2$), a phase plug or acoustic lens having an aperture surface area (S), also measured in square meters ($m^2$), and an effective aperture thickness (L'), $$T_\pi = \frac{4}{4\cos^2 kL' + \left(\frac{S_d}{S} + \frac{S}{S_d}\right)^2 \sin^2 kL'}.$$

Accordingly, the insertion loss (IL), measured in dB, for a volume displacement of the diaphragm $V_d$, measured in cubic meters ($m^3$), of the phase plug or acoustic lens in union with the speaker may be empirically estimated as $$IL \approx 0.01\left(\frac{V_d}{S}\right)^2 + 0.001\left(\frac{V_d}{S}\right).$$

As an example, for an aperture surface area (S) of 570 $mm^2$ and a volume displacement of the diaphragm ($V_d$) of 3877 $mm^3$, the estimated insertion loss (IL) is 0.5 dB. Confirmation of the estimated IL is shown by the data in FIG. 48. The SPL transfer function curve 4810 shows a flat, constant, low frequency portion, which defines the IL, is about 0.5 dB. Other example acoustic lenses have an insertion loss less than 1 dB.

Distortion and insertion loss related effects may be reduced by adjusting the overall surface area of the apertures of the acoustic lens. For example, for an acoustic lens having an insertion loss of the acoustic lens is less than 1 dB, a plurality of supplemental apertures may be added. Each of the supplemental apertures may include a surface area "$S_s$".

Alternatively, the average cross-sectional surface area of all the supplemental apertures may be "$S_s$," where at least one of the supplemental apertures has a different dimension or cross-sectional surface area. The average cross-sectional surface area or the total additional cross-sectional area of the supplemental apertures may be adjusted to maintain a desired ratio of volume displacement of the speaker, "Vd", to the combination of all the surface areas "$S_s$" and S. For example, in some cases, a compression ratio of less than 10 may be desirable.

The acoustic lens may improve directivity of the loud speaker. In addition, the acoustic lenses may minimize the negative impact on SPL/PWL frequency response, insertion loss, and distortion. While in some frequency ranges the SPL/PWL may be reduced, another benefit is that the acoustic lenses described herein may increase SPL/PWL in other frequency regions. Another benefit of the acoustic lenses described herein is acoustic lowpass filtering behavior. These improvements may be obtained at essentially any audio frequency. The improvements typically span a frequency range of at least one octave to two or more octaves.

In FIG. 48, the output of the speaker with the phase plug or acoustic lens, may increase overall sound power output. The increased overall sound power output may be indicated by comparison of the power output of the same speaker without the phase plug or acoustic lens 4822 to the power output of the same speaker with a phase plug or acoustic lens 4812 over the operating bandwidth (200-4000 Hz). The directivity index is lower on the speaker with the phase plug or acoustic lens than on the speaker without the phase plug or acoustic lens over its operating bandwidth. Accordingly, the speaker assembly with a phase plug or an acoustic lens simultaneously may have increased sound power output over a wider listening angle that the same speaker assembly without the phase plug or acoustic lens.

Figure 49:
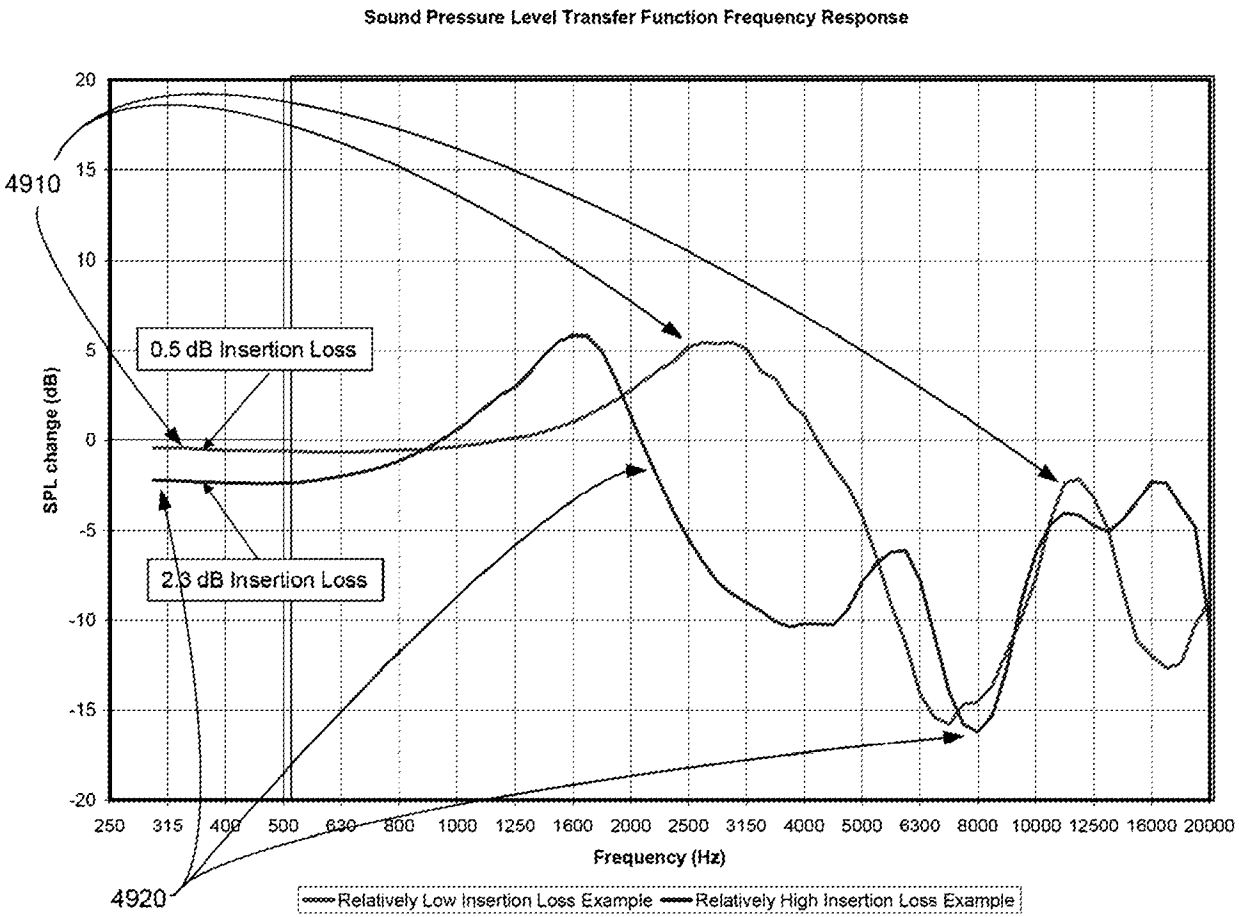
FIG. 49 depicts insertion loss of an example of a phase plug with a relatively high insertion loss and an acoustic lens with a relatively low insertion loss.

In FIG. 49, insertion loss 4910 of an acoustic lens in a speaker assembly is less than 0.5 dB below 1000 Hz. In addition, the insertion loss remains lower longer than the relatively high insertion loss 4920 of a phase plug over the frequency range between 315 Hz and 1000 Hz.

Figure 50A:
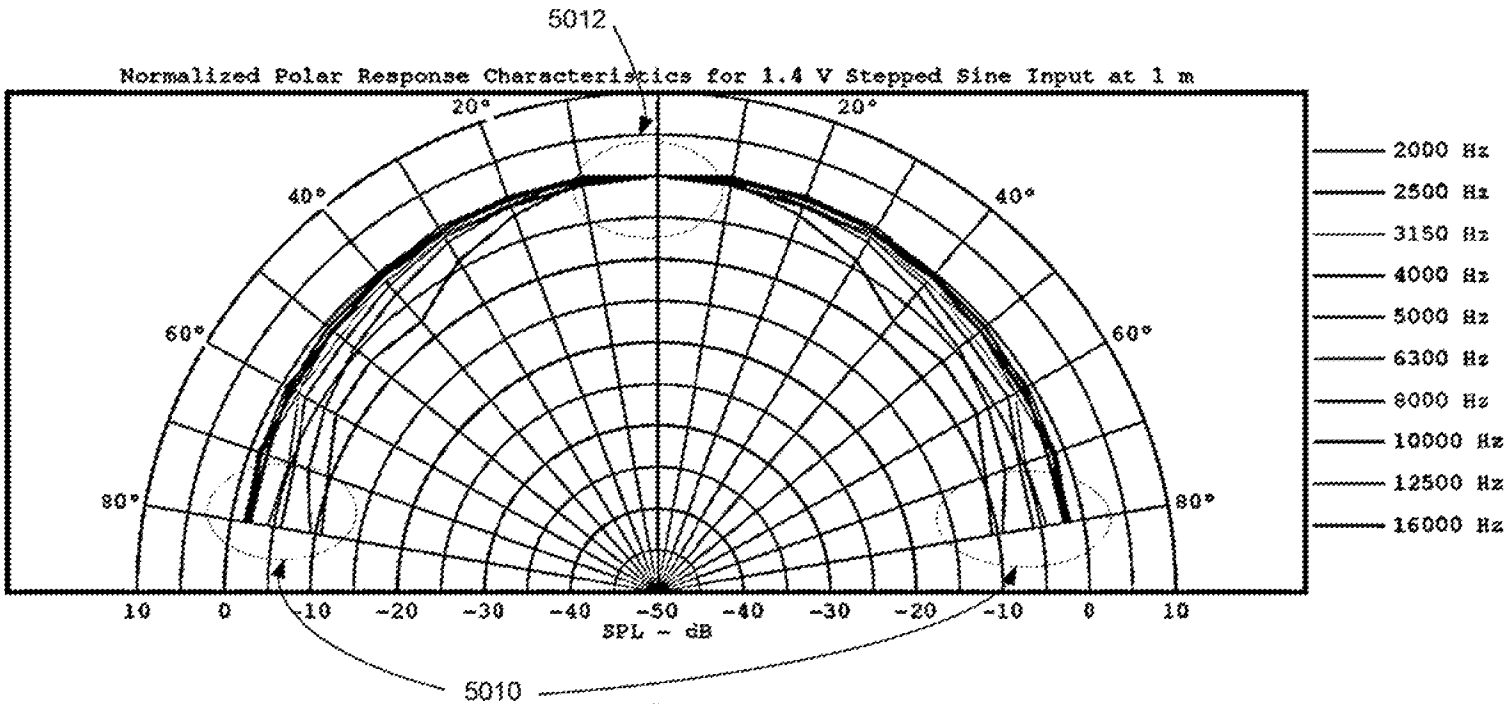
FIGS. 50A and 50B depicts the normalized polar response data from a speaker without an acoustic lens (50B) and the same speaker with an acoustic lens (50A).
Figure 50B:
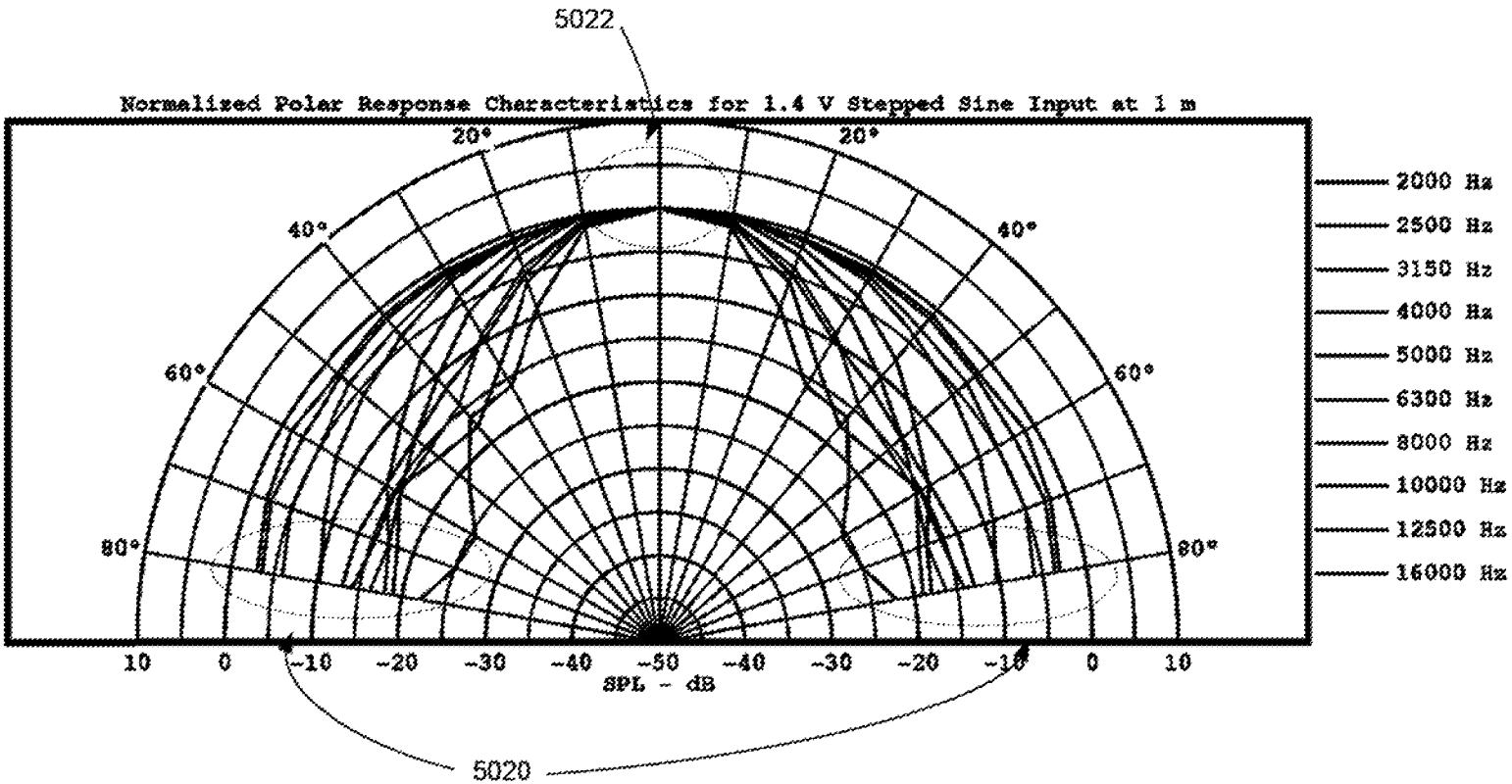

In FIGS. 50A and 50B, polar response data shows directivity improvement of an example of the phase plug, the acoustic lens, or the assembly, in FIGS. 1-47. In FIG. 50A, the plots show a polar response of a speaker, at different off-axis angles, with a phase plug or acoustic lens. In FIG. 50B, the plots show a polar response of a speaker at different off-axis angles, without a phase plug or acoustic lens. The speaker response without the speaker 5150, 5151, 5052, 5053, 5054, 5055, 5056, 5057, and 5058 correspond to the off-axis response at 0 degrees, 10 degrees, 20 degrees, 30 degrees, 40 degrees, 50 degrees, 60 degrees, 70 degrees, and 80 degrees off-axis, respectively.

In FIG. 50A, a grouping of on-axis normalized polar response characteristics 5012 are grouped at 0 db. The groupings of off-axis normalized polarized responses at 5010 shows that the characteristics are grouped within 10 db. In contrast, in FIG. 50B, the groupings of off-axis normalized responses 5020 is spread, less tightly grouped, at the 80 degree off-axis position. Comparing the response characteristics of a speaker with and without the acoustic lens may be characterized by the tightness of the grouping of the polar response at various off-axis angles from the on-axis position of the loudspeaker.

Figure 51A:
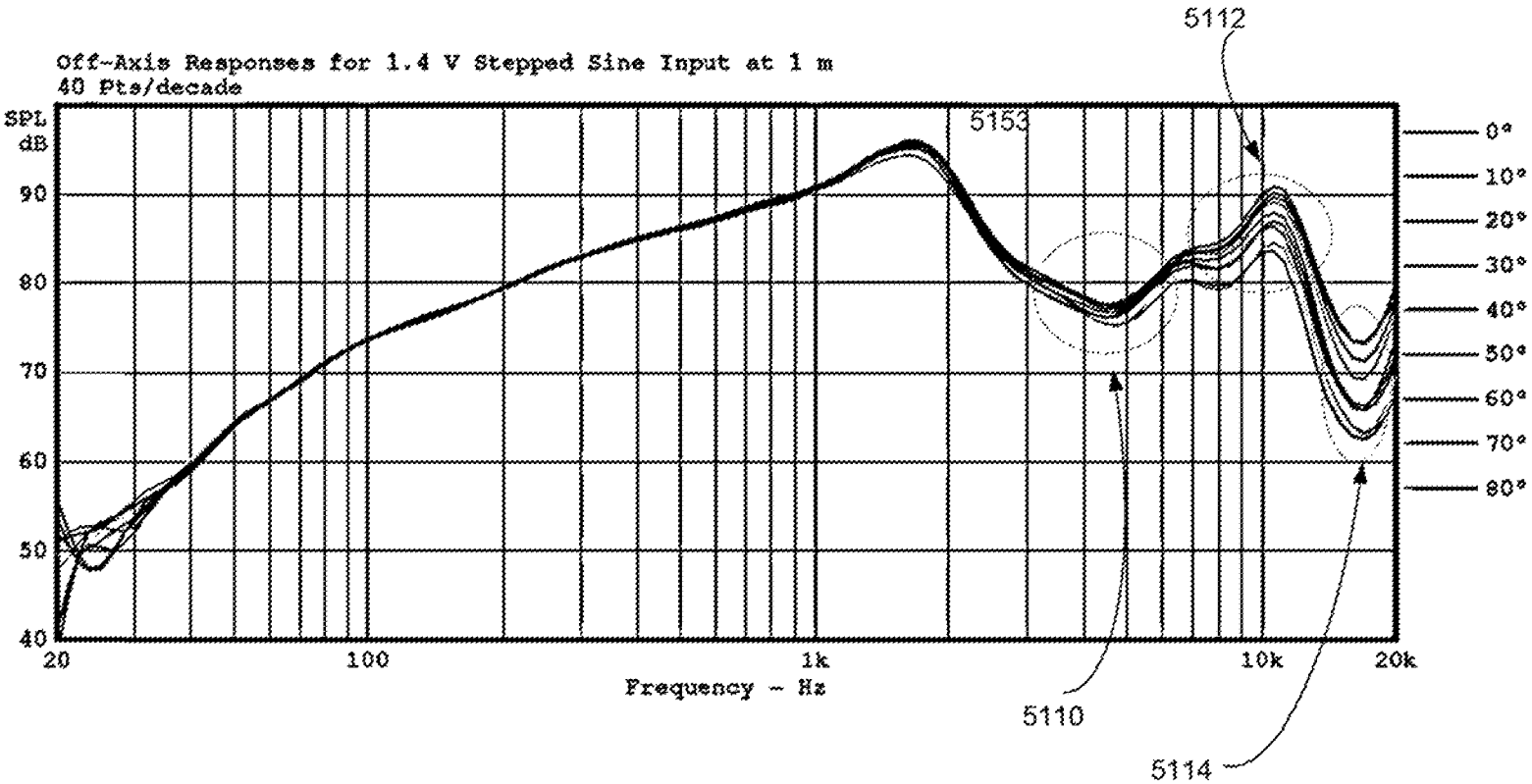
FIGS. 51A and 51B depicts the off-axis sound pressure level (SPL) data from a speaker without an acoustic lens (51B) and the same speaker with an acoustic lens (51A).
Figure 51B:
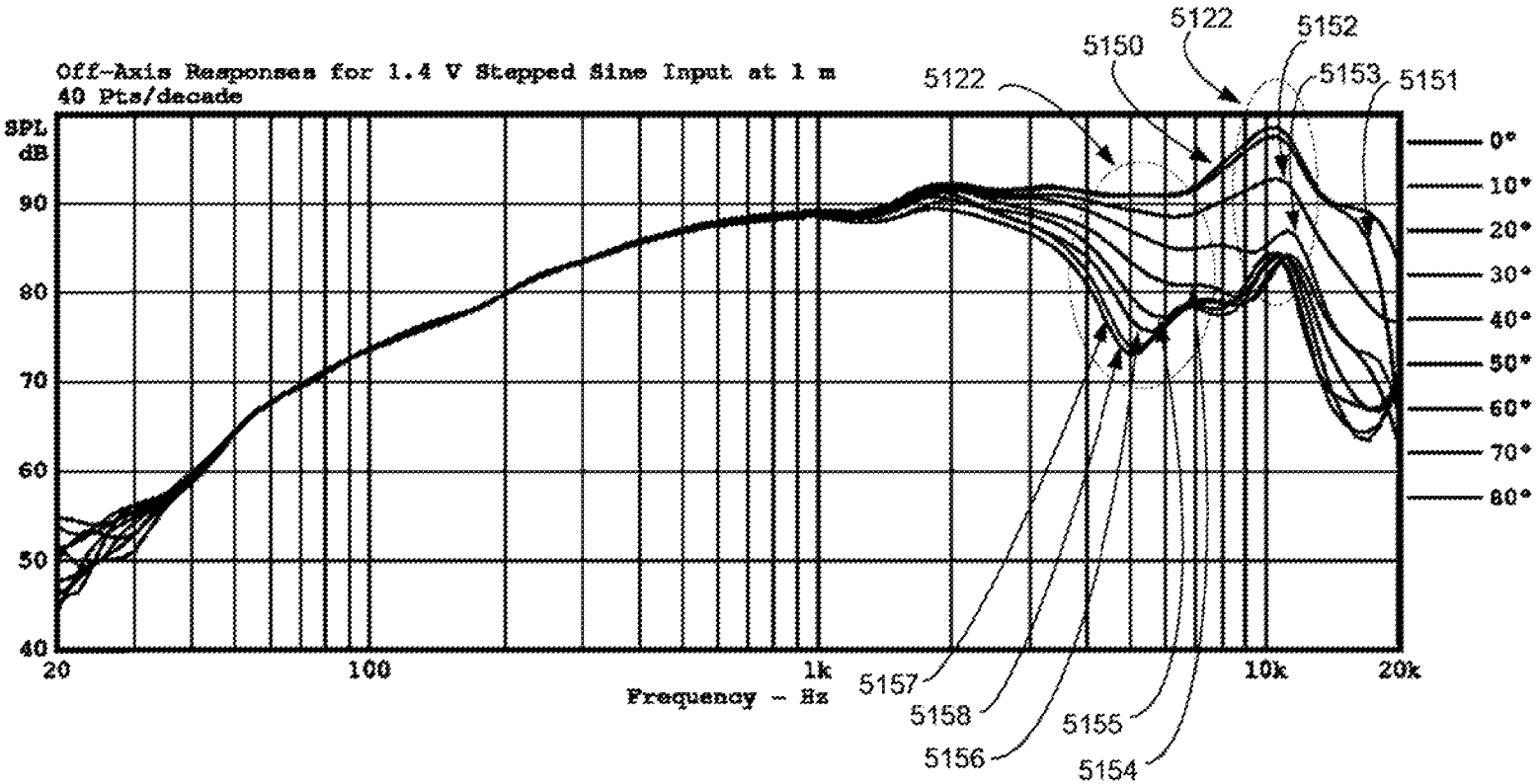

As another example of improved directivity performance, in 51A, the off-axis sound pressure level (SPL) data from a speaker without an acoustic lens has relatively tight groupings 5110, 5112, and 5114, of response curves. In contrast, in FIG. B, the off-axis sound pressure level data has groupings 5120 and 5122. The relatively tight groupings 5110, 5112, and 5114, correspond to improved directivity. In contrast, in FIG. 51B, the grouping o 5110 and 5112 of the SLP for each off-axis position diverges substantially and non-uniformly.

Figure 52:
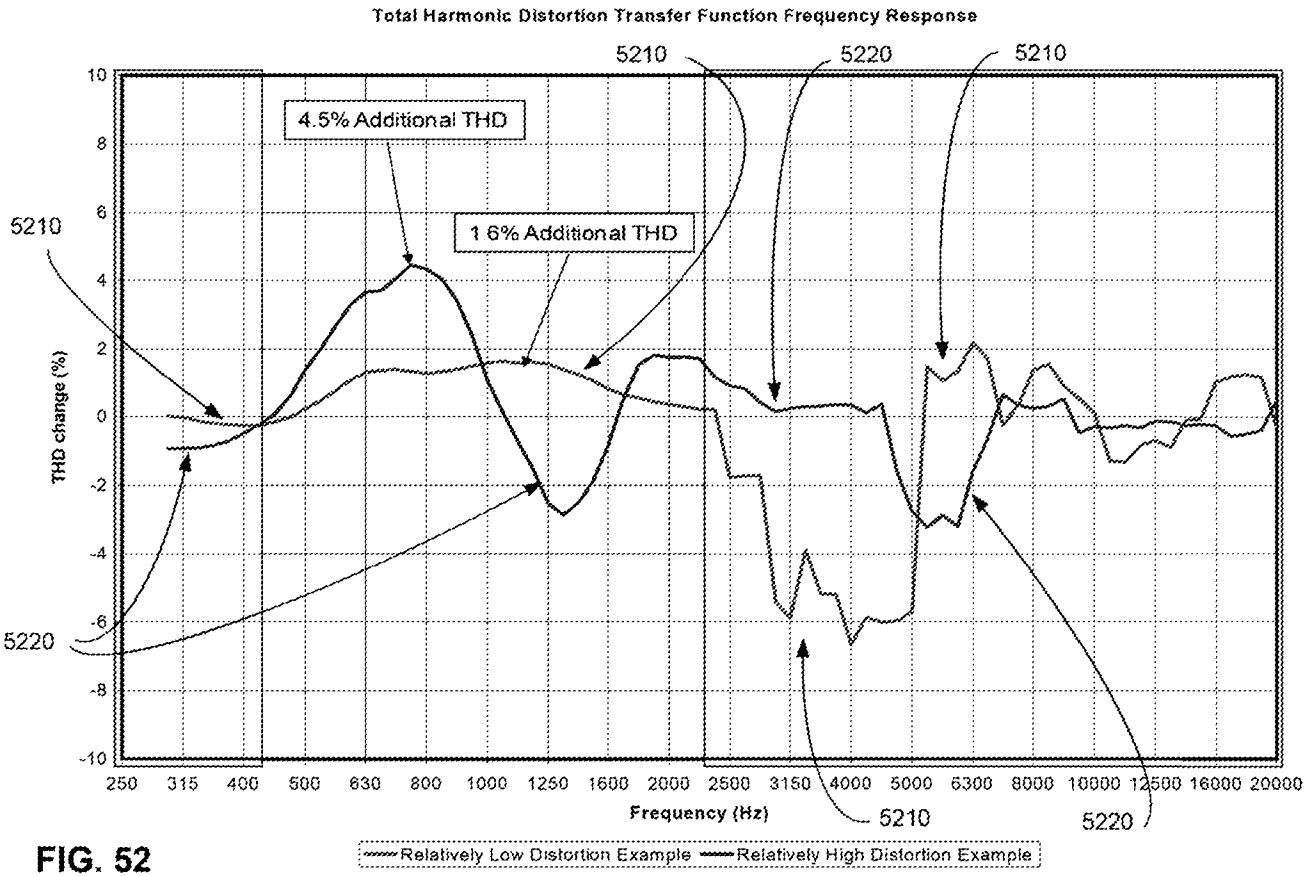
FIG. 52 depicts the distortion effects of an example of a phase plug with relatively high distortion and an acoustic lens with relatively low distortion.

In FIG. 52, the THD data 5220 represents relatively high distortion effects of an example of a phase plug, where the relatively high distortion add around 4.5% of additional THD to the performance of the system. In contrast, the THD data 5220 represents the THD of a speaker assembly with an acoustic lens, as described herein, where the THD is realtivey low and adds no more than 1.6% of additional THD.

Figure 53:
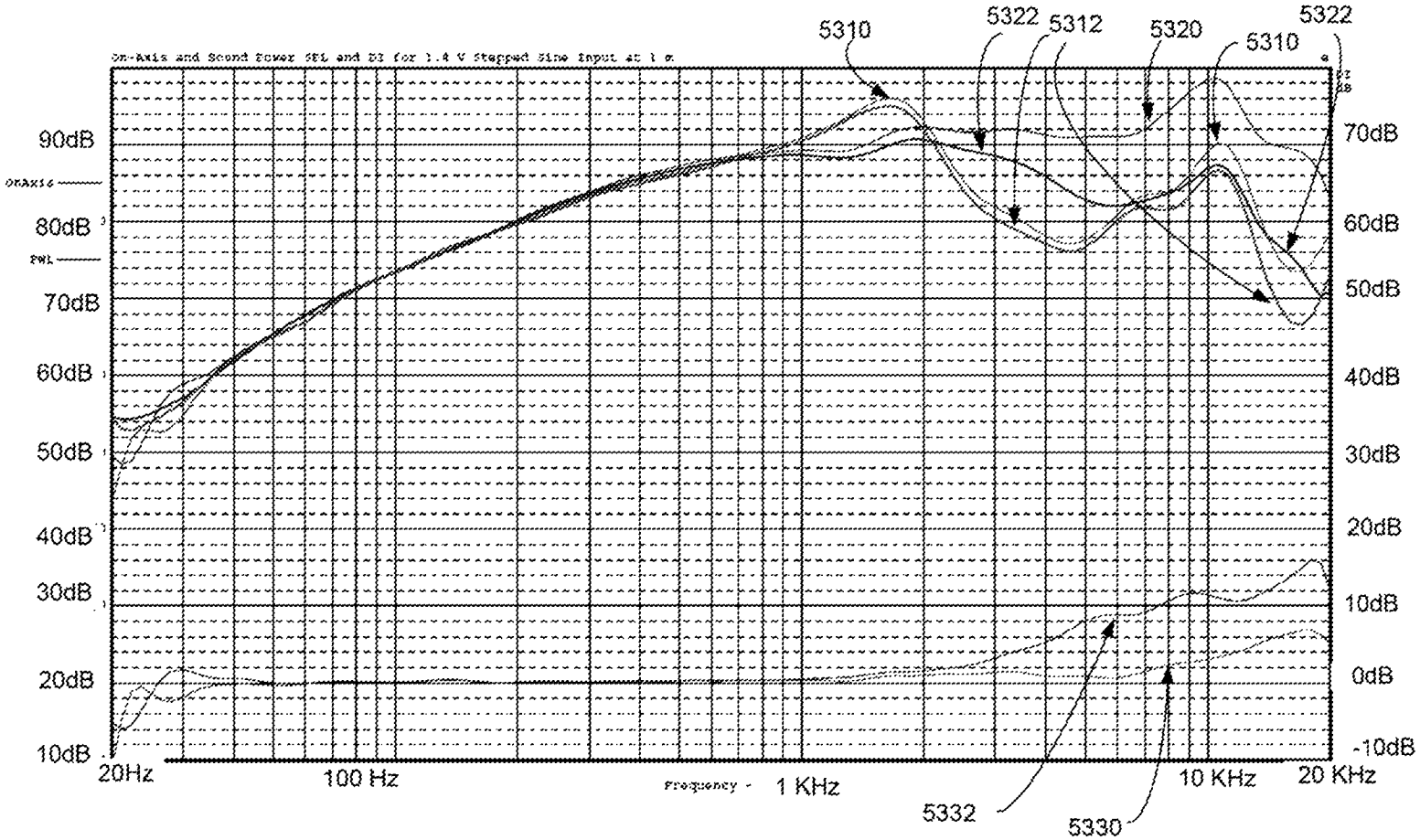
FIG. 53 depicts sound pressure level (SPL), power watt level (PWL), and directivity index (DI) data from a speaker without an acoustic lens and the same speaker with an acoustic lens.

FIG. 53 depicts data representative of a sound pressure level (SPL), a power watt level (PWL), and a directivity index (DI) for a speaker without an acoustic lens). In FIG. 53, sound pressure level (SPL) 5310, power watt level (PWL) 5312, and the directivity index (DI) 5330 correspond to the performance of an assembly having a speaker and an acoustic lens. In contrast, sound pressure level (SPL) 5320, power watt level (PWL) 5322, and the directivity index (DI) 5332 correspond to the performance of the same speaker without an acoustic lens.

In FIG. 53, the on-axis response 5320 of the speaker without an acoustic lens is contrasted with power response 5322 of the speaker without an acoustic lens. The difference between the on-axis response 5320 and power response 5322 is the directivity index 5232. As shown in FIG. 48, the speaker assembly with the acoustic lens has lower directivity through 20,000 Hz. In addition, comparing the on-axis response 5310 and power response 5312 of the speaker with the acoustic lens to the on-axis response 5320 and power response 5322 of the speaker without the acoustic lenses, at around 1800 Hz, the power output of the speaker with the acoustic lens is greater than the speaker without an acoustic lens.

The phase plug or acoustic lens may be formed from a material that includes a ferromagnetic material or has ferromagnetic properties. Some phase plugs or acoustic lenses may include a perforated surface. Alternatively, phase plugs or acoustic lenses may include a ferromagnetic mesh over the apertures of the phase plugs or acoustic lenses. In other examples, the phase plug or acoustic lens may be magnetically coupled back to the speaker in order to improve magnetic flux collection. In addition to reducing stray magnetic flux, the improved magnetic flux collection, as described above, may increase the efficiency of the speaker. In addition, the material that forms the phase plug may be selected to enhance heat dissipation, provide stray magnetic flux shielding, and magnetic flux collection, as described above.

While various examples of the invention have been described, it will be apparent to those of ordinary skill in the art that many more examples and implementations are possible within the scope of the invention. Accordingly, the invention is not to be restricted except in light of the attached claims and their equivalents.

We claim:

1. An assembly for improving directivity performance of a speaker assembly comprising:

a speaker assembly having a dustcap coupled to a diaphragm; and an acoustic lens coupled to the speaker assembly and configured to cover the dustcap and the diaphragm, the acoustic lens comprising:

a first surface and a second surface that unite to form an edge to define a perimeter;

an effective aperture through the first and second surfaces comprising a plurality of perforations, the effective aperture comprises a dome surface having an apex and a dome base, the dome surface being convex relative to the dustcap;

a substantially conical segment that lies between the dome base and the perimeter, where the conical segment is angled from the perimeter to the dome base toward the speaker assembly; and a mounting feature between the conical segment and the perimeter, the mounting feature mated with the speaker assembly to form a substantially air tight seal between the speaker assembly and the acoustic lens.

2. The assembly of claim 1, where the acoustic lens further comprises a solid portion that lies between the effective aperture and the mounting feature.

3. The assembly of claim 2, where at least some of the solid portion lies in a first plane, and the apex lies below the first plane.

4. The assembly of claim 1, where a concentric fold is formed by a union of the dome base and the conical segment, and the concentric fold is positioned adjacently relative to an intersection of the dustcap and the diaphragm.

5. The assembly of claim 1, where the conical segment is angled to form a selected volume of an air space between the speaker assembly and the acoustic lens.

6. The assembly of claim 1, where the dome surface is convex relative to the dustcap to form a selected volume of an air space between the dome surface and the dustcap.

7. The assembly of claim 1, where the acoustic lens comprises ferromagnetic properties.

8. The assembly of claim 7, where the acoustic lens is magnetically coupled to the speaker assembly to provide magnetic flux collection.

9. The assembly of claim 1, where the acoustic lens provides magnetic flux shielding.

10. The assembly of claim 1, where the dome surface and conical segment are configured to reduce vibration of the effective aperture.

11. The assembly of claim 1, where the conical segment is angled based upon a volume displacement of the diaphragm of the speaker assembly, where the volume displacement is a volume of air that is displaced by movement of the diaphragm.

12. The assembly of claim 1, where at least a portion of the substantially conical segment includes at least a portion of the plurality of perforations.

13. The assembly of claim 1, where the effective aperture is substantially located in a central location of the acoustic lens.

14. The assembly of claim 1, where the acoustic lens is configured to increase overall sound power output of the speaker assembly over an operating bandwidth of 200-4000 Hz.

15. The assembly of claim 1, where a surface area of the effective aperture is selected based upon a volume displacement of the diaphragm of the speaker assembly, where the volume displacement is a volume of air that is displaced by movement of the diaphragm.

16. The assembly of claim 1, where the speaker assembly includes a volume displacement of the diaphragm "Vd", where the volume displacement is a volume of air that is displaced by movement of the diaphragm, where the effective aperture has a surface area, "S", where the aperture surface area is configured to obtain a desired insertion loss, "IL", of the acoustic lens with respect to the speaker assembly within a range of frequencies, where insertion loss $$IL \approx 0.01\left(\frac{V_d}{S}\right)^2 + 0.001\left(\frac{V_d}{S}\right)$$

within the range of frequencies.

17. An apparatus for improving directivity performance of a speaker assembly comprising:

a first surface and a second surface that unite to form an edge to define a perimeter;

an effective aperture through the first and second surfaces comprising a plurality of perforations, the effective aperture comprises a dome surface having an apex and a dome base, the dome surface being convex relative to the first surface;

a substantially conical segment that lies between the dome base and the perimeter, where the conical segment is angled generally concave relative to the first surface; and a mounting feature between the conical segment and the perimeter, the mounting feature configured to mate with the speaker assembly to form a substantially air tight seal between the speaker assembly and the apparatus.

18. The assembly of claim 17, further comprising a solid portion that lies between the effective aperture and the mounting feature.

19. The assembly of claim 17, where the acoustic lens comprises ferromagnetic properties.

20. An apparatus for improving directivity performance of a speaker assembly comprising:

a member including a first surface and a second surface;

where the first surface and the second surface unite to form a first edge to define a perimeter, where the perimeter includes a mounting feature;

where the first surface and the second surface further unite to form a plurality of perforations arranged to define an effective aperture through the member;

where the member further includes a solid portion that lies between the effective aperture and the mounting feature, and where at least some portion of the solid portion lies substantially in a first plane;

where the mounting feature includes a foot feature that lies in a second plane, where the foot feature is conformed to mate with a speaker to form a substantially air tight seal between the speaker and the foot feature of the member;

where a portion of the effective aperture includes a dome surface having an apex and a dome base, where the apex lies close to the first plane, and the dome base lies close to a third plane, and where the third plane lies between the first plane and the second plane; and where the member further includes a substantially conical segment that lies between the dome base of the dome surface and the solid portion.

* * * * *